US010906723B2

(12) United States Patent
Guerdrum et al.

(10) Patent No.: US 10,906,723 B2
(45) Date of Patent: Feb. 2, 2021

(54) COLLAPSIBLE PORTABLE STORAGE CONTAINER

(71) Applicant: OTTER PRODUCTS, LLC, Fort Collins, CO (US)

(72) Inventors: Jonathan H. Guerdrum, Fort Collins, CO (US); Douglas A. Kempel, Fort Collins, CO (US); Matthew M. Glanzer, Fort Collins, CO (US); Richard W. Vinson, Fort Collins, CO (US); Patrick G. Skovsted, Fort Collins, CO (US); Jason Sagen, Fort Collins, CO (US); Alan V. Morine, Fort Collins, CO (US); Todd Eichinger, Fort Collins, CO (US); Alex S. Breeden, Fort Collins, CO (US); Taylor S. Massey, Fort Collins, CO (US); Peter Goldsmith, Fort Collins, CO (US)

(73) Assignee: Otter Products, LLC, Fort Collins, CO (US)

( * ) Notice: Subject to any disclaimer, the term of this patent is extended or adjusted under 35 U.S.C. 154(b) by 141 days.

(21) Appl. No.: 15/982,246

(22) Filed: May 17, 2018

(65) Prior Publication Data

US 2018/0346229 A1 Dec. 6, 2018

Related U.S. Application Data

(60) Provisional application No. 62/515,004, filed on Jun. 5, 2017, provisional application No. 62/585,630, filed on Nov. 14, 2017.

(51) Int. Cl.
*B65D 81/38* (2006.01)
*B65D 25/16* (2006.01)
(Continued)

(52) U.S. Cl.
CPC ..... *B65D 81/3813* (2013.01); *B65D 11/1826* (2013.01); *B65D 21/086* (2013.01);
(Continued)

(58) Field of Classification Search
CPC ..... B65D 11/1826; B65D 11/184; B65D 21/086; B65D 21/08; B65D 25/14;
(Continued)

(56) References Cited

U.S. PATENT DOCUMENTS 1,468,563 A 9/1923 Girard
2,627,993 A 2/1953 Hafner
(Continued)

FOREIGN PATENT DOCUMENTS

EP 3061704 A1 8/2016
WO 2004029526 A1 4/2004
(Continued)

OTHER PUBLICATIONS

Best Cooler Reviews, Best Folding and Collapsible Cooler—It's All About Convenience, downloaded from https://bestcooler.reviews/best-folding-collapsible-cooler/ January 15, 2018, 8 pages.
(Continued)

*Primary Examiner* — James N Smalley
*Assistant Examiner* — Jennifer Castriotta

(57) ABSTRACT

A portable insulated storage container includes an insulated body having an internal cavity for storing one or more items and an insulated lid. The insulated body includes a base, first and second opposing end panels, and first and second opposing side panels. The first and second opposing end panels are each configured to move between a first vertical orientation and a second horizontal orientation. Each of the first and second opposing side panels includes an upper
(Continued)

portion connected to a lower portion by a hinge. The insulated lid configured to engage the insulated body to close the internal cavity.

18 Claims, 49 Drawing Sheets

(51) Int. Cl.

| | |
|---|---|
| ***B65D 25/06*** | (2006.01) |
| ***B65D 25/28*** | (2006.01) |
| ***B65D 43/02*** | (2006.01) |
| ***B65D 21/08*** | (2006.01) |
| ***B65D 45/20*** | (2006.01) |
| ***B65D 6/18*** | (2006.01) |
| ***B65D 45/02*** | (2006.01) |
| *A45C 7/00* | (2006.01) |

(52) U.S. Cl.
CPC ..... *B65D 25/06* (2013.01); *B65D 25/16* (2013.01); *B65D 25/2805* (2013.01); *B65D 25/2808* (2013.01); *B65D 43/0202* (2013.01); *B65D 45/02* (2013.01); *B65D 45/20* (2013.01); *A45C 7/0036* (2013.01); *A45C 2200/20* (2013.01); *B65D 2543/00194* (2013.01); *B65D 2543/00277* (2013.01); *B65D 2543/00296* (2013.01); *B65D 2543/00518* (2013.01); *B65D 2543/00842* (2013.01); *B65D 2543/00972* (2013.01); *F25D 2323/061* (2013.01)

(58) Field of Classification Search
CPC ..... B65D 25/16; B65D 5/60; B65D 81/3813; B65D 81/3848; A45C 7/0077; A45C 7/0036; A45C 2200/20; F25D 2323/061
USPC ..... 220/6, 4.28, 7, 666, 62.21, 23.87, 23.89; 206/546
See application file for complete search history.

(56) References Cited

U.S. PATENT DOCUMENTS 3,347,060 A 10/1967 Barkan
3,395,550 A 8/1968 Dungan
3,658,035 A * 4/1972 Harris ..... A01K 63/003 119/269
3,850,398 A 11/1974 Kantor
3,868,829 A 3/1975 Mann et al.
3,939,986 A 2/1976 Pierro
4,024,731 A 5/1977 Branscum
4,213,310 A 7/1980 Buss
D275,822 S 10/1984 Gatland et al.
4,515,421 A 5/1985 Steffes
4,560,128 A 12/1985 Willeby et al.
4,606,461 A 8/1986 Bolton
RE32,740 E 8/1988 Steffes
4,841,661 A 6/1989 Moore
4,964,528 A 10/1990 Wagoner
4,988,216 A 1/1991 Lyman
5,052,185 A 10/1991 Spahr
D325,323 S 4/1992 Kahl
5,103,884 A 4/1992 Roman
D328,389 S 8/1992 Pardo
D330,488 S 10/1992 Daniels
5,181,612 A 1/1993 Liu
5,215,248 A 6/1993 Moser
5,285,656 A 2/1994 Peters
D353,082 S 12/1994 Keven
D354,419 S 1/1995 Kahl et al.
5,403,095 A 4/1995 Melk
5,509,279 A 4/1996 Brown et al.
5,562,228 A 10/1996 Ericson
5,605,056 A 2/1997 Brown et al.
5,622,276 A 4/1997 Simmons
5,669,233 A 9/1997 Cook et al.
D387,249 S 12/1997 Mogil
D391,121 S 2/1998 Melk
5,816,432 A 10/1998 Hammen et al.
5,845,515 A 12/1998 Nelson
5,850,915 A 12/1998 Tajima
5,857,778 A 1/1999 Ells
5,913,448 A 6/1999 Mann et al.
D419,297 S 1/2000 Richardson et al.
D419,767 S 2/2000 Richardson et al.
D419,768 S 2/2000 Richardson et al.
6,039,202 A 3/2000 Olstad et al.
D425,761 S 5/2000 Philipson et al.
6,065,873 A 5/2000 Fowler
D435,196 S 12/2000 Gregor et al.
6,185,860 B1 2/2001 Thibodeaux
6,193,097 B1 2/2001 Perianes
6,234,677 B1 5/2001 Mogil
6,244,458 B1 6/2001 Frysinger et al.
D444,683 S 7/2001 Corrion
6,276,579 B1 8/2001 DeLoach
D451,765 S 12/2001 Israel et al.
6,325,281 B1 12/2001 Grogan
6,328,179 B1 12/2001 Conrado et al.
D455,934 S 4/2002 Culp et al.
6,409,066 B1 6/2002 Schneider et al.
D465,134 S 11/2002 Joss
6,474,095 B1 11/2002 Chan
6,505,479 B2 1/2003 Defelice et al.
D472,384 S 4/2003 Richardson
6,595,687 B2 7/2003 Godshaw et al.
6,736,309 B1 5/2004 Westerman et al.
6,751,963 B2 6/2004 Navedo et al.
D502,599 S 3/2005 Cabana et al.
6,895,778 B1 5/2005 Ackerman
D513,123 S 12/2005 Richardson et al.
D514,808 S 2/2006 Morine et al.
6,993,931 B1 2/2006 Hamilton
D516,807 S 3/2006 Richardson et al.
D527,226 S 8/2006 Maldonado
D527,953 S 9/2006 Gal
7,140,507 B2 11/2006 Maldonado et al.
7,296,433 B2 11/2007 Uihlein et al.
7,389,608 B1 6/2008 MacKay
7,415,794 B1 8/2008 Thompson
7,682,080 B2 3/2010 Mogil
7,791,003 B2 9/2010 Lockhart et al.
7,900,816 B2 3/2011 Kastanek et al.
D635,832 S 4/2011 Bergin
D637,044 S 5/2011 Davis
8,011,194 B2 9/2011 Dimmitt
8,043,004 B2 10/2011 Mogil
8,065,889 B1 11/2011 Silberman
8,209,995 B2 7/2012 Kieling et al.
8,246,190 B2 8/2012 Boiteau et al.
8,317,046 B2 11/2012 Vanderberg et al.
8,365,944 B2 2/2013 Vanderberg et al.
8,403,162 B2 3/2013 Vanderberg et al.
8,424,699 B2 4/2013 Vanderberg et al.
8,430,265 B2 4/2013 Vanderberg et al.
8,448,813 B2 5/2013 Vanderberg et al.
D712,720 S 9/2014 Seiders
D712,721 S 9/2014 Seiders
D712,722 S 9/2014 Seiders
D712,723 S 9/2014 Seiders
D714,125 S 9/2014 Seiders
8,863,546 B2 10/2014 Oberweis
8,875,964 B1 11/2014 Vanderberg
8,910,819 B2 12/2014 Seiders
8,919,082 B1 12/2014 Cataldo
8,925,752 B2 1/2015 Smith
D722,474 S 2/2015 Seiders
D722,475 S 2/2015 Seiders
D732,348 S 6/2015 Seiders et al.
D732,349 S 6/2015 Seiders et al.
D732,350 S 6/2015 Seiders et al.
D732,899 S 6/2015 Seiders et al.

(56) References Cited

U.S. PATENT DOCUMENTS

| | | | |
|---|---|---|---|
| 9,139,352 | B2 | 9/2015 | Seiders et al. |
| 9,187,232 | B2 | 11/2015 | Seiders |
| D752,347 | S | 3/2016 | Seiders et al. |
| 9,316,428 | B2 | 4/2016 | Mech |
| 9,389,010 | B1 | 7/2016 | Booker |
| 9,408,445 | B2 | 8/2016 | Mogil et al. |
| 9,433,200 | B2 | 9/2016 | Norman |
| 9,446,847 | B2 | 9/2016 | Richardson et al. |
| 9,500,400 | B2 | 11/2016 | Smith |
| 9,834,342 | B2 | 4/2017 | Seiders |
| D786,559 | S | 5/2017 | Seiders et al. |
| D786,560 | S | 5/2017 | Seiders et al. |
| D786,561 | S | 5/2017 | Seiders et al. |
| D786,562 | S | 5/2017 | Seiders et al. |
| D787,187 | S | 5/2017 | Seiders et al. |
| D797,454 | S | 9/2017 | Seiders et al. |
| D797,455 | S | 9/2017 | Seiders et al. |
| D798,670 | S | 10/2017 | Seiders et al. |
| D799,276 | S | 10/2017 | Seiders et al. |
| D799,277 | S | 10/2017 | Seiders et al. |
| D799,905 | S | 10/2017 | Seiders et al. |
| D801,123 | S | 10/2017 | Seiders et al. |
| 9,796,517 | B2 | 10/2017 | Seiders et al. |
| D802,373 | S | 11/2017 | Seiders et al. |
| D804,905 | S | 12/2017 | Seiders et al. |
| D805,851 | S | 12/2017 | Seiders et al. |
| D820,646 | S | 6/2018 | Yockey |
| D821,165 | S | 6/2018 | Guerdrum et al. |
| D821,825 | S | 7/2018 | Sullivan et al. |
| D823,064 | S | 7/2018 | Eichinger et al. |
| D823,065 | S | 7/2018 | Eichinger et al. |
| D823,066 | S | 7/2018 | Eichinger et al. |
| 10,029,842 | B2 | 7/2018 | Seiders et al. |
| D824,730 | S | 8/2018 | Guerdrum et al. |
| 10,092,137 | B1 | 10/2018 | Nelson et al. |
| D835,470 | S | 12/2018 | Seiders et al. |
| D835,471 | S | 12/2018 | Seiders et al. |
| D835,472 | S | 12/2018 | Seiders et al. |
| D835,946 | S | 12/2018 | Seiders et al. |
| D838,983 | S | 1/2019 | Seiders et al. |
| D838,984 | S | 1/2019 | Seiders et al. |
| D840,150 | S | 2/2019 | Seiders et al. |
| 10,221,005 | B2 | 3/2019 | James |
| D850,865 | S | 6/2019 | Smith et al. |
| 10,443,918 | B2 | 10/2019 | Li et al. |
| 2003/0038138 | A1 | 2/2003 | Komurke |
| 2003/0106895 | A1 | 6/2003 | Kalal |
| 2003/0136702 | A1 | 7/2003 | Redzisz et al. |
| 2003/0141424 | A1 | 7/2003 | Thomas |
| 2004/0178208 | A1 | 9/2004 | Leba et al. |
| 2004/0238543 | A1 | 12/2004 | Askew |
| 2004/0262319 | A1 | 12/2004 | Fisher |
| 2005/0006268 | A1 | 1/2005 | Futernick |
| 2005/0133557 | A1 | 6/2005 | McKenzie et al. |
| 2005/0263527 | A1 | 12/2005 | Maldonado et al. |
| 2005/0263528 | A1 | 12/2005 | Maldonado et al. |
| 2005/0279123 | A1 | 12/2005 | Maldonado et al. |
| 2005/0279124 | A1 | 12/2005 | Maldonado |
| 2006/0065655 | A1* | 3/2006 | Taylor ..... B65D 11/1826 220/6 |
| 2006/0180624 | A1 | 8/2006 | Sadow et al. |
| 2007/0137958 | A1 | 6/2007 | Hamlin |
| 2007/0278234 | A1 | 12/2007 | Mogil |
| 2008/0094853 | A1 | 4/2008 | Kim et al. |
| 2008/0260303 | A1 | 10/2008 | Lesseux et al. |
| 2009/0159471 | A1 | 6/2009 | Koppe |
| 2009/0218342 | A1* | 9/2009 | Pickles ..... B65D 25/16 220/6 |
| 2010/0065466 | A1 | 3/2010 | Perkins |
| 2010/0072215 | A1 | 3/2010 | Coon |
| 2010/0287976 | A1 | 11/2010 | Roof et al. |
| 2011/0056233 | A1 | 3/2011 | Flaker et al. |
| 2011/0182532 | A1 | 7/2011 | Baltus |
| 2011/0203297 | A1 | 8/2011 | Oberweis |
| 2011/0220531 | A1 | 9/2011 | Meether et al. |
| 2011/0289958 | A1 | 12/2011 | White et al. |
| 2013/0228583 | A1 | 9/2013 | Mayer |
| 2013/0264161 | A1 | 10/2013 | Thompson |
| 2014/0013789 | A1 | 1/2014 | Conrad et al. |
| 2014/0248003 | A1 | 9/2014 | Mogil et al. |
| 2015/0158539 | A1 | 6/2015 | Jensen et al. |
| 2015/0210444 | A1 | 7/2015 | Mercado et al. |
| 2015/0241107 | A1 | 8/2015 | Mech |
| 2015/0298886 | A1 | 10/2015 | Knight et al. |
| 2015/0369529 | A1 | 12/2015 | Monroe |
| 2016/0101924 | A1 | 4/2016 | Mitchell et al. |
| 2016/0257479 | A1 | 9/2016 | Seiders et al. |
| 2016/0279840 | A1 | 9/2016 | French et al. |
| 2016/0347507 | A1 | 12/2016 | Kendrick |
| 2017/0001785 | A1 | 1/2017 | Ripley et al. |
| 2017/0023289 | A1 | 1/2017 | Anderson |
| 2017/0073146 | A1 | 3/2017 | Kuhn et al. |
| 2017/0073147 | A1 | 3/2017 | Kuhn |
| 2017/0121059 | A1 | 5/2017 | Faris |
| 2017/0233139 | A1 | 8/2017 | Averill |
| 2017/0245486 | A1 | 8/2017 | Larson et al. |
| 2017/0305639 | A1 | 10/2017 | Kuhn et al. |
| 2017/0350635 | A1 | 12/2017 | Thirumurugavel |
| 2018/0015938 | A1 | 1/2018 | DeFrancia |
| 2018/0141718 | A1 | 5/2018 | Ahlström et al. |
| 2018/0149400 | A1 | 5/2018 | Valencia |
| 2018/0186547 | A1 | 7/2018 | Morine et al. |
| 2018/0186550 | A1 | 7/2018 | Morine et al. |
| 2018/0263346 | A1 | 9/2018 | Stephens |
| 2018/0290814 | A1 | 10/2018 | Smith |
| 2018/0335241 | A1 | 11/2018 | Li et al. |
| 2018/0353379 | A1 | 12/2018 | Chou et al. |
| 2019/0023480 | A1 | 1/2019 | Lin |

FOREIGN PATENT DOCUMENTS

| | | | |
|---|---|---|---|
| WO | 2006007266 | A2 | 1/2006 |
| WO | 2006009537 | A1 | 1/2006 |
| WO | 2014105962 | A1 | 7/2014 |
| WO | 2016154105 | A1 | 9/2016 |

OTHER PUBLICATIONS

Clevermade, CleverMade CleverCrates 45 Liter Collapsible Storage Bin/Container; Grated Wall Utility Basket/Tote, Royal Blue, downloaded from https://www.amazon.com/CleverMade-CleverCrates-Collapsible-Storage-Container/dp/B00UM4D63W/ref=sr_1_8?ie=UTF8&qid=1516048768&sr=8-8&keywords=collapsible%2Bmilk%2Bcrate&th=1 Jan. 15, 2018, 13 pages.

Coleman, 75 Can Collapsible Sport Cooler, downloaded from https://www.coleman.com/large-sport-collapsible/2000015225.html Jan. 15, 2018, 3 pages.

Digital Trends, "The new Venture coolers from Otterbox . . . ", Posted May 9, 2017.(https://www.digitaltrends.com/outdoors/otterbox-venture-coolers/).

Duluth Trading Co, Folding Milk Crate, downloaded from https://www.duluthtrading.com/store/product/folding-milk-crate-78536.aspx on Jan. 15, 2018, 6 pages.

Fulton, Wil, All the Major Meal Delivery Services, Tested and Ranked, dated Oct. 7, 2016, downloaded from https://www.thrillist.com/eat/nation/best-meal-delivery-services-food-subscription-boxes-ranked on Jan. 15, 2018, 18 pages.

Ice Chest Guide, "Top 10 Best Soft Cooler Reviews and Buying Guide for 2018", downloaded from http://www.icechestguide.com/top-10-best-soft-cooler-reviews-and-buying-guide.html Jan. 25, 2018, 12 pages.

Igloo, Marine Ultra TM Collapse and Cool TM 50, downloaded from https://www.igloocoolers.com/products/61582-marine-ultra-collapse-and-cool-50-can-cooler-bag-white Jan. 15, 2018, 4 pages.

Kelty Folding Cooler, downloaded from https://www.kelty.com/folding-cooler/ Jan. 18, 2018, 6 pages.

Morris, David Z., This box opens up new possibilities for fresh food delivery, dated Aug. 3, 2015, downloaded from http://fortune.com/2015/08/03/freshrealm-cold-delivery/ Jan. 15, 2018, 4 pages.

(56) References Cited

OTHER PUBLICATIONS

OtterBox, "Rugged Venture Coolers", Accessed Jan. 16, 2018. (https://www.otterbox.com/en-us/venture-coolers.html).
Pelican Consumer, Coolers—Hunting, Fishing, Camping, downloaded from http://www.pelican.com/us/en/products/coolers May 8, 2017, 2 pages.
Pelican Products, "70QT Cooler", Accessed Jan. 16, 2018. (http://www.pelican.com/usien/product/outdoor-heavy-dutycoolers/elite-cooler/cooler/70QT/).
Picnic At Ascot, 396-RB 60 Can Collapsible Rolling Cooler, downloaded from http://www.picnicatascot.com/main/default/ProductsDetail.aspx?id=136 Jan. 15, 2018, 2 pages.
Polar Bear Coolers, "24 Pack Eclipse Cooler," downloaded from http://www.polarbearcoolers.com/product/PB327.html Jan. 30, 2018, 6 pages.
Polar Bear Coolers, "Eclipse Backpack Cooler," downloaded from http://www.polarbearcoolers.com/product/PB397.html Jan. 29, 2018, 4 pages.
Rei Co-Op, "Soft-sided Coolers", downloaded from https://www.rei.com/c/soft-sided-coolers?r-c&origin+web&ir=category%3Asoft-sided-coolers%page=1 Jan. 25, 2018, 6 pages.
RTIC, "RTIC Soft Pack Coolers," downloaded form https://www.rticcoolers.com/shop/coolers/softpak Jan. 25, 2018, 16 pages.
RTIC, Cooler Accessories, downloaded May 8, 2017 from http://www.rticcoolers.com/shop/coolers/accessories, 14 pages.
Stay Cool Hot Stuff, Flip-Box XL Collapsible Cooler and Insulation Box, downloaded from https://staycoolhotstuff.com/products/flip-box-xl-collapsible-cooler-and-insulation-box Jan. 18, 2018, 5 pages.
The Cooler Box, "Cordova Coolers vs Yeti—Is This New Cooler Better Than Yeti?", Published Oct. 24, 2016.(http://thecoolerbox.com/cordova-coolers-vs-yeti/).
The Good Housekeeping Institute, Thermos Cold N' Fold Cooler, dated Jul. 2007, downloaded from http://www.goodhousekeeping.com/travel-products/food-cooler-reviews/a28866/thermos-cold-n-fold-cooler-101/ Jan. 18, 2018, 5 pages.
Walmart, ECR4Kids Large Vented Collapsible Crate, 12pk, downloaded from https://www.walmart.com/ip/ECR4Kids-Large-Vented-Collapsible-Crate-12pk/34702630 on Jan. 15, 2018, 7 pages.
Yeti Coolers, "Hopper Soft Sided Portable Coolers," downloaded from https://www.yeti.com/soft-coolers Jan. 25, 2018, 6 pages.
Yeti Coolers, Tundra Cooler Divider, downloaded from www.yeti.com/tundra-dividers May 8, 2017, 4 pages.
Yeti Coolers, Tundra Ice Chests, downloaded from http://yeti.com/tundra May 8, 2017, 7 pages.
Yeti Coolers, Yeti Accessories & Parts, downloaded from http://yeti.com/accessories May 8, 2017, 5 pages.
Amazon.com, "Farberware 5190590 3-piece cutting board set," dated Jul. 23, 2011, downloaded from https ://www.amazon.com/Farberware-5190590-3-Piece-Plastic-Assorted/dp/80731KDNM P/ref=cm_cr_arp _d_product_top?ie=UTF8 Mar. 11, 2019, 8 pages.
Yeti Coolers, "Tundra Cooler Divider," dated Mar. 11, 2014, downloaded from https://www.yeti.com/en_US/accessories/tundra-dividers/DV.html?cg id =accessories# Mar. 11, 2019, 9 pages.

* cited by examiner

COLLAPSIBLE PORTABLE STORAGE CONTAINER

CROSS-REFERENCE TO RELATED APPLICATIONS

This disclosure claims priority to U.S. Provisional Application Nos. 62/515,004, filed Jun. 5, 2017 and 62/585,630, filed Nov. 14, 2017, the disclosures of each of which are hereby incorporated by reference in their entirety.

FIELD

This disclosure relates generally to a portable storage container for storing objects, such as food and/or beverages.

BACKGROUND

It is often desirable to bring along food or beverages when traveling or when participating in remote leisure activities. Often, the food may be perishable and the ambient temperature may be high (for instance, at a beach location), so it is desirable to keep the perishable food in a temperature controlled environment to avoid spoiling. Similarly, beverages, such as canned or bottled beverages, may also be consumed, and it is desired to keep such beverages cool until consumption. Meal delivery kits including perishable items are shipped to consumers in shipping containers. Portable storage containers, including insulated and non-insulated storage containers, coolers, and/or insulated shipping containers, may also be used for a variety of other purposes or activities including hunting, fishing, camping, medical purposes, general storage, grocery delivery, meal kit shipping, other food delivery, and/or other business or personal purposes. Exemplary portable storage containers are disclosed in U.S. application Ser. No. 15/398,468, filed Jan. 4, 2017, Ser. No. 15/494,020, filed Apr. 21, 2017, and 62/508,099, filed May 18, 2017, the disclosures of each of which are hereby incorporated by reference in their entirety.

Transporting or shipping the storage containers may be relatively difficult or expensive due to the relatively large volume of the container. In some situations, it may be desirable for the storage container to have an expanded configuration providing a larger interior space for storing food and/or beverages and a collapsed, smaller configuration for transporting an empty container.

SUMMARY

Portable storage containers are used for a variety of purposes and in conjunction with a variety of activities. In some exemplary embodiments, the storage container may be insulated to assist in keeping one or more items cool, cold, frozen, warm, or hot. The storage container may also be used to protect one or more items from damage, bumps, scratching, impact, water, rain, snow, mud, dust, dirt, light, visibility, theft, chemicals, and/or contaminants. The storage container may also be used to organize and/or transport items stored therein. While most of the examples discussed herein are illustrated with respect to a "cooler," it should be understood that the techniques and features disclosed herein are applicable to other types of storage containers or temperature control containers. Further, shipping containers of the type disclosed herein may be used for storage or transportation purposes and need not necessarily include insulating characteristics. The containers disclosed herein may be configured to be carried or transported in a plurality of ways or configurations.

In one exemplary embodiment a portable insulated storage container is provided. The storage container includes an insulated body having an internal cavity for storing one or more items, the insulated body having a base, first and second opposing end panels, and first and second opposing side panels. The first and second opposing end panels are each configured to move between a first vertical position and a second horizontal position. Each of the first and second opposing side panels includes an upper portion connected to a lower portion by a respective hinge. The first and second opposing side panels are each configured to rotate about their corresponding hinge between a first vertical storage position and a second stacked position. The container includes an insulated lid configured to engage the insulated body to close the internal cavity.

In a more particular embodiment, the storage container includes a flexible liner covering at least a portion of the internal cavity. In another more particular embodiment of any of the above or below embodiments, the hinge on each side panel is a living hinge. In another more particular embodiment of any of the above or below embodiments, the insulated body includes an upper perimeter portion. The first and second opposing end panels are configured to releasably attach direct to the perimeter portion in the second horizontal orientation. In another more particular embodiment of any of the above or below embodiments, the insulated body includes an upper perimeter portion and the first and second opposing end panels are positioned within a space defined by the upper perimeter portion in the second horizontal orientation. In another more particular embodiment of any of the above or below embodiments, the body is configured to releasably attach directly to the base when the first and second opposing side panels are in the stacked configuration. In another more particular embodiment of any of the above or below embodiments, the container has a first height when the first and second opposing end panels are in the first vertical position and the first and second opposing side panels are in the first vertical position and a second height when the first and second opposing end panels are in the second horizontal position and a second horizontal position and the first and second opposing side panels are in the second stacked position, the first height being greater than the second height.

In one exemplary embodiment a collapsible shipping container is provided. The container has a first configuration and a second configuration. The container includes an insulated base and an insulated upper perimeter portion. The container includes a plurality of insulated side panels extending between the upper perimeter portion and the base, each of the plurality of the insulated side panels being movable between a respective first position and a respective second position. The shipping container is in the first configuration when all of the insulated side panels are in the respective first positions. The shipping container collapses into the second configuration when all of the side panels are in the respective second positions. The collapsible shipping container has a height in the first configuration that is greater than a height of the shipping container in the second configuration. The container includes an insulated lid removably attachable to the upper perimeter portion for selectively closing and accessing an internal storage volume of the shipping container. The internal storage volume is defined by the insulated base, the plurality of insulated side panels, the insulated upper perimeter portion and the insulated lid. The container includes a latching mechanism for temporarily maintaining the shipping container in the first configuration. The latching mechanism latches at least two of the insulated side panels in the respective first positions to temporarily maintain the shipping container in the first configuration. The container includes a flexible liner attached to the upper perimeter portion and configured to line the internal storage volume. The flexible liner has a first surface facing the internal storage volume and a second surface facing at least one of the insulated base and the insulated side panels. The flexible liner has a handle attached to the first surface and accessible from inside the internal storage volume. The container includes a strap attached to the second surface of the flexible liner and attached to the latching mechanism. The strap disengages the latching mechanism when the handle of the flexible liner is pulled from the internal storage volume, the disengaging of the latching mechanism permitting the shipping container to transition from the first configuration to the second configuration.

In a more particular embodiment, the latching mechanism includes a first latching apparatus associated with a first panel of the plurality of insulated side panels and a second latching apparatus associated with a second panel of the plurality of side panels, the second panel being opposite the first panel. In another more particular embodiment of any of the above or below embodiments, the first and second panels pivot inward toward the internal storage volume enabling the shipping container to transition from the first configuration to the second configuration. In another more particular embodiment of any of the above or below embodiments, a third panel of the plurality of insulated side panels is opposite a fourth panel of the plurality of insulated side panels, each of the third and fourth panels having an upper portion connected to a lower portion by a hinging element. In another more particular embodiment of any of the above or below embodiments, each latching apparatus includes a movable biased tab attached to the respective side panel, the movable biased tab extending into a slot in the insulated base to temporarily retain the respective side panel in the respective first position. In another more particular embodiment of any of the above or below embodiments, a force applied to the strap retracts the biased tabs from the slots in the insulated base to unlatch the latching mechanism. In another more particular embodiment of any of the above or below embodiments, the strap is attached to the flexible liner without piercing the flexible liner. In another more particular embodiment of any of the above or below embodiments, the strap is detachable from the flexible liner and/or the latching mechanism. In another more particular embodiment of any of the above or below embodiments, the flexible liner is removable from the collapsible shipping container. In another more particular embodiment of any of the above or below embodiments, the flexible liner is liquid impermeable. In another more particular embodiment of any of the above or below embodiments, the flexible liner has insulating characteristics. In another more particular embodiment of any of the above or below embodiments, the insulated lid includes one or more receptacles for receiving a temperature control element and one or more shelves for retaining the temperature control element, each shelf including one or more convection apertures.

In one exemplary embodiment, a configurable shipping container has a first configuration and a second configuration. The shipping container includes a base and an upper portion. The shipping container includes a plurality of side panels extending between the upper portion and the base, each of the plurality of the side panels being movable between a first position and a second position. The shipping container is in the first configuration when all of the side panels are in the respective first positions. The shipping container is in the second configuration when all of the side panels are in the respective second positions. The first configuration of the shipping container has a height that is greater than a height of the second configuration. The shipping container includes a lid for selectively accessing and closing an internal storage volume of the shipping container, the internal storage volume defined by the base, the upper portion, the plurality of side panels, and the lid. The shipping container includes latching mechanisms for temporarily maintaining the shipping container in the first configuration. The latching mechanisms temporarily latch at least two of the side panels in the respective first positions to temporarily maintain the shipping container in the first configuration. The shipping container includes a flexible liner attached to the upper portion and configured to line at least a portion of the internal storage volume of the shipping container. The shipping container includes a strap attached to the flexible liner and the latching mechanisms. The strap disengages the latching mechanisms when the flexible liner is pulled away from the internal storage volume. The disengaging of the latching mechanisms releases the at least two of the side panels from the respective first positions thereby permitting the shipping container to transition from the first configuration to the second configuration.

In a more particular embodiment, the flexible liner includes a handle attached to an inner surface of the flexible liner, the handle being accessible from the internal storage volume. In another more particular embodiment of any of the above or below embodiments, the side panels, and the lid include vacuum insulated panels. In another more particular embodiment of any of the above or below embodiments, the container includes a securing mechanism for securing the configurable shipping container in the second configuration. In another more particular embodiment of any of the above or below embodiments, the at least two of the side panels are opposite each other and hinge inward toward the internal storage volume when in the respective second positions. In another more particular embodiment of any of the above or below embodiments, the flexible liner is replaceable.

In one exemplary embodiment, a portable insulated storage container has at least two configurations. The container includes an insulated body having an internal cavity for storing one or more items. The insulated body includes a base. The body includes first and second opposing end panels each configured to move between a first vertical orientation and a second horizontal orientation, each of the first and second opposing end panels including a respective latching mechanism for engaging the base for temporarily maintaining the first and second opposing end panels in the first vertical orientation. The body includes first and second opposing side panels each including an upper portion connected to a lower portion by a respective hinge. The first and second opposing side panels are each configured to rotate about their respective hinge between a first vertical configuration and a second stacked configuration. The portable insulated storage container is in a collapsed configuration when each of the opposing side panels are in the second stacked configuration and each of the opposing end panels are in the second horizontal orientation. The container includes an insulated lid configured to close an opening of the insulated body to close the internal cavity. The container includes a strap removably attached to the respective latching mechanisms of the first and second opposing end panels for releasing both the first and second opposing end panels from the first vertical orientation to the second horizontal orientation when the strap is pulled.

In a more particular embodiment, the container includes a liquid impermeable liner which lines the internal cavity of the insulated body, wherein the strap is removably adhered to a surface of the liquid impermeable liner that is opposite a surface of the liquid impermeable liner facing into the internal cavity. In another more particular embodiment of any of the above or below embodiments, the container includes a handle adhered to the surface of the liquid impermeable liner facing into the internal cavity of the insulated body, wherein the strap and the handle are adhered to the liquid impermeable liner without puncturing the liquid impermeable liner. In another more particular embodiment of any of the above or below embodiments, the liquid impermeable liner includes one or more of an antimicrobial coating and an insulating layer.

In one exemplary embodiment, a portable storage container has an expanded configuration and a collapsed configuration. The portable storage container includes a body having an internal cavity for storing one or more items. The body includes an upper perimeter portion, a base, and first and second opposing side panels each connecting the body to the base. The body includes first and second opposing end panels pivotably attached to the upper perimeter portion. The first end panel includes a movable locking member extending from a surface of the first end panel. The movable locking member is configured to be movable between a locked position. The movable locking member is received in a recess of the base and an unlocked position. The movable locking member prevents the first end panel from pivoting with respect to the upper perimeter member when the movable locking member is in the locked position. The movable locking member permits the first end panel to pivot with respect to the upper perimeter when the movable locking member is in the unlocked position. The container includes a liner at least partially positioned in the internal cavity, the liner having opposing inner and outer surfaces, the inner surface including a handle, the handle operably connected to the movable locking member. The handle is configured such that a first movement of the handle is configured to move the movable locking member from the locked to the unlocked position and the portable storage container from the expanded configuration to the collapsed configuration.

In a more particular embodiment, the first movement includes moving the handle in a direction away from the base. In another more particular embodiment of any of the above or below embodiments, the first and second opposing end panels each extend between the perimeter portion and the base in a vertical storage position when the portable storage container is in the expanded configuration. In another more particular embodiment of any of the above or below embodiments, the first and second opposing end panels each extend from the perimeter portion substantially parallel to the base in a horizontal shipping position when the portable storage container is in the collapsed configuration. In another more particular embodiment of any of the above or below embodiments, the handle is independently connected to the first and second opposing end panels such that the first movement of the handle results in the movement of the first and second opposing end panels from the vertical storage position to the horizontal shipping position.

In another more particular embodiment of any of the above or below embodiments, the movable locking member is positioned proximate a bottom surface of the first end panel. In another more particular embodiment of any of the above or below embodiments, the first end panel includes a biasing member attached to the movable locking member, the biasing member biasing the movable locking member in the locked position. In another more particular embodiment of any of the above or below embodiments, the handle is operably connected to a strap, the strap being connected to the biasing member, wherein the strap is configured such that a first movement of the handle transmits a force through the strap and the biasing member to move the movable locking member from the locked to the unlocked position. In another more particular embodiment of any of the above or below embodiments, the handle is attached to the inner surface of the liner and the strap is attached to the outer surface of the liner. In another more particular embodiment of any of the above or below embodiments, the handle and strap are independently attached to the liner with an adhesive and wherein the inner surface and the outer surface of the liner are each continuous proximate the handle and the strap.

In another more particular embodiment of any of the above or below embodiments, the second end panel includes a second movable locking member extending from a surface of the second end panel, the second movable locking member configured to be movable between a locked position wherein the second movable locking member is received in a second recess of the base and an unlocked position wherein the second movable locking member prevents the second end panel from pivoting with respect to the upper perimeter member when the second movable locking member is in the locked position and the second movable locking member permits the second end panel to pivot with respect to the upper perimeter when the second movable locking member is in the unlocked position. The second end panel includes a second biasing member attached to the second movable locking member, the second biasing member biasing the movable locking member in the locked position. In another more particular embodiment of any of the above or below embodiments, the handle is operably connected to a strap, the strap being connected to the first biasing member and the second biasing member, wherein the strap is configured such that a first movement of the handle transmits a first force through the strap and the biasing member to move the movable locking member from the locked to the unlocked position and a second force through the strap and the second biasing member to move the second movable locking member from the locked to the unlocked position.

In another more particular embodiment of any of the above or below embodiments, the container includes a lid configured to removably engage the body to removably seal the internal cavity. In another more particular embodiment of any of the above or below embodiments, the internal cavity is defined by the base, the first and second opposing end panels, the first and second opposing side panels, and the engaged lid. In another more particular embodiment of any of the above or below embodiments, the internal cavity defines an expanded volume when the portable storage container is in the expanded configuration and a collapsed volume when the portable storage container is in the collapsed configuration, the expanded volume being greater than the collapsed volume.

In another more particular embodiment of any of the above or below embodiments, the first and second opposing end panels are each pivotably attached to the perimeter portion. In another more particular embodiment of any of the above or below embodiments, the first and second opposing end panels each extend between the perimeter portion and the base in a vertical storage position when the portable storage container is in the expanded configuration. In another more particular embodiment of any of the above or below embodiments, the first and second opposing end panels each extend from the perimeter portion substantially parallel to the base in a horizontal shipping position when the portable storage container is in the collapsed configuration. In another more particular embodiment of any of the above or below embodiments, the first side panel is pivotably attached to at least one of the perimeter portion and the base. In another more particular embodiment of any of the above or below embodiments, the first side panel includes an upper portion pivotably attached to the perimeter portion and a lower portion pivotably attached to the base. In another more particular embodiment of any of the above or below embodiments, the upper portion is connected to the lower portion by a hinge. In another more particular embodiment of any of the above or below embodiments, the container includes a hoop configured to secure the liner to the upper perimeter portion.

In one exemplary embodiment, an insulated portable storage container movable between an expanded configuration and a collapsed configuration is provided. The container includes a body having an internal cavity for storing one or more items. The body includes an insulated upper perimeter portion, an insulated base, first and second opposing side panels each connecting the body to the base. The first side panel includes an insulated first upper portion pivotably attached to the perimeter portion and an insulated first lower portion pivotably attached to the base and the second side panel includes an insulated second upper portion pivotably attached to the perimeter portion and an insulated second lower portion pivotably attached to the base, and first and second opposing insulated end panels pivotably attached to the upper perimeter portion. The first and second opposing end panels each extend between the perimeter portion and the base in a vertical storage position when the portable storage container is in the expanded configuration. The first and second opposing end panels each extend from the perimeter portion substantially parallel to the base in a horizontal shipping position when the portable storage container is in the collapsed configuration. The container includes a liner at least partially positioned in the internal cavity, the liner including a handle operably connected to the first end panel. The handle is configured such that a first movement of the handle is configured to move the first end panel from the vertical storage position to the horizontal shipping position. The liner includes an insulated lid configured to engage the body to removably seal the internal cavity.

In a more particular embodiment, the first upper portion is connected to the first lower portion by a first hinge and wherein the second upper portion is connected to the second lower portion by a second hinge. In another more particular embodiment of any of the above or below embodiments, the first end panel includes a movable locking member extending from a surface of the first end panel, wherein the locking member is configured such that the first movement of the handle moves the locking member from a locked position in which the locking member resists the movement of the first end panel from the vertical storage position to the horizontal shipping position to an unlocked position in which the locking member permits the movement of the first end panel from the vertical storage position to the horizontal shipping position. In another more particular embodiment of any of the above or below embodiments, the first end panel includes a biasing member attached to the movable locking member, the biasing member biasing the movable locking member in the locked position.

In another more particular embodiment of any of the above or below embodiments, the handle is operably connected to a strap, the strap being connected to the biasing member, wherein the strap is configured such that a first movement of the handle transmits a force through the strap and the biasing member to move the movable locking member from the locked to the unlocked position. In another more particular embodiment of any of the above or below embodiments, the base includes a recess for receiving the movable locking member when the movable locking member is in the locked position.

In another more particular embodiment of any of the above or below embodiments, at least one of the upper perimeter portion, the base, the first side panel, the second side panel, the first end panel, the second panel, and the lid includes a vacuum insulated panel. In another more particular embodiment of any of the above or below embodiments, the upper perimeter portion, the base, the first side panel, the second side panel, the first end panel, the second panel, and the lid each includes one or more vacuum insulated panels. In another more particular embodiment of any of the above or below embodiments, the container includes an insulating gasket between the upper perimeter portion and at least one of the first side panel, the second side panel, the first end panel, the second panel, and the lid.

In one exemplary embodiment, a portable storage container has an expanded configuration and a collapsed configuration. The portable storage container includes a body having an internal cavity for storing one or more items, the body including an upper perimeter portion, a base, first and second opposing side panels each connecting the body to the base. The body includes first and second opposing end panels pivotably attached to the upper perimeter portion. The container includes an insulated lid configured to engage the body to removably seal the internal cavity and a liner at least partially positioned in the internal cavity and connected to the first and second opposing end panels, the liner including a handle connected to a movable locking mechanism of the first end, the movable locking mechanism including a projection configured to be moved between a locked position and an unlocked position upon a first movement of the handle, the projection engaging the base to resist movement of the first end relative to the base when the projection is in the locked position, and the projection permitting movement of the first end relative to the base when the projection is in the unlocked position.

In a more particular embodiment, the first and second opposing end panels each extend between the perimeter portion and the base in a vertical storage position when the portable storage container is in the expanded configuration and wherein the first and second opposing end panels each extend from the perimeter portion substantially parallel to the base in a horizontal shipping position when the portable storage container is in the collapsed configuration. In another more particular embodiment of any of the above or below embodiments, the first end is configured such that the first movement of the handle moves the first end panel from the vertical storage position to the horizontal shipping position. In another more particular embodiment of any of the above or below embodiments, the first movement includes moving the handle in a direction away from the base.

In another more particular embodiment of any of the above or below embodiments, the first side panel includes an insulated first upper portion pivotably attached to the perimeter portion and an insulated first lower portion pivotably attached to the base and the second side panel includes an insulated second upper portion pivotably attached to the perimeter portion and an insulated second lower portion pivotably attached to the base. In another more particular embodiment of any of the above or below embodiments, the first upper portion is connected to the first lower portion by a first hinge and wherein the second upper portion is connected to the second lower portion by a second hinge. In another more particular embodiment of any of the above or below embodiments, the first upper portion includes a first outer surface and an opposing first inner surface and the first lower portion includes a second outer surface and a second inner surface, wherein the first outer surface and the second outer surface form an outer side surface of the portable storage container when the portable storage container is in the expanded configuration. In another more particular embodiment of any of the above or below embodiments, the first outer surface is adjacent the second outer surface when the portable storage container is in the collapsed configuration.

In another more particular embodiment of any of the above or below embodiments, the internal cavity defines an extended volume when the portable storage container is in the expanded configuration and a collapsed volume when the portable storage container is in the collapsed configuration, the expanded volume being greater than the collapsed volume. In another more particular embodiment of any of the above or below embodiments, the container has an expanded volume when the container is in the expanded configuration and a collapsed height when the container is in the collapsed configuration, the expanded height being greater than the collapsed height.

In one exemplary embodiment, a portable storage container is provided. The container includes a body having an internal cavity for storing one or more items, the body including a base, a perimeter portion, first and second opposing end panels extending from the perimeter portion, and first and second opposing side panels extending from the perimeter portion, and a lid configured to engage the body to close the internal cavity. The perimeter portion includes a securing mechanism including a locking lip, the portable storage container having an expanded configuration in which the locking lip is configured to releasably engage a side panel locking portion of the first side panel to prevent movement of the first side panel relative to the upper perimeter portion when the portable storage container is in the expanded configuration, and the portable storage container having a collapsed configuration in which the locking lip is configured to releasably engage a base locking portion of the base to prevent movement of the base relative to the upper perimeter portion when the portable storage container is in the collapsed configuration.

In a more particular embodiment, the side panel locking portion includes a groove, the locking lip being received within the groove to prevent movement of the first side panel relative to the perimeter portion when the portable storage container is in the expanded configuration. In another more particular embodiment of any of the above or below embodiments, the base panel locking portion includes a groove, the locking lip being received within the groove to prevent movement of the base relative to the perimeter portion when the portable storage container is in the collapsed configuration.

In another more particular embodiment of any of the above or below embodiments, the upper perimeter portion includes a rotatable portion movable between a locked position and an unlocked position, the rotatable portion including the locking lip. In another more particular embodiment of any of the above or below embodiments, the locking lip is configured to engage the side panel locking portion when the rotatable portion is in the locked position and the portable storage container is in the expanded configuration, the locking lip is configured to engage the base locking portion when the rotatable portion is in the locked position and the portable storage container is in the collapsed configuration, and the locking lip is configured to not engage either the side panel locking portion or the base locking portion when the rotatable portion is in the unlocked position. In another more particular embodiment of any of the above or below embodiments, the container includes a button movable between an expanded configuration and a depressed configuration, wherein the button is configured to maintain the rotatable portion in the locked position when the button is in the expanded configuration and the button is configured to allow the rotatable portion to move between the locked position and the unlocked position when the button is in the depressed configuration. In another more particular embodiment of any of the above or below embodiments, the container includes a biasing element configured to bias the button in the expanded configuration.

In another more particular embodiment of any of the above or below embodiments, the securing mechanism includes a second locking lip, the second locking lip configured to releasably engage a lid locking portion of the lid. In another more particular embodiment of any of the above or below embodiments, the lid locking portion includes a groove, the second locking lip being received within the groove to prevent movement of the engaged lid relative to the body. In another more particular embodiment of any of the above or below embodiments, the perimeter portion includes a rotatable portion movable between a locked position and an unlocked position, the rotatable portion including the locking lip and the second locking lip. In another more particular embodiment of any of the above or below embodiments, the internal cavity is defined by the base, the first and second opposing end panels, the first and second opposing side panels, and the engaged lid.

In another more particular embodiment of any of the above or below embodiments, the internal cavity defines an extended volume when the portable storage container is in the expanded configuration and a collapsed volume when the portable storage container is in the collapsed configuration, the expanded volume being greater than the collapsed volume.

In another more particular embodiment of any of the above or below embodiments, the first and second opposing end panels are each pivotably attached to the perimeter portion. In another more particular embodiment of any of the above or below embodiments, the first and second opposing end panels each extend between the perimeter portion and the base in a vertical storage position when the portable storage container is in the expanded configuration. In another more particular embodiment of any of the above or below embodiments, the first and second opposing end panels each extend from the perimeter portion substantially parallel to the base in a horizontal shipping position when the portable storage container is in the collapsed configuration. In another more particular embodiment of any of the above or below embodiments, the first side panel is pivotably attached to at least one of the perimeter portion and the base. In another more particular embodiment of any of the above or below embodiments, the first side panel includes an upper portion pivotably attached to the perimeter portion and a lower portion pivotably attached to the base. In another more particular embodiment of any of the above or below embodiments, the upper portion is connected to the lower portion by a hinge.

In one exemplary embodiment, a portable storage container having an expanded configuration and a collapsed configuration is provided. The portable storage container includes a body having an internal cavity for storing one or more items. The body includes an upper perimeter portion including a rotatable portion having a locking lip movable between a locked position and an unlocked position, a base including a groove configured to receive the locking lip when the portable storage container is in the collapsed configuration, first and second opposing end panels, the first end panel including a groove configured to receive the locking lip when the portable storage container is in the expanded configuration, and first and second opposing side panels each extending between the upper perimeter portion and the base.

In a more particular embodiment, the locking lip is configured to prevent movement of the first side panel relative to the upper perimeter portion when the portable storage container is in the expanded configuration, and locking lip is configured to prevent movement of the base relative to the upper perimeter portion when the portable storage container is in the collapsed configuration. In another more particular embodiment of any of the above or below embodiments, the locking lip is configured to be received within the groove of the first end panel when the rotatable portion is in the locked position and the portable storage container is in the expanded configuration, the locking lip is configured to be received within the groove of the base when the rotatable portion is in the locked position and the portable storage container is in the collapsed configuration, and the locking lip is configured to not be received within either the groove of the first end panel or the groove of the base when the rotatable portion is in the unlocked position.

In another more particular embodiment of any of the above or below embodiments, the upper perimeter portion includes a second rotatable portion having a second locking lip movable between a locked position and an unlocked position, the base includes a second groove configured to receive the second locking lip when the portable storage container is in the collapsed configuration, and the second end panel includes a second groove configured to receive the locking lip when the portable storage container is in the expanded configuration.

In another more particular embodiment of any of the above or below embodiments, the container includes a button movable between an expanded configuration and a depressed configuration, wherein the button is configured to maintain the rotatable portion in the locked position when the button is in the expanded configuration and the button is configured to allow the rotatable portion to move between the locked position and the unlocked position when the button is in the depressed configuration. In another more particular embodiment of any of the above or below embodiments, the container includes a biasing element configured to bias the button in the expanded configuration.

In another more particular embodiment of any of the above or below embodiments, the container includes a lid configured to removably engage the body to close the internal cavity. In another more particular embodiment of any of the above or below embodiments, the securing mechanism includes a second locking lip, the second locking lip configured to releasably engage a groove of the lid, the second locking lip configured to be received within the groove of the lid to prevent movement of the engaged lid relative to the body. In another more particular embodiment of any of the above or below embodiments, the locking lip is configured to be received within the groove of the first end panel and the second locking lip is configured to be received with in the groove of the engaged lid when the rotatable portion is in the locked position and the portable storage container is in the expanded configuration, the locking lip is configured to be received within the groove of the base and the second locking lip is configured to be received with in the groove of the engaged lid when the rotatable portion is in the locked position and the portable storage container is in the collapsed configuration, and the locking lip is configured to not to be received within either the groove of the first end panel or the groove of the base and the second locking lip is configured to not be received within the groove of the engaged lid when the rotatable portion is in the unlocked position.

In another more particular embodiment of any of the above or below embodiments, the upper portion includes a post about which the rotatable portion rotates to move the locking lip between the locked position and the unlocked position. In another more particular embodiment of any of the above or below embodiments, the locking lip, the post, and the second locking lip are positioned in a substantially straight line.

In one exemplary embodiment, a portable storage container has an expanded configuration and a collapsed configuration. The portable storage container includes a body having an internal cavity for storing one or more items. The body includes an upper perimeter portion, a base, first and second opposing end panels, and first and second opposing side panels. The upper perimeter portion includes means for selectively engaging the first side panel when the portable storage container is in the expanded configuration and the base when the portable storage container is in the collapsed configuration.

In a more particular embodiment, the container includes a lid configured to engage the body to removably seal the internal cavity and wherein the upper perimeter portion includes means for selectively engaging the lid.

In one exemplary embodiment, a configurable shipping container has an expanded configuration and a collapsed configuration is provided. The shipping container includes an insulated base and an insulated upper portion. The container includes a plurality of insulated side panels extending between the upper portion and the base, the side panels movable to transition the shipping container between the expanded configuration and the collapsed configuration. The shipping container has a height in the expanded configuration that is greater than a height of the shipping container in the collapsed configuration. The container includes an insulated lid configured to close an internal storage volume of the shipping container when the lid is in a closed position and provide access to the internal storage volume when the lid is in an opened position. The lid includes a first receptacle and a second receptacle that face the internal storage volume when the lid is in the closed position, each of the first and second receptacles configured to receive one or more temperature control elements. The lid includes a first shelf and a second shelf, each shelf configured to cover at least a portion of a respective one of the first and second receptacles to hold the one or more ice packs in the respective one of the receptacles; and a slot between the first and second receptacles. The container includes a removable divider for dividing the internal storage volume into a first storage compartment and a second storage compartment when the shipping container is in the expanded configuration. A slot proximate the base and the slot in the lid receive respective edges of the divider for holding the divider in place. The first receptacle is associated with the first storage compartment and the second receptacle is associated with the second storage compartment.

In a more particular embodiment the container includes a removable flexible liner configured to line at least a portion of the internal storage volume. In another more particular embodiment of any of the above or below embodiments, the flexible liner is liquid impermeable and/or has anti-microbial characteristics. In another more particular embodiment, the slot proximate the base is formed in the base, in the liner, or in a handle coupled to the liner.

In another more particular embodiment of any of the above or below embodiments, one or more of the plurality of side panels includes a slot for receiving an edge of the removable divider. In another more particular embodiment of any of the above or below embodiments, the base includes a second slot and the lid includes a corresponding second slot for receiving the respective edges of the divider for holding the divider in place in a second position. In another more particular embodiment of any of the above or below embodiments, at least one of the shelves includes one or more apertures for allowing convective air movement between the associated storage compartment and the associated receptacle. In another more particular embodiment of any of the above or below embodiments, the base includes a second slot for receiving a second divider for defining a third storage compartment in the internal storage volume, and the lid includes a third receptacle, a third shelf, and a second slot for receiving the second divider. In another more particular embodiment of any of the above or below embodiments, the container includes a securing mechanism configured to secure the lid in the closed position when the shipping container is in the expanded configuration, and secure the lid in the closed position and secure the shipping container in the collapsed configuration when the shipping container is in the collapsed configuration. In another more particular embodiment of any of the above or below embodiments, the divider is insulated.

In one exemplary embodiment, a configurable shipping container system is provided. The system includes a configurable shipping container having an expanded configuration and a collapsed configuration. The shipping container includes an insulated base, an insulated upper portion, a plurality of insulated side panels extending between the upper portion and the base, the side panels movable to transition the shipping container between the expanded configuration and the collapsed configuration. The shipping container has a height in the expanded configuration that is greater than a height of the shipping container in the collapsed configuration, and an insulated lid configured to close an internal storage volume of the shipping container when the lid is in a closed position and provide access to the internal storage volume when the lid is in an opened position, the lid including a first receptacle and a second receptacle each facing the internal storage volume when the lid is in the closed position, each of the first and second receptacles configured to receive one or more temperature control elements, the lid including a slot positioned between the first and second receptacles. The system includes a first shelf and a second shelf, each shelf configured to cover at least a portion of a respective one of the first and second receptacles to hold the one or more ice packs in the respective one of the receptacles, each of the first and second shelves including one or more convection apertures, and a removable divider for dividing the internal storage volume into a first storage compartment and a second storage compartment when the shipping container is in the expanded configuration. A slot proximate the base and the slot in the lid receive respective edges of the divider for holding the divider in place. The first receptacle is associated with the first storage compartment and the second receptacle is associated with the second storage compartment.

In a more particular embodiment, the system includes a removable flexible liner configured to line at least a portion of the internal storage volume. In another more particular embodiment, the slot proximate the base is formed in the base, in the liner, or in a handle coupled to the liner. In another more particular embodiment of any of the above or below embodiments, the system includes a strap for releasing the configurable shipping container from the expanded configuration to the collapsed configuration, the strap attached to two or more of the insulated side panels. In another more particular embodiment of any of the above or below embodiments, the strap is attached to the flexible liner. In another more particular embodiment of any of the above or below embodiments, the flexible liner is liquid impermeable and has anti-microbial characteristics. In another more particular embodiment of any of the above or below embodiments, the system includes a securing mechanism configured to: secure the lid in the closed position when the shipping container is in the expanded configuration, and secure the lid in the closed position and secure the shipping container in the collapsed configuration when the configurable shipping container is in the collapsed configuration. In another more particular embodiment of any of the above or below embodiments, the shipping container is configurable to maintain the first storage compartment in a first temperature range that is different than a second temperature range of the second storage compartment. In another more particular embodiment of any of the above or below embodiments, the system includes a second divider. In another more particular embodiment of any of the above or below embodiments, the system includes a tamper resistant closure or tamper evident closure for the insulated lid. In another more particular embodiment of any of the above or below embodiments, the system includes a lock for the insulated lid.

In one exemplary embodiment, a portable storage container is provided. The container includes a body having an internal cavity for storing one or more items, the body including a base and a plurality sides, each of the plurality of sides having an internal surface and an opposing external surface, the body having an upper perimeter including an internal lip extending around the internal cavity. The container includes a liner at least partially positioned in the internal cavity and covering an interior surface of the base and the internal surface of each of the plurality of sides, the liner including an edge region around a perimeter of the liner, and a hoop coupling the upper perimeter of the body to the edge region of the liner. The hoop includes an upper perimeter portion, a connecting portion extending downward from the upper perimeter portion, and a securing portion extending upward from the connecting portion, the securing portion exerting a force through the liner against the plurality of sides to secure the liner in the internal cavity.

In one more particular embodiment, the securing portion exerts a force through the liner against the internal lip of the body to resist the hoop from being removed from the body. In another more particular embodiment of any of the above or below embodiments, the securing portion includes an outer surface and a distal end, the outer surface exerting the force through the liner against the plurality of sides to secure the liner in the internal cavity, and the distal end exerting the force through the line against the internal lip of the body to resist the hoop from being removed from the body. In another more particular embodiment of any of the above or below embodiments, the connecting portion has a thickness substantially similar to a thickness of the securing portion, and wherein an intermediate portion connecting the connecting portion and the securing portion has a thickness less than the thickness of the connecting portion. In another more particular embodiment of any of the above or below embodiments, the upper perimeter includes a recess extending around the internal cavity, the hoop being received within the recess. In another more particular embodiment of any of the above or below embodiments, the container includes a lid configured to be removably attached to the body. In another more particular embodiment of any of the above or below embodiments, the container includes a gasket positioned in a recess formed in one of the hoop and the lid, the gasket contacting the other of the hoop and the lid when the lid is attached to the body to thermally seal the internal cavity of the body. In another more particular embodiment of any of the above or below embodiments, the recess extends around an upper surface of the hoop. In another more particular embodiment of any of the above or below embodiments, the plurality of sides includes one or more vacuum insulated panels. In another more particular embodiment of any of the above or below embodiments, the hoop includes a plurality of sides, the upper perimeter portion and the connecting portion forming a continuous perimeter around the plurality of sides of the hoop.

In one exemplary embodiment, a portable storage container is provided. The container includes a body having an internal cavity for storing one or more items, the body including a base and a plurality sides, each of the plurality of sides having an upper surface, an internal surface and an opposing external surface, a liner at least partially positioned in the internal cavity and covering an interior surface of the base, the internal surface of each of the plurality of sides, and at least a portion of the upper surface of each of the plurality of sides, and a hoop coupled to the upper surface of each of the plurality of sides, the hoop having a plurality of outwardly engaging projections applying a force through the liner to the body, the hoop securing the liner in the body.

In one more particular embodiment, the body includes a recess positioned in the upper surface of each of the plurality of sides, the recess forming a perimeter extending around the internal cavity, the hoop being positioned in the recess. In another more particular embodiment of any of the above or below embodiments, the body includes an internal lip extending outward from the internal surface of one of the plurality of sides, the outwardly engaging projections engaging the internal lip through the liner to maintain the hoop in the internal cavity. In another more particular embodiment of any of the above or below embodiments, the outwardly engaging projections have a bias in a direction towards the body.

In one exemplary embodiment, a method of assembly a storage container is provided. The method includes providing a body having an internal cavity for storing one or more items, the body including a base and a plurality sides each having a top surface, an internal surface and an opposing external surface, the body having an upper perimeter including an internal lip extending around the internal cavity, each of the plurality of sides having an internal side and an opposing external side, the body having an upper perimeter including an internal lip extending around the internal cavity. The method also includes inserting a liner having a perimeter region into the internal cavity, the liner fully covering the internal lip and internal surface of each of the plurality of sides. The method also includes attaching a hoop to the body, the hoop including an upper perimeter portion, a connecting portion extending downward from the upper perimeter portion, and a securing portion extending upward from the connecting portion, whereby attaching the hoop compresses the securing portion against the connecting portion causing the securing portion to exert a force through the liner to the internal surface of each of the plurality of sides, the force securing the liner between the body and the hoop.

Other variations and embodiments are possible, including variations and embodiments which do not necessarily include all of the elements described above or below and/or variations and embodiments which may include additional elements.

DETAILED DESCRIPTION

Figure 1:
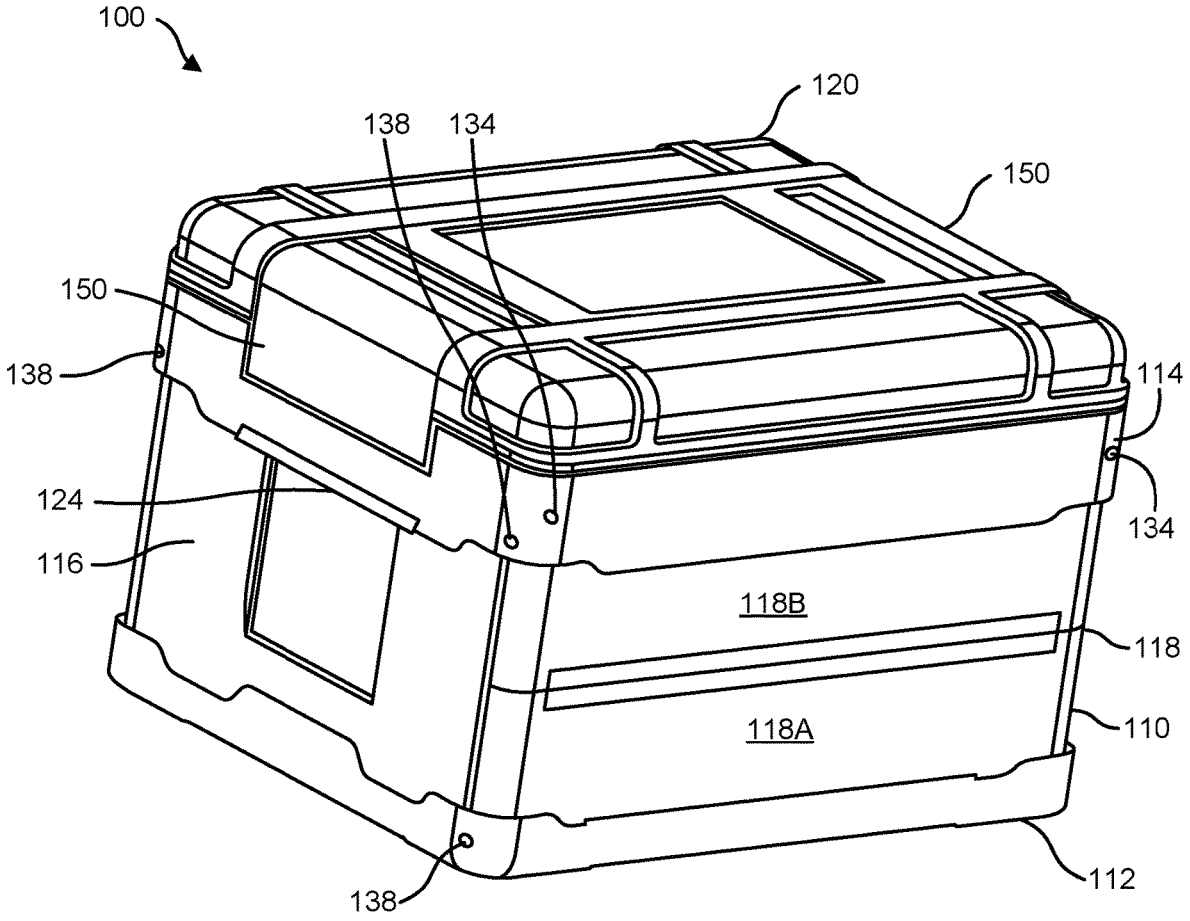
FIG. 1 illustrates an elevated perspective view of an exemplary portable storage container in a first expanded configuration in accordance with the techniques and improvements disclosed herein.

FIG. 1 illustrates a portable storage container 100, illustratively a cooler, in accordance with the techniques and improvements disclosed herein. Although illustrated as a cooler, in other embodiments, the portable storage container 100 may be an insulated or non-insulated portable shipping or storage container.

Container 100 includes a body 110 and a lid 120. Body 110 provides an internal cavity, storage compartment, or storage area 102 (FIG. 4) which is accessible by removing lid 120 from body 110. Body 110 and/or lid 120 may be made from one or more plastics, metals, and/or natural materials. Body 110 and/or lid 120 may be molded, injection molded, roto-molded, pressure-formed, 3-D printed, machined, and/or stamped. Each of body 110 and lid 120 may comprise a single component or may be made of multiple components. Each of body 110 and lid 120 may also include insulation or one or more insulating elements, such as foam, expanding foam, closed cell foam, structural foam, spray foam, blanket materials, one more evacuated cavities, one more vacuum panels, or combinations thereof. In other embodiments, body 110 and/or lid 120 may not include any insulation or insulating elements.

Body 110 and/or lid 120 may be rigid or may contain portions that are flexible, bendable, soft, compliant, stretchable, and/or compressible. In some cases, one or more portions of container 100 may be partially or fully collapsible when not in use as described herein. Various portions of container 100 may be attached using one or more methods including sewing, gluing, adhesive, electro-welding, thermoplastic welding, co-molding, melting, and/or fasteners. One or more parts of container 100 may be waterproof, water-resistant, abrasion resistant, tear resistant, and/or puncture resistant.

Figure 3:
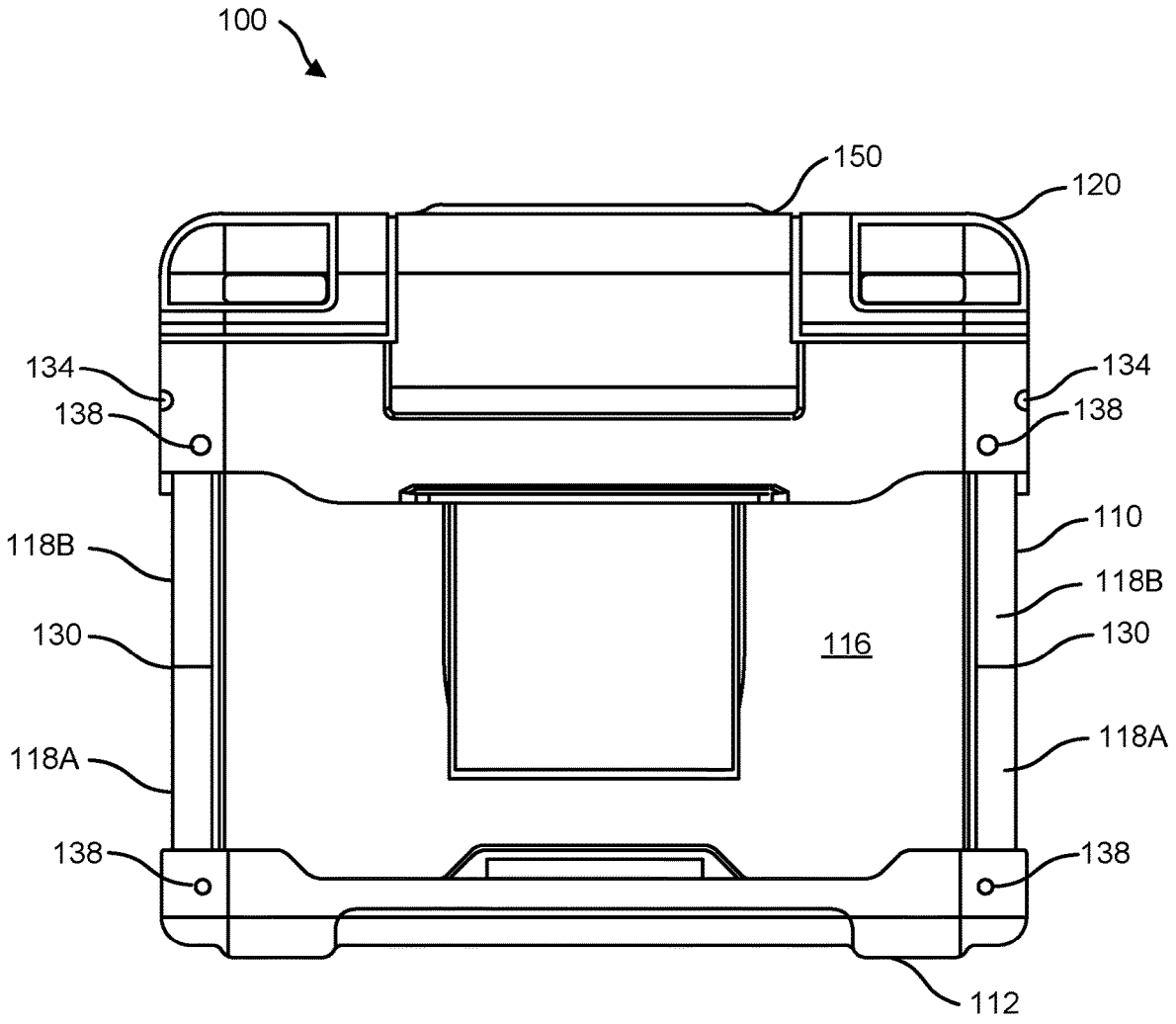
FIG. 3 illustrates an end view of the container of FIG. 1.
Figure 4:
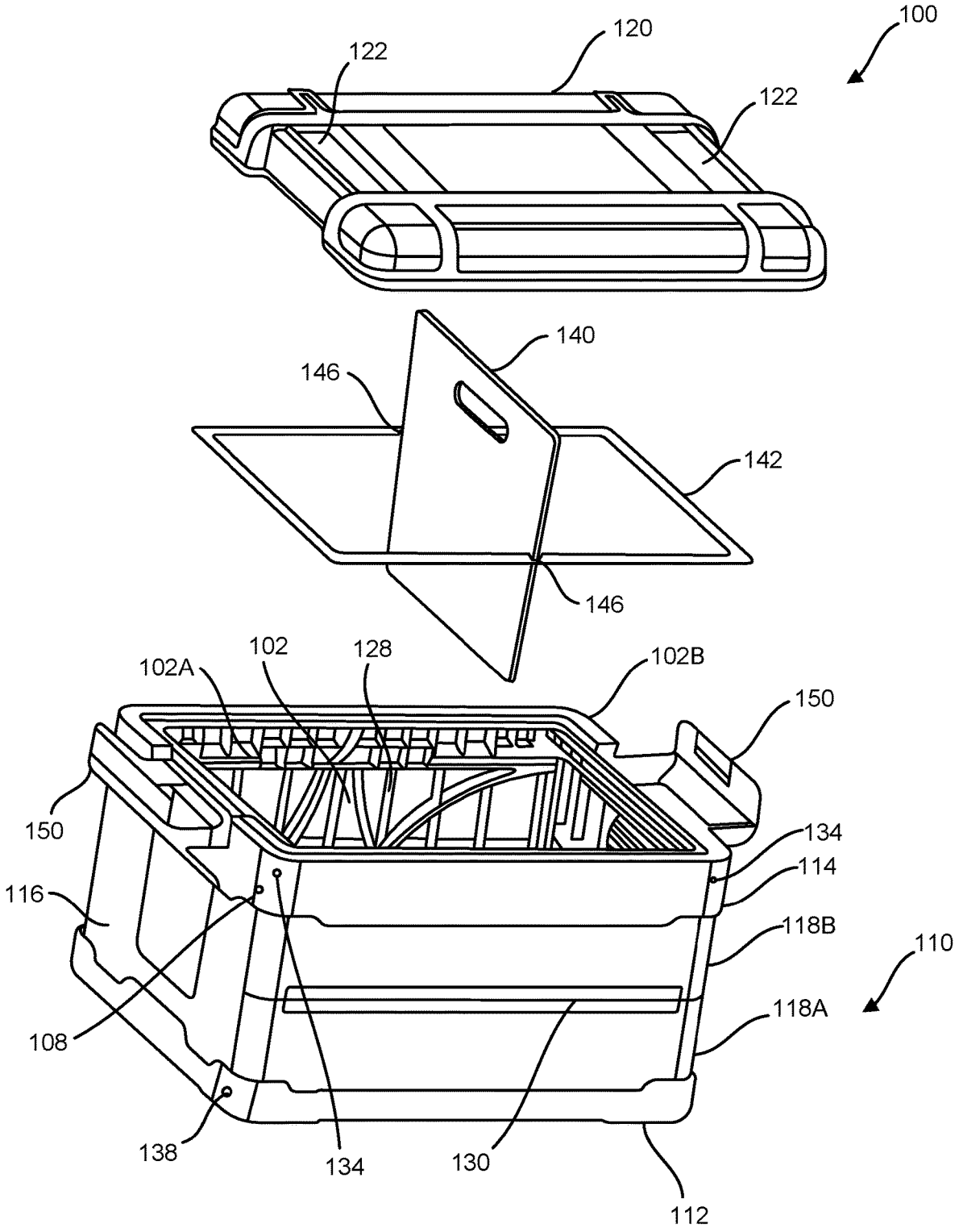
FIG. 4 illustrates an exploded view of an exemplary container including a divider.
Figure 5:
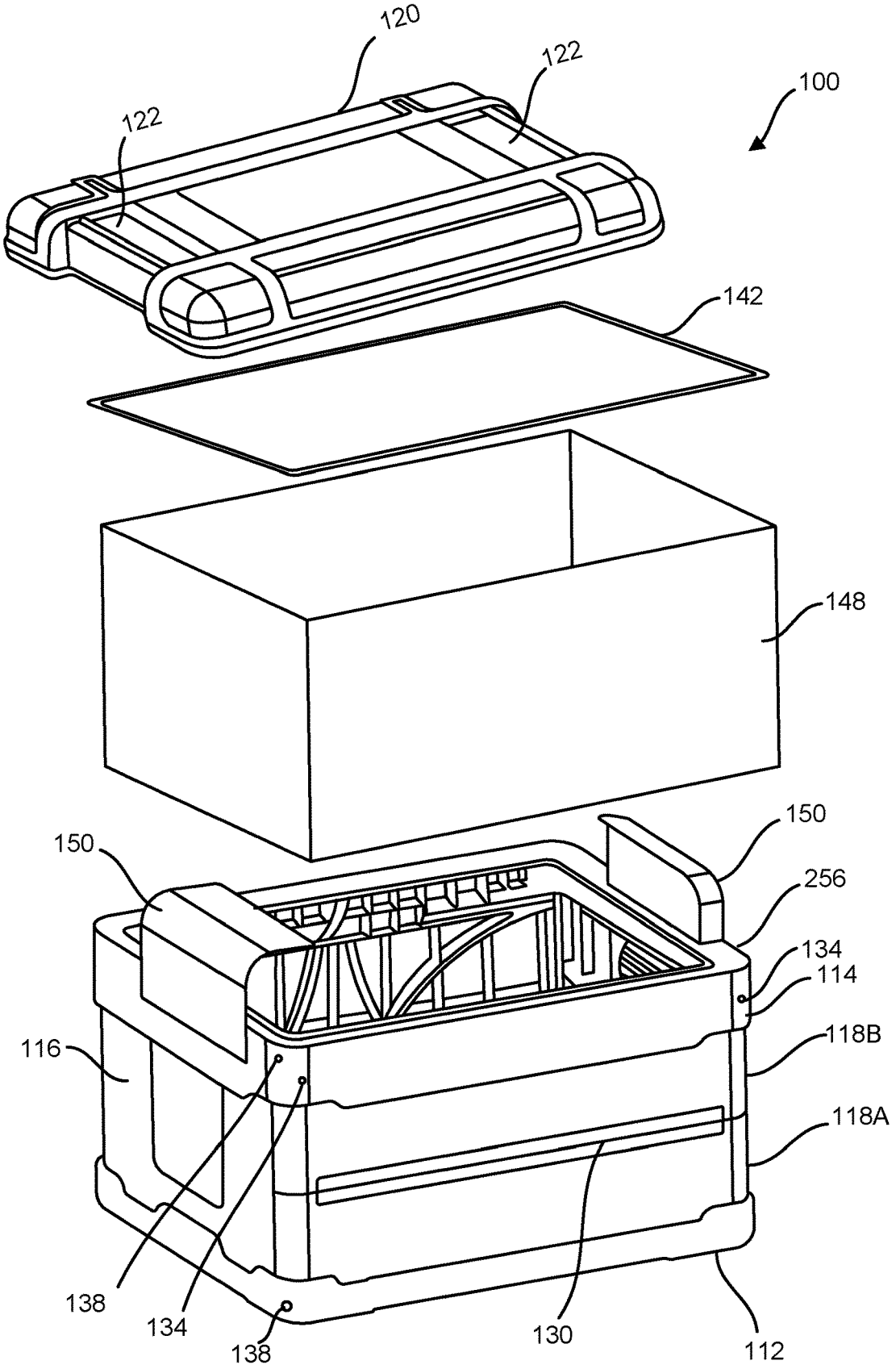
FIG. 5 illustrates an exploded view of an exemplary container including a liner.

Lid 120 may be fully removable from body 110 (as illustrated in FIGS. 4 and 5) or may be attached to body 110. Lid 120 is removably held in a closed position against body 110 using one or more latches, clasps, fasteners, clips, and/or levers, such as latches 150 (see FIGS. 1-3) or securing mechanism 180 (see FIG. 11A). Latches 150 and/or securing mechanism 180 illustratively secure lid 120 by attaching to a corresponding groove 122 on lid 120. Container 100 may also include one or more carrying handles 124 which may be integrated with or separate from latches 150 and/or securing mechanism 180. Latches 150 and/or securing mechanism 180 may provide a closure that is waterproof, water-resistant, childproof, child resistant, animal proof, and/or animal resistant. Latches 150 and/or securing mechanism 180 may include one or more components made of plastic, metal, wood, ceramic, rubber, and/or silicone. Further, latches 150 and/or securing mechanism 180 may include a locking mechanism or may include an interface for use with one or more locks or access control devices, such as an electronic lock or a seal which indicates tampering. One or more gaskets or seals may be used between lid 120 and body 110.

Figure 2:
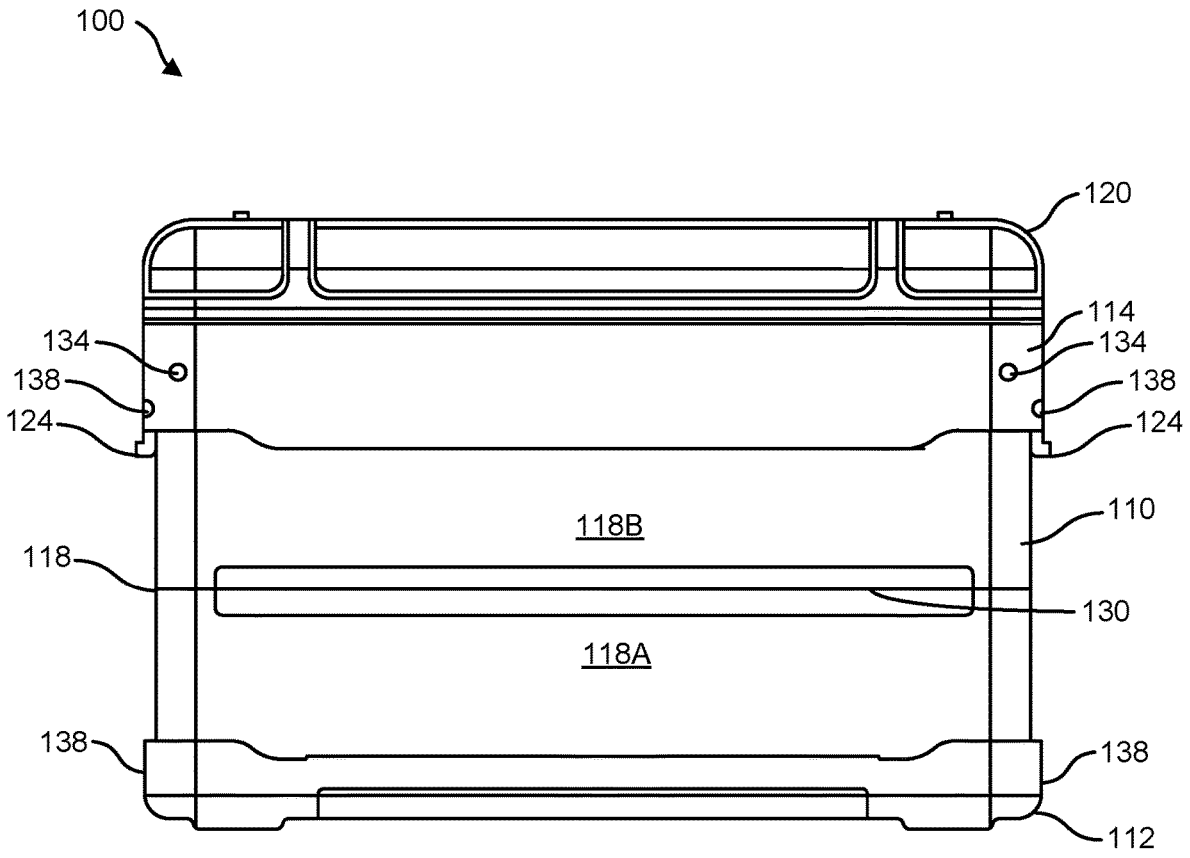
FIG. 2 illustrates a side view of the container of FIG. 1.

Referring to FIGS. 1-4, body 110 illustratively includes base 112 and an upper perimeter portion 114. Base 112 forms at least a portion of the bottom surface of container 100. Upper perimeter portion 114 illustratively extends around at least a portion of an upper perimeter of body 110. Upper perimeter portion 114 is separated from base 112 with one or more end panels 116 and one or more side panels 118. As shown in FIGS. 1-3, body 110 includes first and second end panels 116 at opposite ends of body 110 and first and second side panels 118 extending between the first and second end panels 116 along opposite sides of body 110. Although end panels 116 are illustrated as having a shorter length than side panels 118 in FIGS. 1-3, in other embodiments end panels 116 and side panels 118 may have the same length, or end panels 116 may have a longer length than side panels 118.

Figure 8:
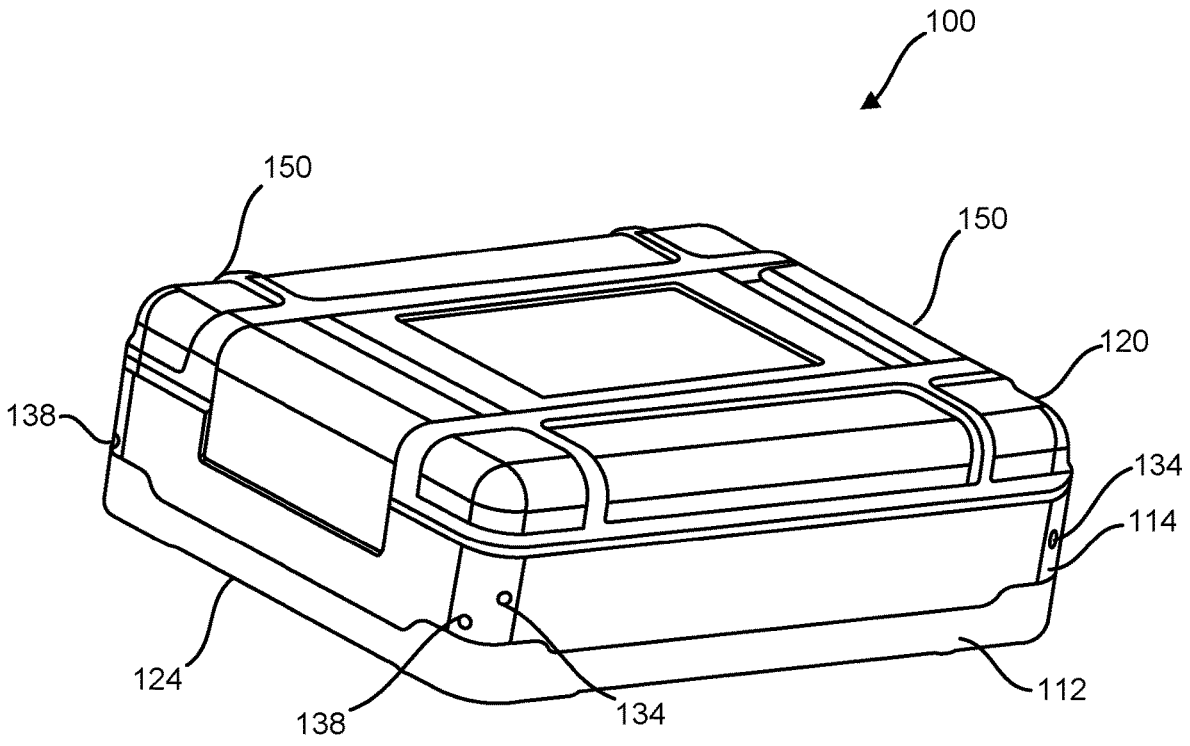
FIG. 8 illustrates an elevated perspective view of the container of FIG. 1 in a second collapsed configuration.
Figure 9:
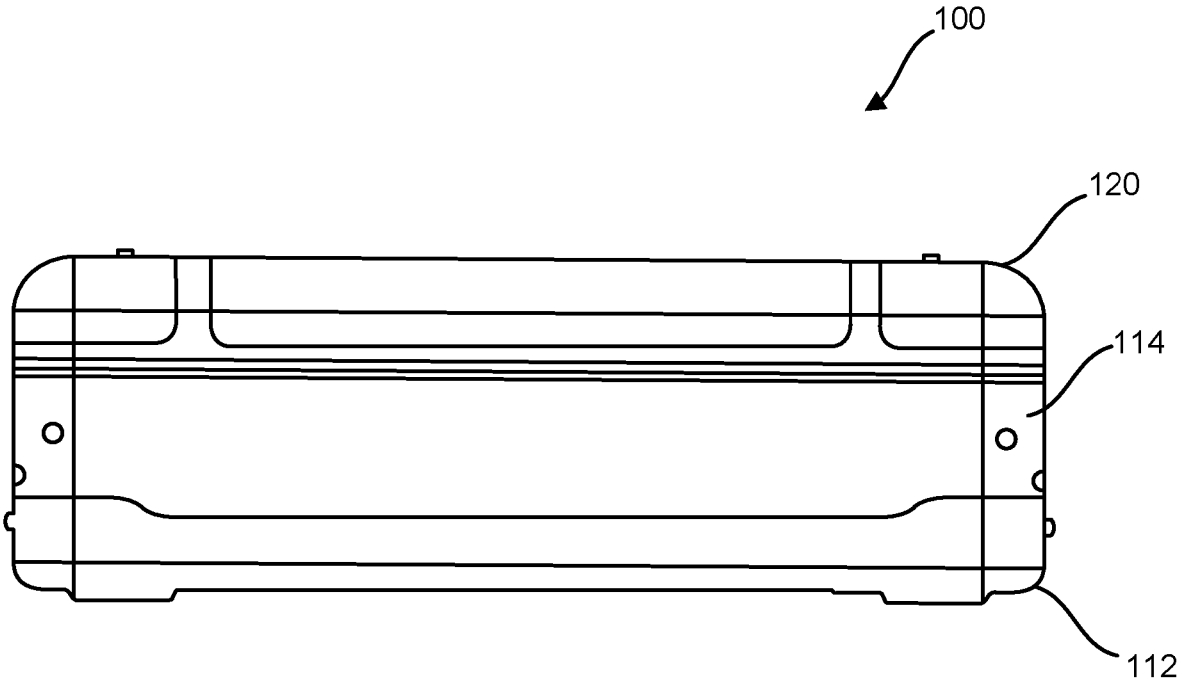
FIG. 9 illustrates a side view of the container of FIG. 8.
Figure 10:
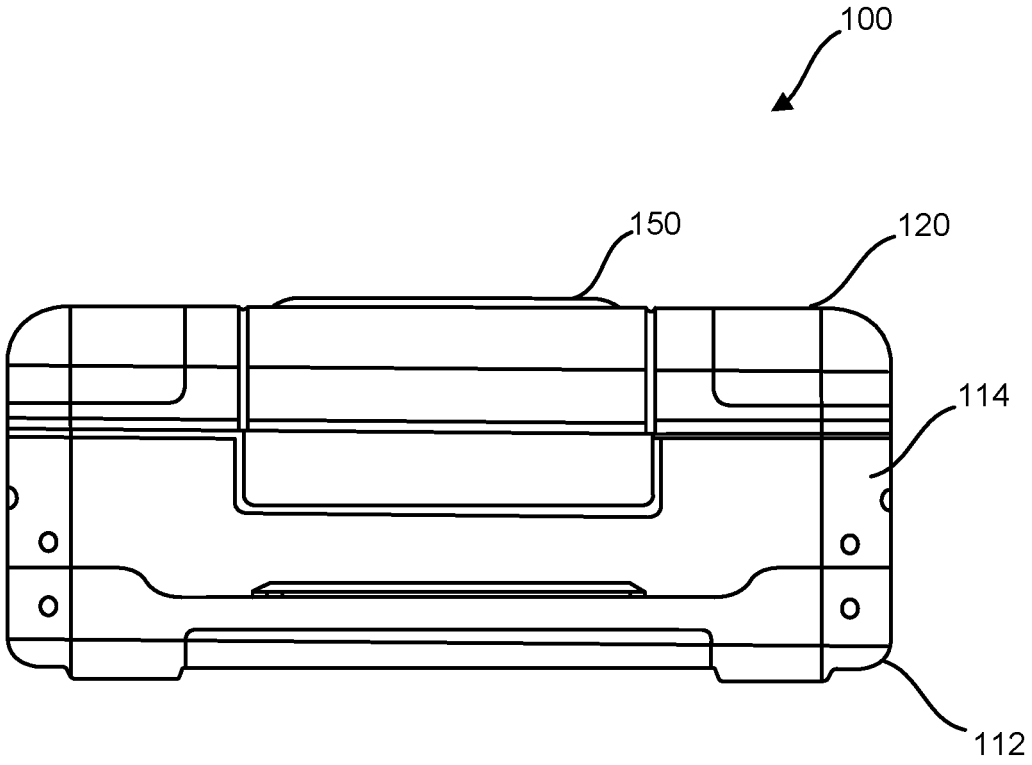
FIG. 10 illustrates an end view of the container of FIG. 8.

In some exemplary embodiments, container 100 has a first expanded configuration as illustrated in FIGS. 1-3 and a second collapsed configuration as illustrated in FIGS. 8-10. The height of the container 100 in the expanded configuration is greater than the height of the container 100 in the collapsed configuration. The interior volume of the container 100 in the expanded configuration is greater than the interior volume of the cooler in the collapsed configuration.

An upper portion of each end panel 116 is pivotably connected to upper perimeter portion 114 of body 110. A lower portion of each end panel is releasably coupled to base 112 by an attachment mechanism 132, such as by a snap or détente or other suitable mechanism (see FIG. 6). As described below with respect to FIGS. 6 and 7, this allows the lower portion of end panel 116 to be disconnected from the base 112 and the end panel 116 to rotate about upper perimeter portion 114 from the vertical storage position of end panels 116 illustrated in FIGS. 1-3 to a horizontal shipping position illustrated in FIGS. 8-10. As shown in FIGS. 8-10, in the shipping position, the end panels 116 are at least partially housed within a space defined by upper perimeter portion 114 of body 110. Although the exemplary end panels 116 as illustrated in FIGS. 1-3 are pivotably connected the upper perimeter portion 114, in other embodiments, one or more of the end panels 116 may instead pivotably connected to the base 112, allowing end panel 116 to rotate to a horizontal shipping position in which the end panel 116 is positioned adjacent a portion of base 112.

Each side panel 118 is illustratively formed from a lower side panel 118A and an upper side panel 118B. Each lower side panel 118A is pivotably connected to the base 112 with one or more pins 138. Each upper side panel 118B is pivotably connected to the upper perimeter portion 114 with one or more pins 138. Lower side panel 118A and upper side panel 118B are illustratively connected by a hinge 130, such as a living hinge. As described below with respect to FIGS. 6 and 7, hinge 130 allows lower side panel 118A to pivot with respect to upper side panel 118B, bringing a portion of base 112 in closer proximity to a portion of upper perimeter portion 114.

Referring to FIG. 4, in some embodiments, an internal wall or divider 140 may divide storage area 102 into two or more separate storage areas 102A and 102B. The storage area 102 may be bounded by one or more liners 148 (FIG. 5). Divider 140 may be insulated in addition to the outer walls and/or bottom of body 110 being insulated. Divider 140 is illustratively removably and slidably received by a pair of guides or slots 128 positioned in an interior of storage area 102. It should be understood that although FIG. 4 illustrates a container 100 having two storage areas 102 separated by divider 140, in other embodiments, container 100 has only a single storage area 102, or has three or more storage areas 102. Beneficially, different types of items with different requirements can be stored in each of the different storage areas. The requirements of the items may vary based on temperature requirements. In one example, one storage area may be used for frozen items, while the second is used for cold beverages. A grocery delivery company or meal kit company may place different products or ingredients and different compartments that best suit them for shipping. In other examples, one or more of the storage areas 102 may be used for items that preferably remain at room/neutral/outside temperature. In other examples, one or more of the storage areas 102 may be used for items that must be kept warm or hot relative to other items. In yet other examples, various storage areas 102 may be used for pharmaceuticals or other medical items that have different temperature requirements. The different storage areas 102 may also be used for items or groups of items that have varying level of sensitivity to humidity or water exposure.

Referring to FIG. 5, container 100 may include a liner 148 and a liner securing component or hoop 142 attaching the liner 148 to the body 110 of container 100. Hoop 142 surrounds an upper perimeter of one or more interior storage areas 102. Hoop 142 may include one or more grooves 146 for receiving divider 140. Hoop 142 illustratively is removably secured to body 110 by snapping hoop 142 into a channel or recess 256 formed in an upper perimeter portion 114 of body 110 (see FIG. 33). Other suitable methods of securing hoop 142 to body 110 may also be used.

Liner 148 is illustratively formed from a bendable, and/or flexible material, such as a polymer or fabric. Beneficially, the bendable and/or flexible nature of liner 148 allows the liner to conform to the size of the storage area 102 when the container 100 is configured as illustrated in FIG. 1, and then be crushed, folded, squashed, or removed to allow the cooler to be configured as illustrated in FIG. 8. In some embodiments, liner 148 is water proof or water resistant, restricting the movement of fluid out of storage areas 102 and allowing for easier cleaning of container 100. In some embodiments, liner 148 is removed and replaced in container 100 by removing hoop 142, removing and discarding a first liner 148, placing a second liner 148 into the interior of body 110, and re-attaching hoop 142. In other embodiments, liner 148 and hoop 142 are provided as a single unit that can be removed from body 110 and replaced with a corresponding new unit.

Figure 6:
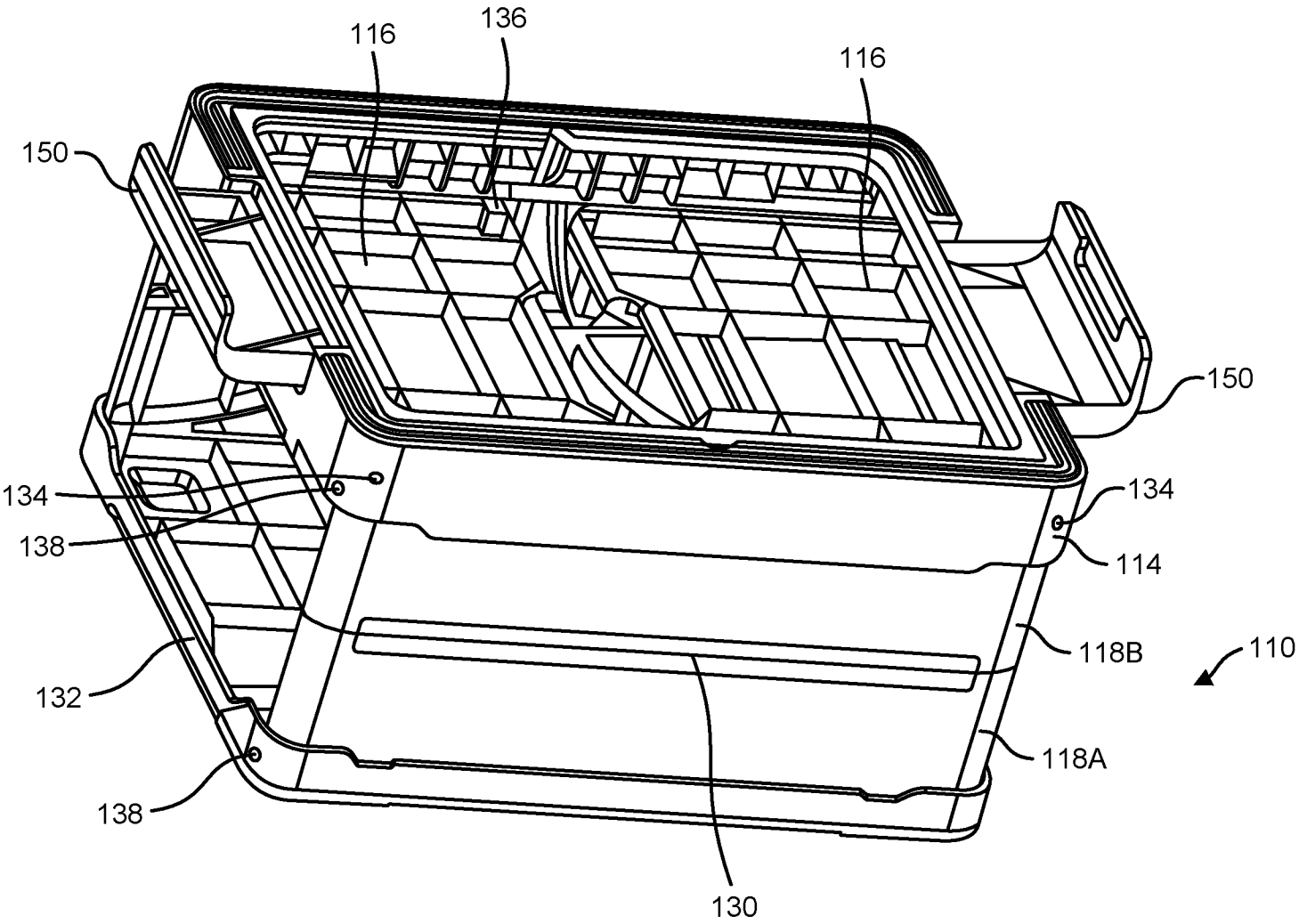
FIG. 6 illustrates the container of FIG. 1 with the lid removed and end panels raised in the horizontal shipping position.
Figure 7:
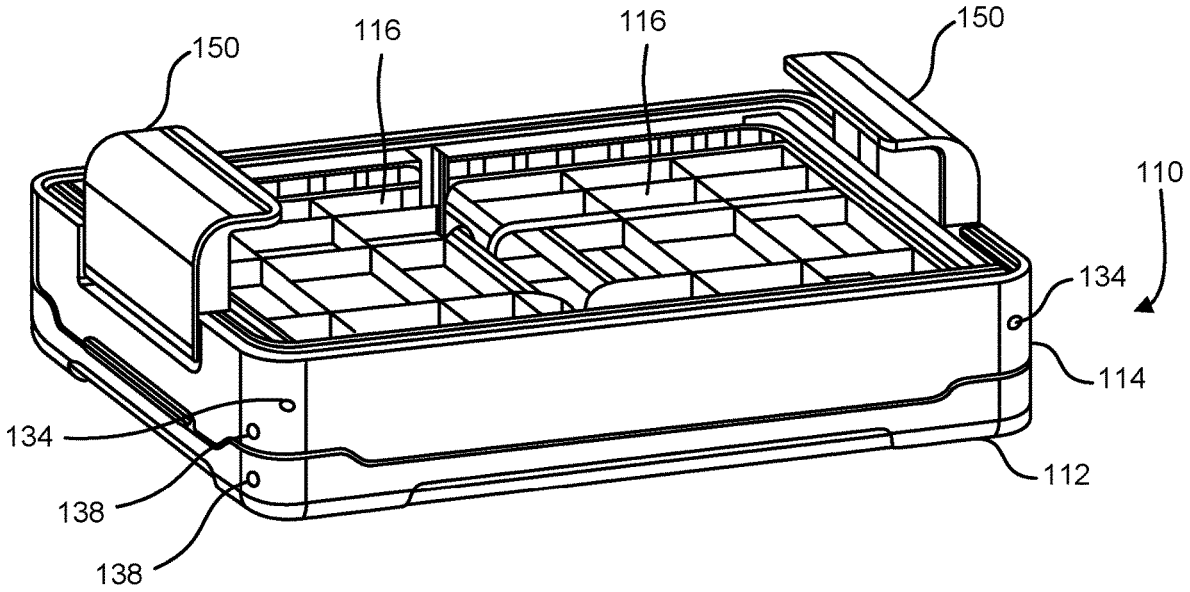
FIG. 7 illustrates the container of FIG. 1 with the lid removed, end panels raised, and side panels collapsed in the collapsed position.

Referring next to FIGS. 6 and 7, the lid 120, divider 140, and liner 148 have been removed from the drawings to show details of the end panels 116 and side panels 118.

In FIG. 6, the lower portion of end panels 116 have been released from the attachment mechanism 132 of base 112. The end panels 116 are then rotated about pins 134 in upper perimeter portion 114 until the end panels 116 are completely within a space defined by upper portion 114. As illustrated in FIG. 6, the end panels 116 may be locked in the upper position with a suitable snap or détente mechanism 136 between upper perimeter portion 114 and each end panel 116.

In FIG. 7, the hinge 130 is collapsed inward, causing each lower side panel 118A and upper side panel 118B to rotate about pins 138 and the outer surface of each lower side panel 118A to be moved adjacent to the outer surface of the corresponding upper side panel 118B. As illustrated in FIG. 7, the effect of this movement is to move the base 112 closer to the upper perimeter portion 114 of body 110, thereby decreasing the overall height of body 110. In the exemplary embodiment illustrated in FIG. 7, the lower edge of upper portion 114 is brought into contact with an upper edge of base 112, and the lower side panel 118A and upper side panel 118B are positioned completely within a space defined by upper perimeter portion 114 and/or base 112. In some embodiments, upper perimeter portion 114 is releasably secured or attached to base 112 with a suitable snap or détente mechanism.

Although not illustrated in FIGS. 6 and 7, divider 140 and liner 148 may be raised above the level of end panels 116 prior to rotating the end panels 116 into the upper position illustrated in FIG. 6. In some embodiments, at least a portion of divider 140 and liner 148 may be positioned in a space defined by lid 120.

Referring next to FIGS. 8-10, the container 100 is illustrated in a shorter, collapsed shipping position. Beneficially, the collapsed configuration illustrated in FIGS. 8-10 has a shorter height dimension than the taller, storage position illustrated in FIGS. 1-3. In some embodiments, the shorter height allows for more containers 100 to be stacked in a given space and/or to require less space for shipping. In some exemplary embodiments, divider 140 and/or liner 148 may be positioned within interior storage area 102 when the container 100 is in the collapsed configuration.

Referring next to FIGS. 11A-21, another exemplary storage container 100 is illustrated. The container 100 shown in FIGS. 11A-21 is similar to the container illustrated in FIGS. 1-10, and similar part numbers are used to indicate similar features. Those of ordinary skill in the art will recognize that any of the particular features described and/or illustrated may be implemented in combination with any other features described and/or illustrated herein.

As illustrated in FIGS. 11A-13, container 100 includes a body 110 and a lid 120. Lid 120 is removably attached to an upper perimeter portion 114 of body 120 through securing mechanism 180. Securing mechanism 180 is configured to secure the lid 120 in the closed position and maintain the container 100 in the expanded configuration when the container 100 is in the expanded configuration and secure the lid in the closed position and secure the container 100 in the collapsed configuration when the container 100 is in the collapsed configuration. The lid 120 is configured to selective close or permit access to the internal storage area 102 defined by the base 112, end panels 116, side panels 118, upper perimeter portion 114, and lid 120. In some exemplary embodiments, lid 120 includes insulation or one or more insulating elements.

Figure 14:
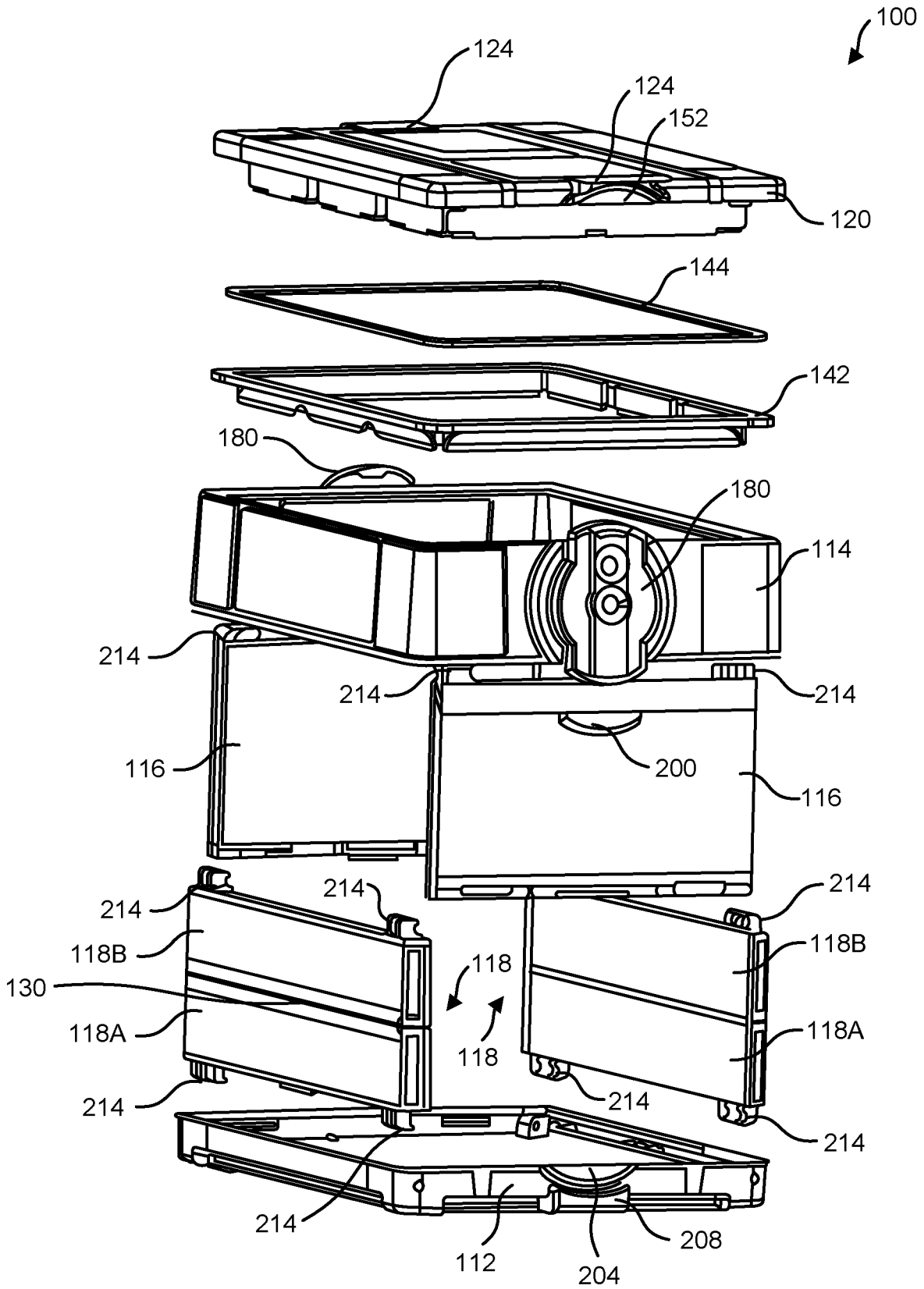
FIG. 14 illustrates still another exploded view of the container of FIG. 11A with the liner removed.

As illustrated in FIG. 14, body 110 illustratively includes a base 112 and an upper perimeter portion 114 including a securing mechanism 180 for securing the body 110 to the lid 120. As described in more detail below, securing mechanism 180 may also serve to alternately secure the upper perimeter portion 114 to either the end panel 116 or base 112 to secure the container 100 in either the expanded or collapsed configuration.

Body 110 further includes first and second opposing end panels 116 extending downwardly from upper perimeter portion 114. Each end panel 116 includes a pivoting connector 214, such as a circular or semi-circular end, to rotatably attach the end panel 116 to the upper perimeter portion 114 with one or more pins 134.

Body 110 further includes first and second opposing side panels 118, each including a lower portion 118A extending upwardly from the base 112 and an upper portion 118B extending downwardly from upper perimeter portion 114. Each lower portion 118A is rotatably attached to a corresponding upper portion 118B with a hinge 130, such as a living hinge. Each panel portion 118A, 118B includes a pivoting connector 214, such as a circular or semi-circular end, to rotatably attach the panel portion 118A, 118B to either the base or the upper perimeter portion 114 with one or more pins 138.

Figure 12:
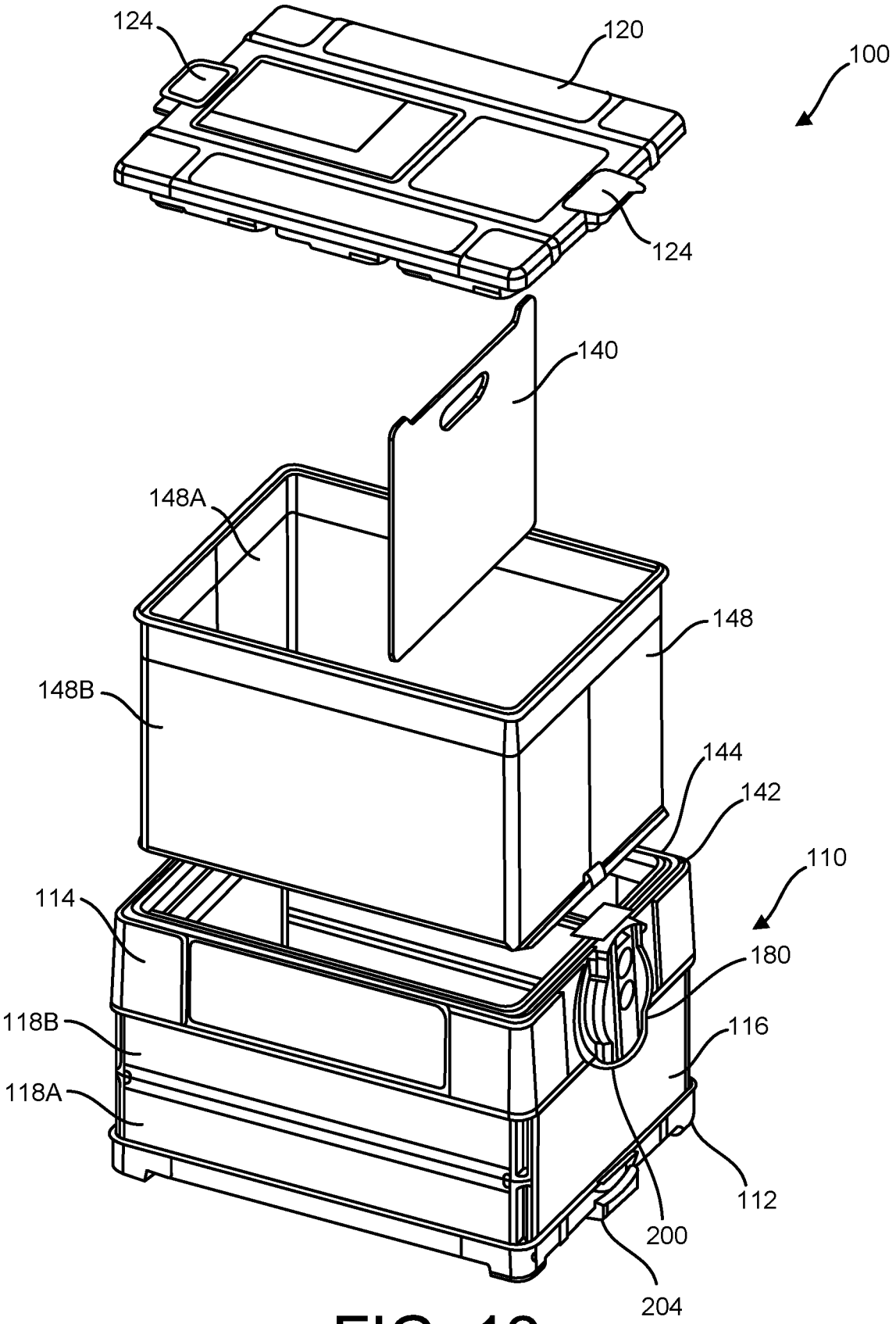
FIG. 12 illustrates an exploded view of the container of FIG. 11A showing the liner and divider.
Figure 13:
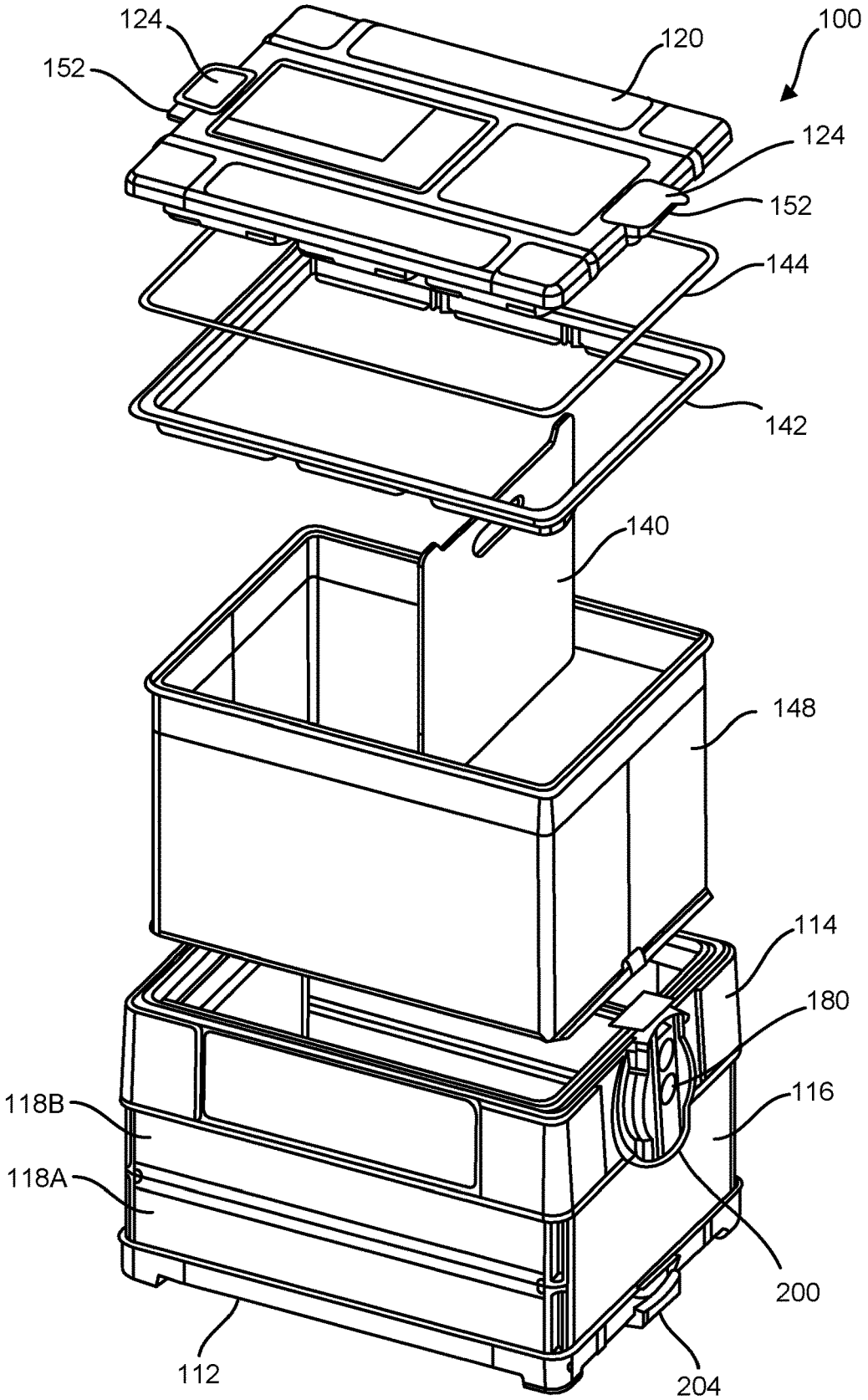
FIG. 13 illustrates another exploded view of the container of FIG. 11A further showing the hoop and gasket.
Figure 27:
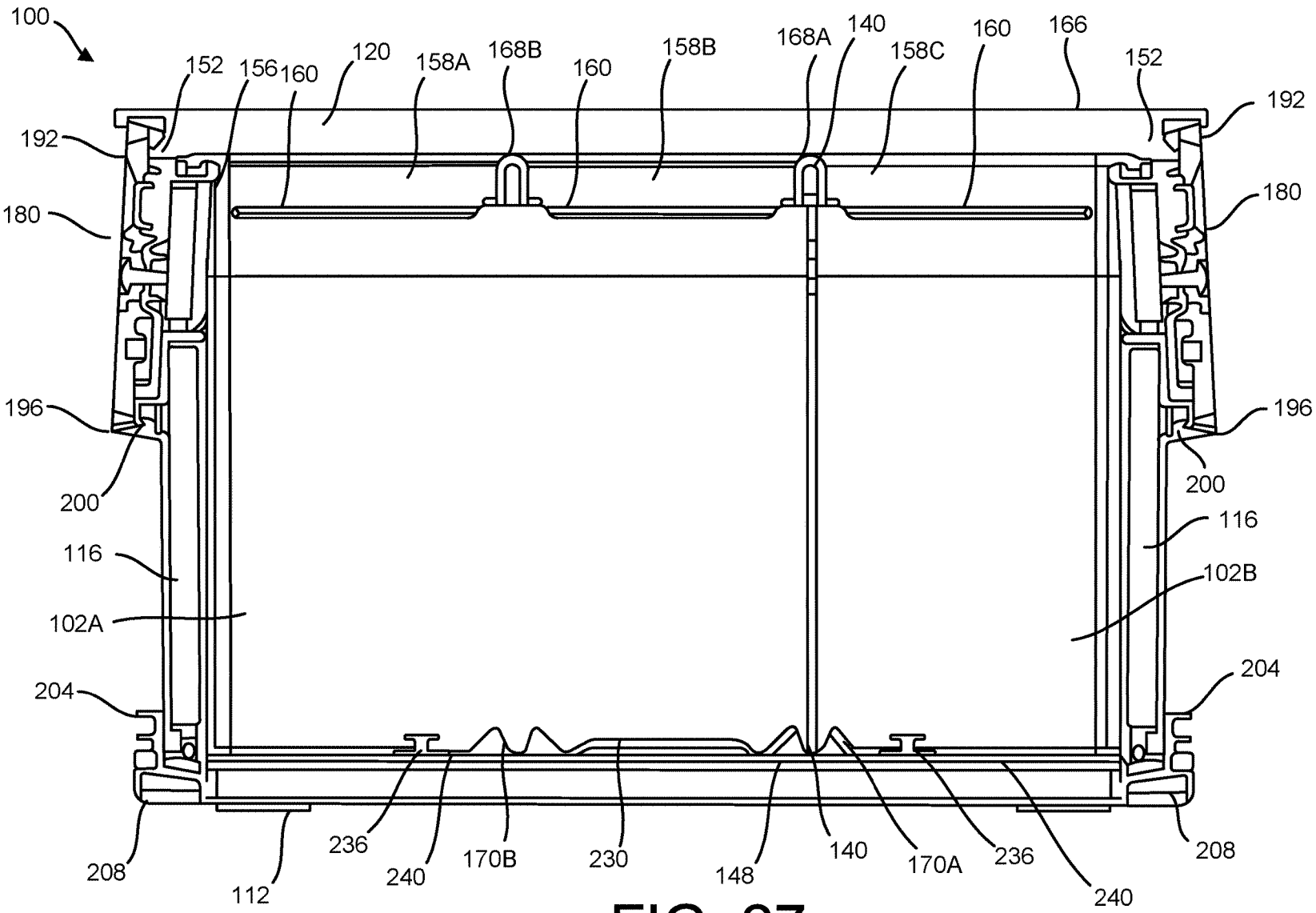
FIG. 27 illustrates a sectional view of the portable storage container of FIG. 11B in the expanded configuration.

In the illustrative embodiments shown in FIGS. 12 and 13, container 100 further includes a removable divider 140 for dividing the interior storage area 102 of container into a first storage compartment 102A and a second storage compartment 102B when the container 100 is in the expanded configuration (see FIG. 27). In some exemplary embodiments, divider 140 is insulated. In some exemplary embodiments, the divider 140 may be positioned within one or more slots 168, 170 in a vertical dividing position when the container 100 is in the expanded configuration. In some exemplary embodiments, the divider 140 and/or liner 148 may be placed in a horizontal storage position within the interior storage area 102 when the container 100 is in the collapsed configuration.

In some exemplary embodiments, container 100 further includes a flexible liner 148 separating the interior storage area 102 from the body 110 of container 100. Liner 148 is attached to upper perimeter portion with hoop 142. Liner 148 includes a first surface 148A facing the internal storage area 102 of container 100 and a second opposing surface 148B facing at least one of the base 112, end panels 116, and side panels 118 (see FIG. 12). In some exemplary embodiments, the liner is liquid impermeable. In some exemplary embodiments, the liner has insulating characteristics. In some exemplary embodiments, the liner has anti-microbial properties.

In some embodiments, liner 148 is removably and/or replaceably attached to upper perimeter portion 114 with hoop 142. In other embodiments, liner 148 may be permanently attached to upper perimeter portion 114. Upper perimeter portion 114 and/or hoop 142 may include one or more gaskets 144 for sealing with lid 120 when lid is attached to body 110.

In some exemplary embodiments, one or more of base 112, upper perimeter portion 114, end panels 116, side panels 118, and lid 120 include insulation or one or more insulating elements, such as foam, expanding foam, closed cell foam, structural foam, spray foam, blanket materials, one more evacuated cavities, one more vacuum panels 108 (see FIG. 33), or combinations thereof. In some embodiments, each of base 112, upper perimeter portion 114, end panels 116, side panels 118, and lid 120 include insulation or one or more insulating elements. In other embodiments, body 110 and/or lid 120 may not include any insulation or insulating elements.

Figure 11A:
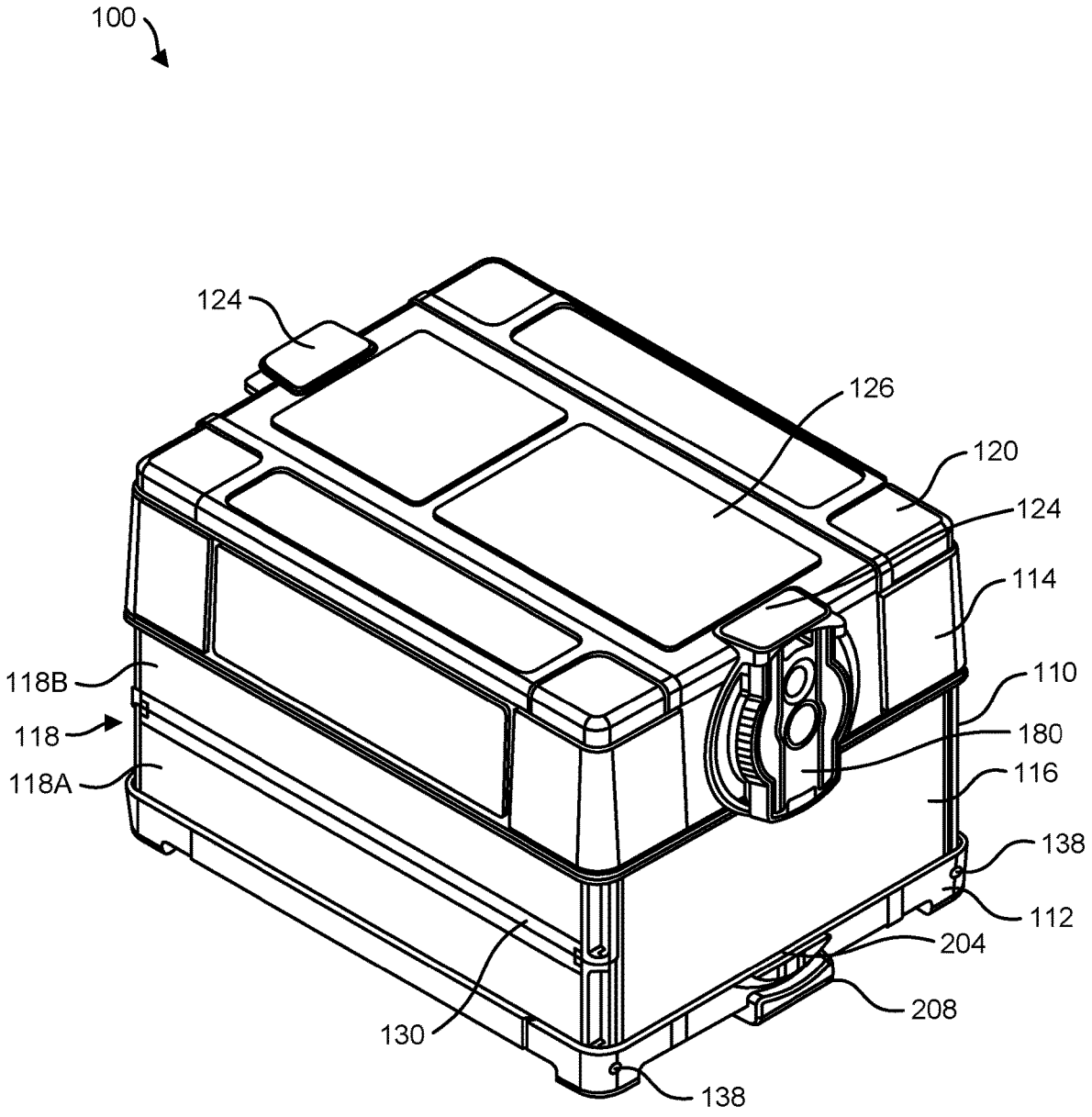
FIG. 11A illustrates another exemplary portable storage container in an expanded configuration.
Figure 11B:
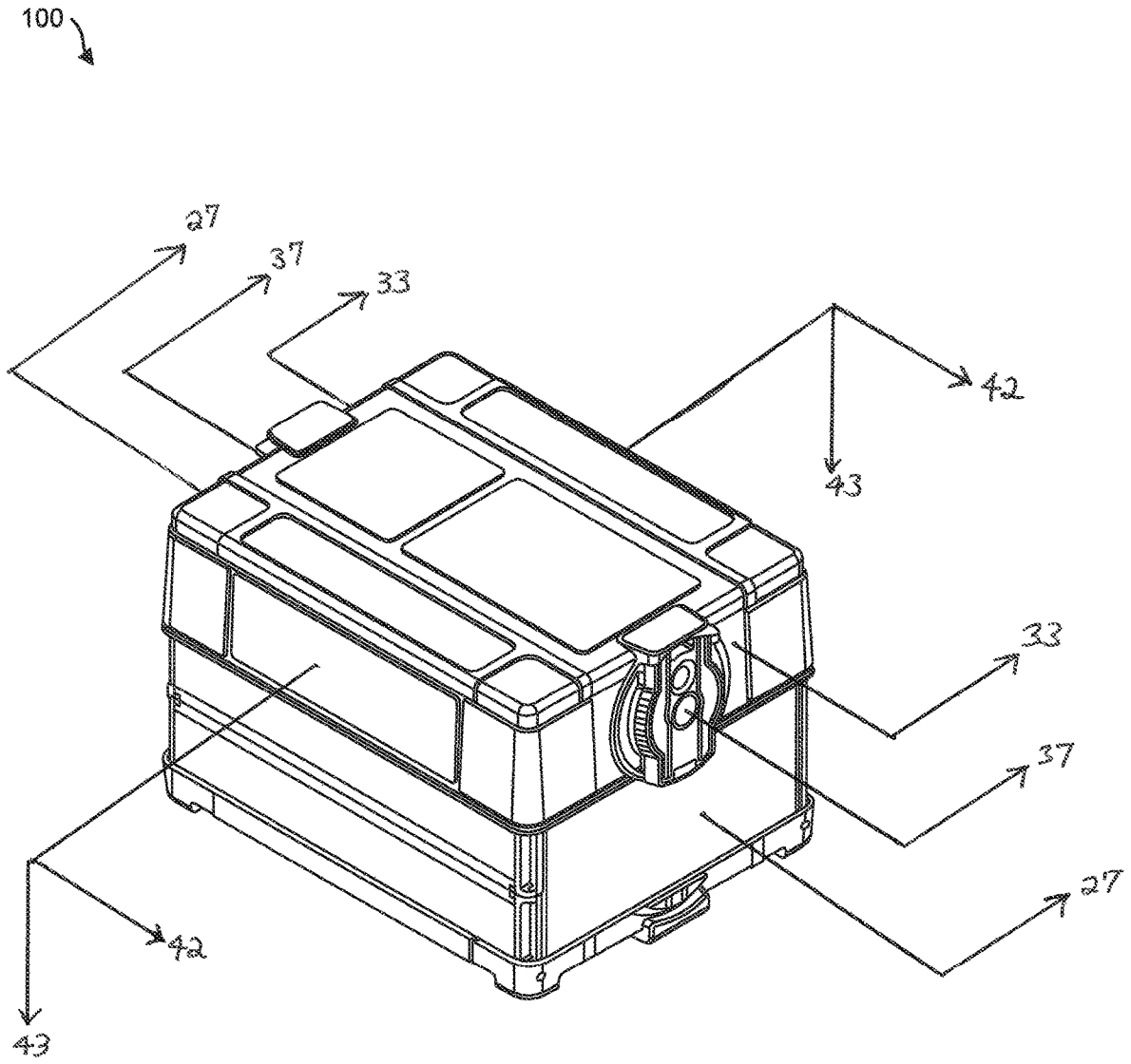
FIG. 11B illustrates the portable storage container of FIG. 11A with section cut lines referenced in subsequent Figures.
Figure 15:
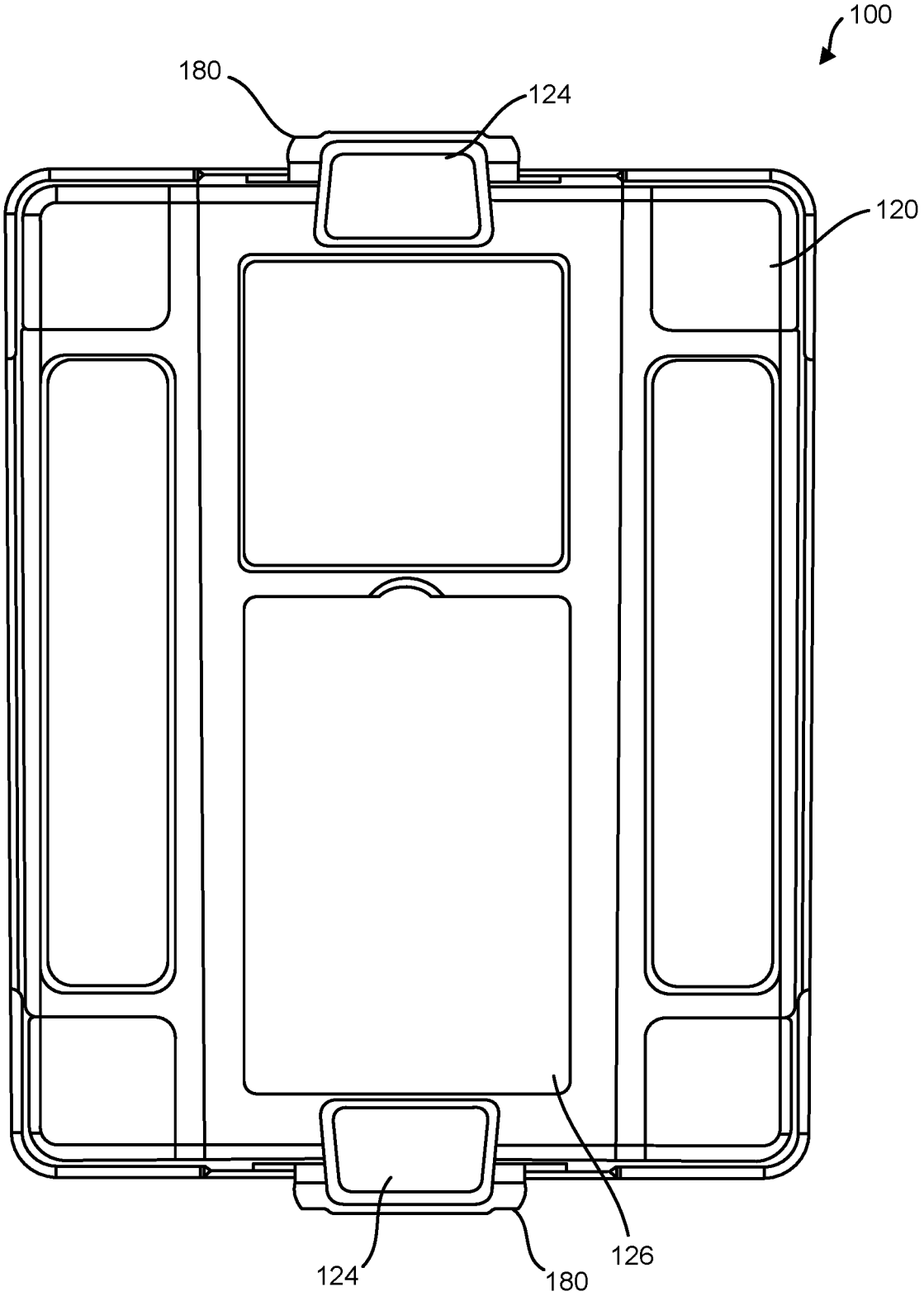
FIG. 15 illustrates a top view of the container of FIG. 11A.
Figure 16:
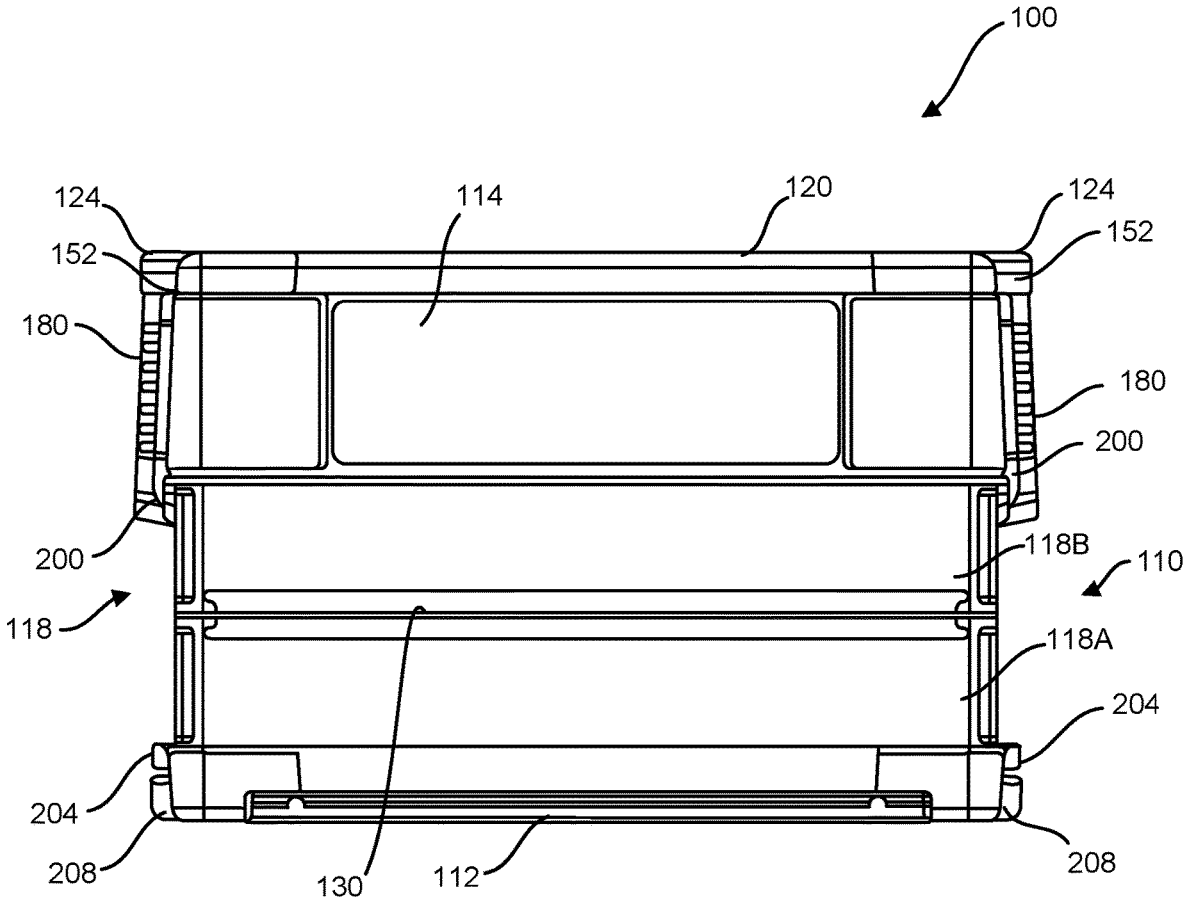
FIG. 16 illustrates a side view of the container of FIG. 11A in the expanded configuration.
Figure 17:
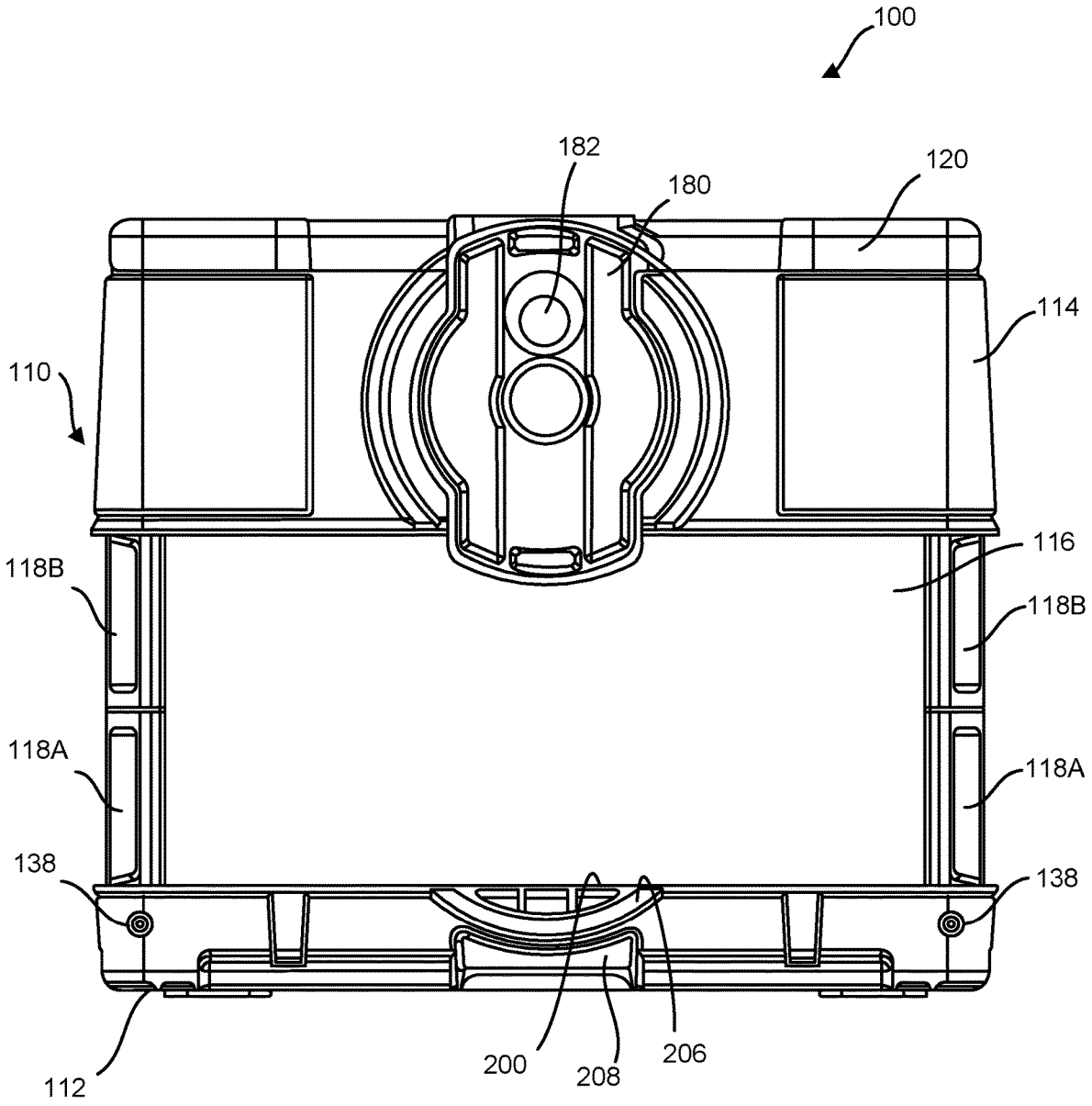
FIG. 17 illustrates an end view of the container of FIG. 11A in the expanded configuration.
Figure 18:
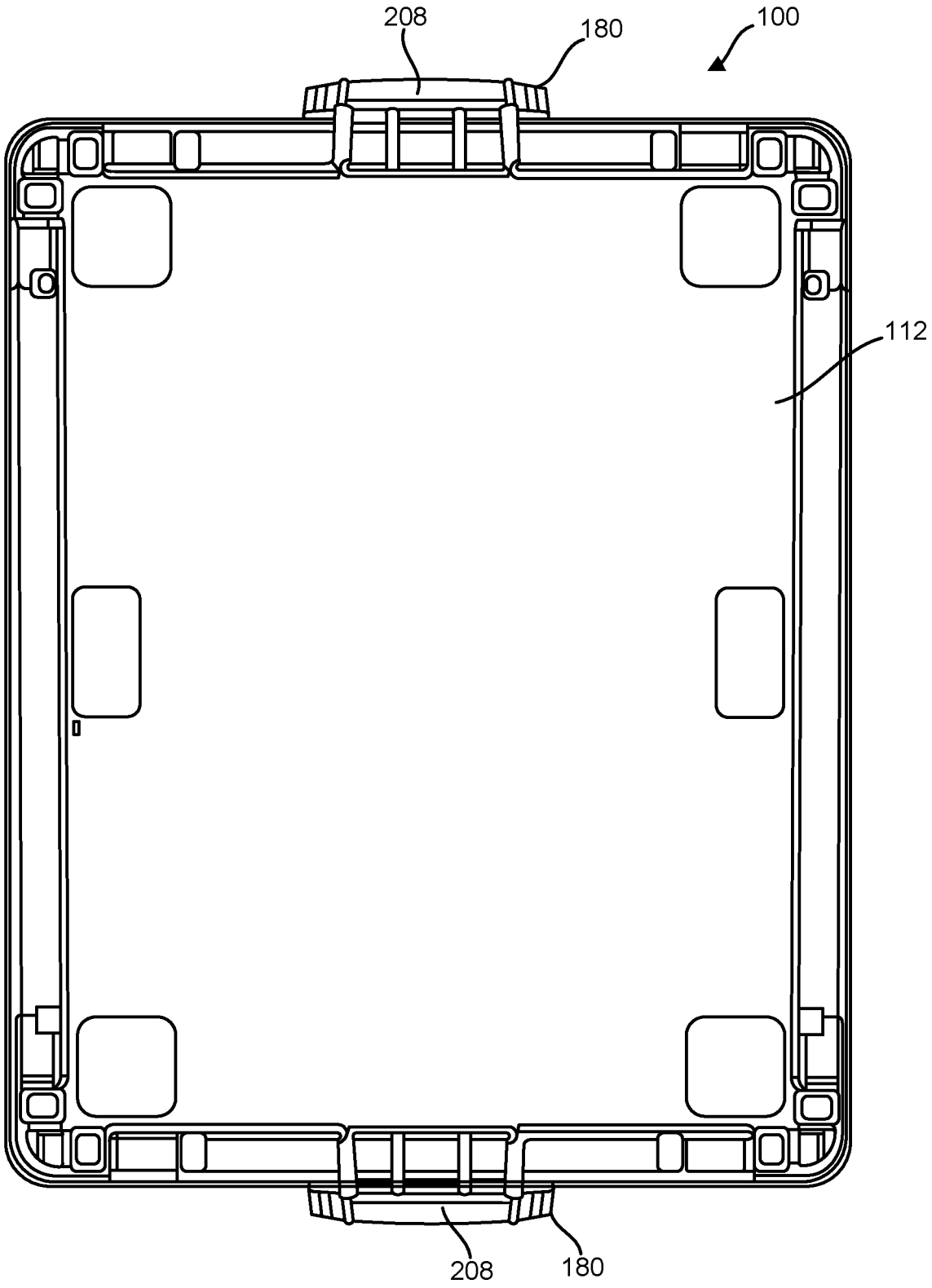
FIG. 18 illustrates a bottom view of the container of FIG. 11A.

FIGS. 11A and 15-18 illustrate exemplary portable storage container 100 in a first, expanded configuration suitable for storing items in an interior storage area 102 of container 100. FIG. 11A illustrates a perspective view of portable storage container 100 in the expanded configuration. FIG. 15 illustrates a top view of portable storage container 100 in the expanded configuration. FIG. 16 illustrates a side view of portable storage container 100 in the expanded configuration. FIG. 17 illustrates a front view of portable storage container 100 in the expanded configuration. FIG. 18 illustrates a bottom view of portable storage container 100 in the expanded configuration.

Figure 19:
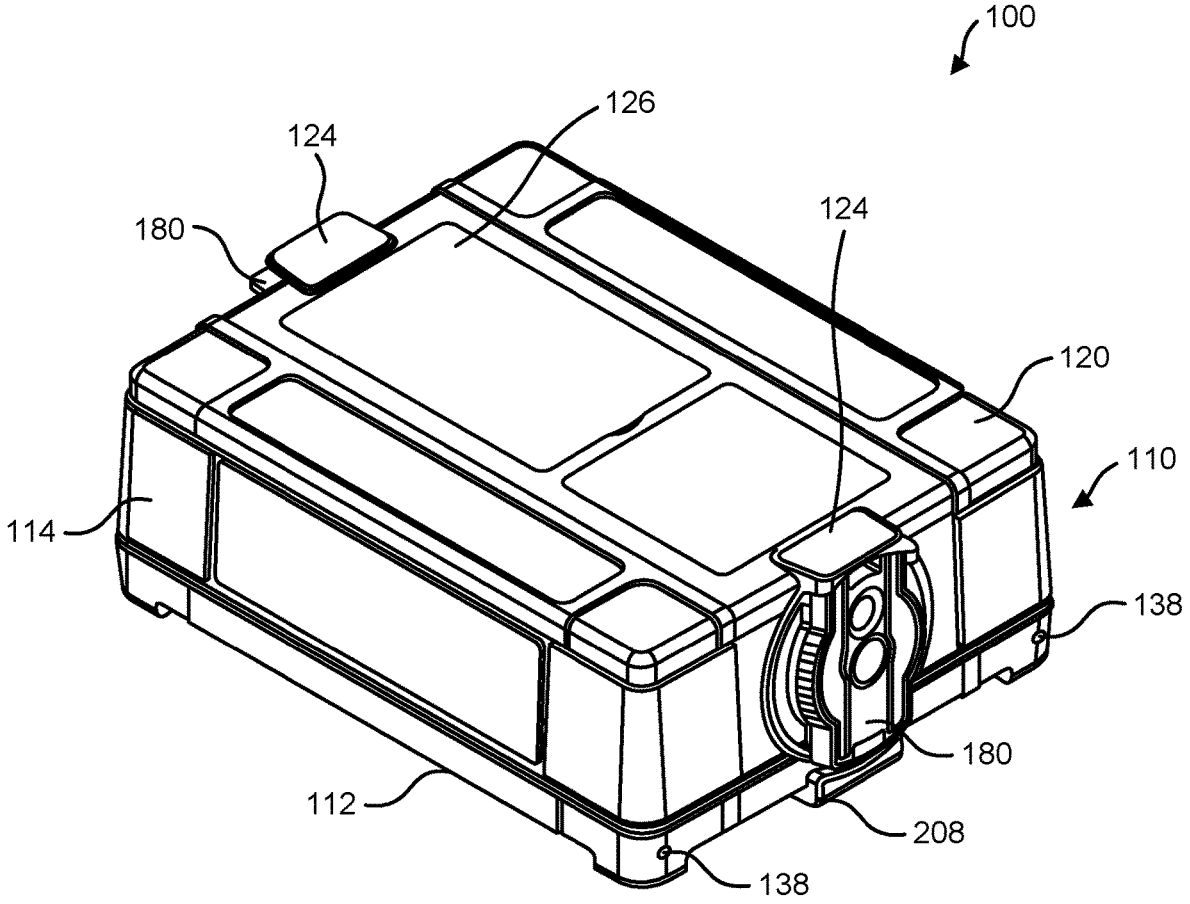
FIG. 19 illustrates a view of the exemplary portable storage container of FIG. 11A in a collapsed configuration.
Figure 20:
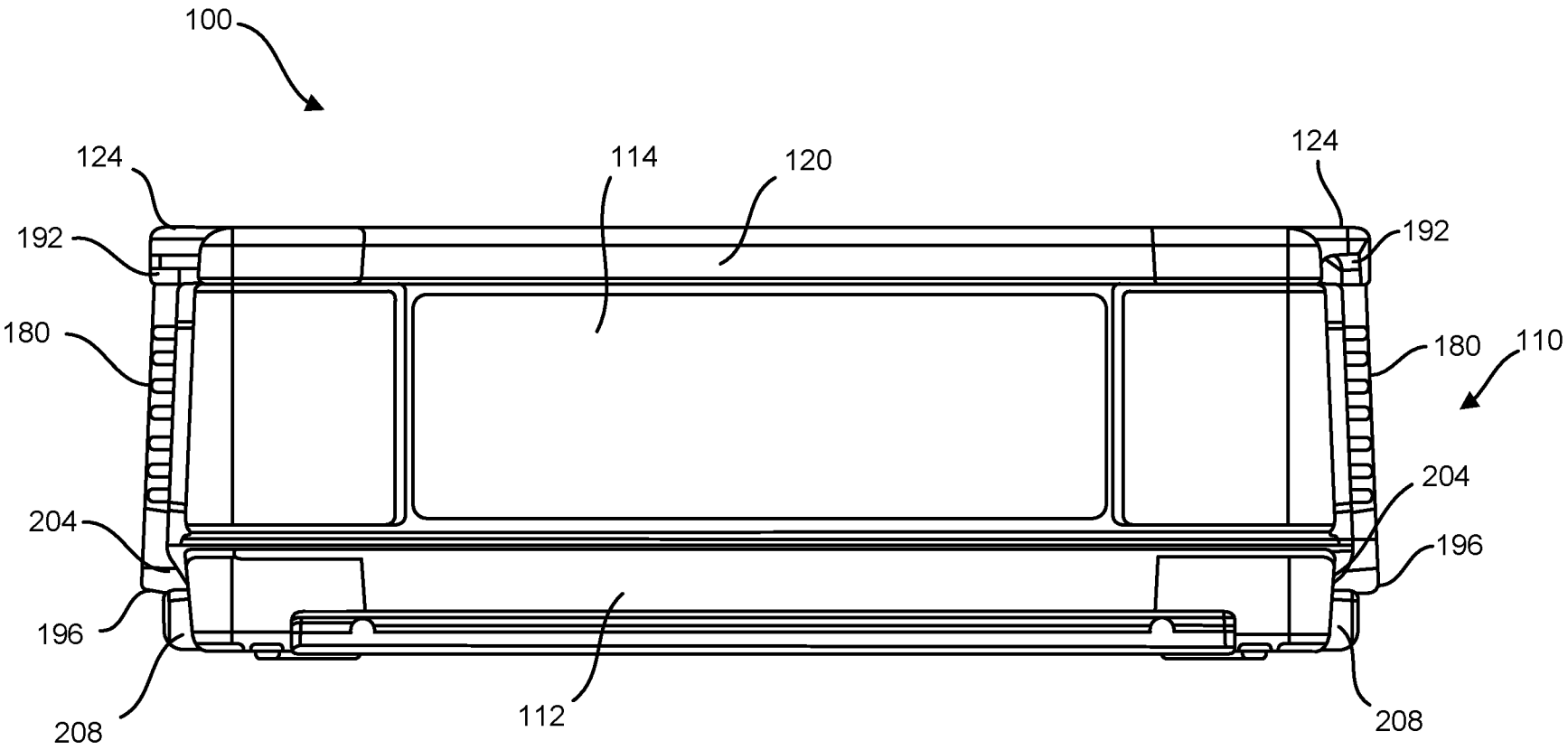
FIG. 20 illustrates a side view of the container of FIG. 19 in the collapsed configuration.
Figure 21:
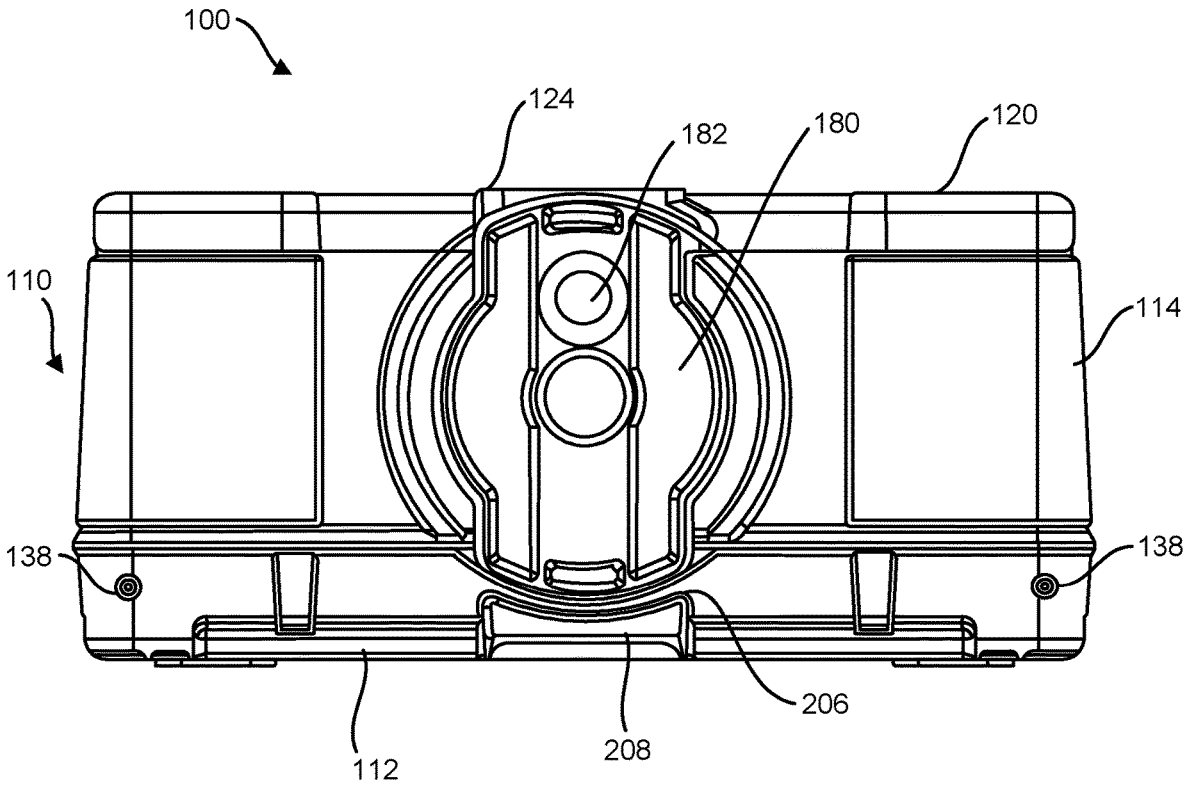
FIG. 21 illustrates an end view of the container of FIG. 19 in the collapsed configuration.

FIGS. 19-21 illustrate container 100 in a second, collapsed configuration suitable for shipping container 100. The height of the container 100 in the expanded configuration is greater than the height of the container 100 in the collapsed configuration. The interior volume of the container 100 in the expanded configuration is greater than the interior volume of the container in the collapsed configuration. FIG. 19 illustrates a perspective view of the portable storage container 100 in the collapsed configuration. FIG. 20 illustrates a side view of the container 100 in the collapsed configuration. FIG. 21 illustrates a front view of the container 100 in the collapsed configuration. Although FIG. 15 illustrates the top view of container 100 and FIG. 18 illustrates the bottom view of the container 100 in the expanded configuration, it should be recognized that the corresponding top and bottom views in the collapsed configuration are similar.

Figure 41:
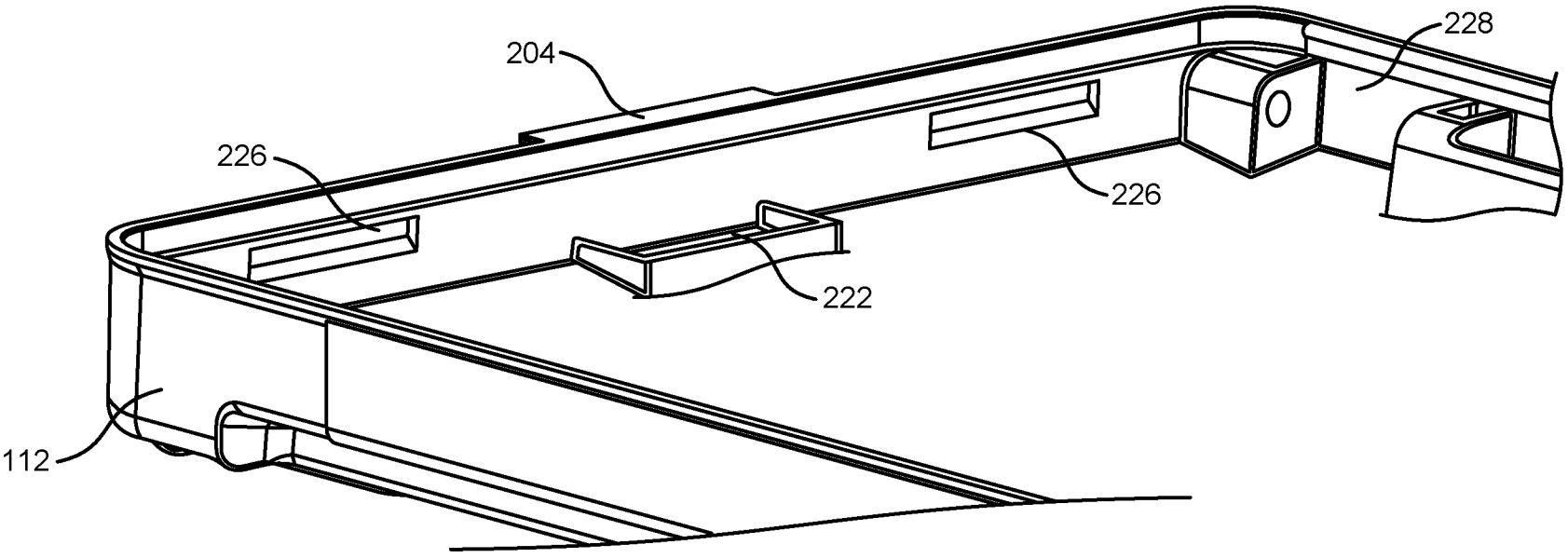
FIG. 41 illustrates a rear view of an end portion of the base of FIG. 40.
Figure 42:
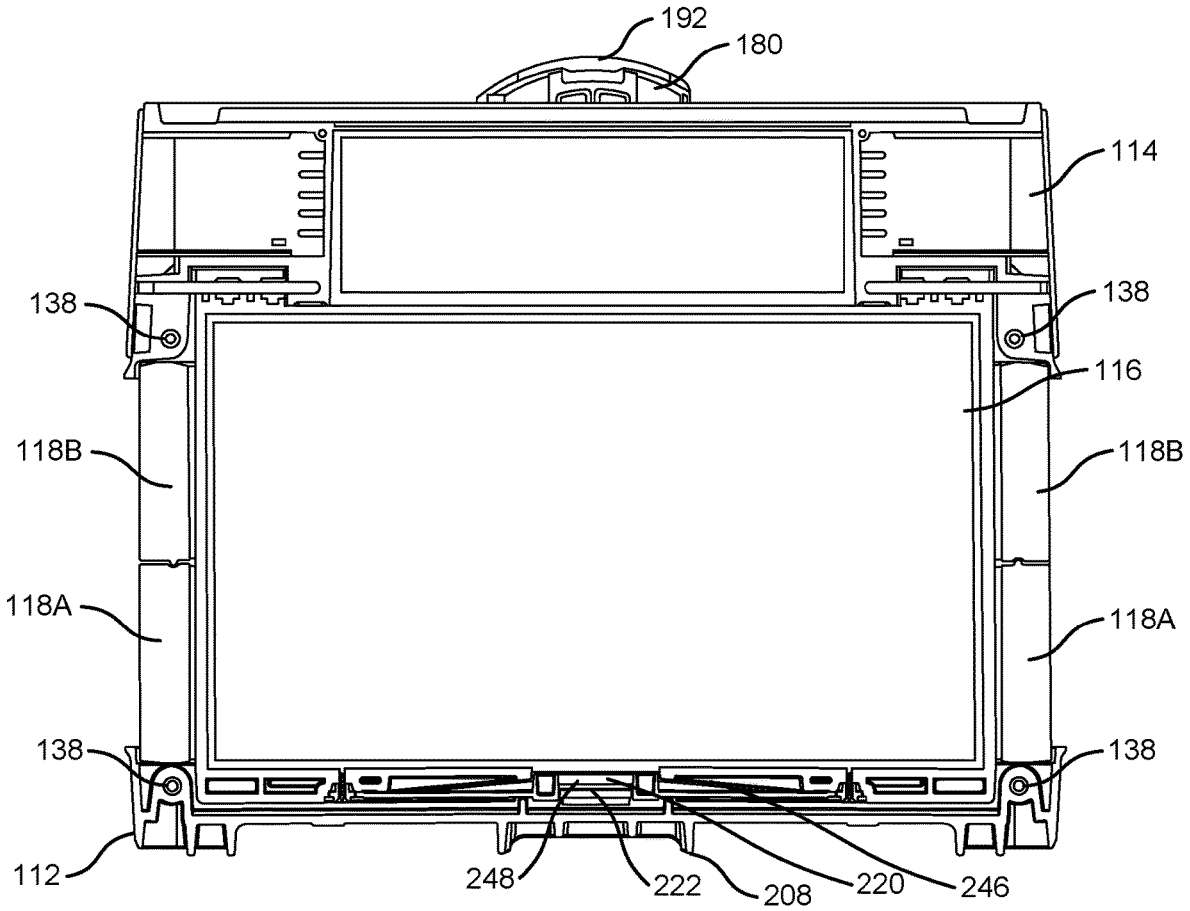
FIG. 42 illustrates a sectional view of the portable storage container of FIG. 11B in the expanded configuration showing an exemplary locking member.

The sides of container 100, namely end panels 116 and side panels 118, are movable between a first vertical storage position when the container is in the first expanded configuration, such as shown in FIG. 11A, and a second horizontal shipping position (see FIG. 7) when the container is in the second collapsed configuration, such as shown in FIG. 19. In some embodiments, an attachment mechanism 132 of an upper portion each end panel 116 and side panel 118 is pivotably attached to an upper perimeter portion 114 of body 110 by a pin 138 and receiver 228. An additional attachment mechanism 132 of a lower power of each side panel 118 is pivotably attached a receiver 228 in the base 112 by a pin 138 (see FIG. 41). To transition from the expanded configuration to the collapsed configuration, the end panels 116 are pivoted with respect to the upper perimeter portion 114 about the pins 138 to a substantially horizontal position (see FIG. 6). Each of the lower side panels 118A then pivots with respect to the base and each of the upper side panels 118B pivots with respect to the upper perimeter portion 114 as the side panels 118 collapse about hinge 130 (see FIG. 7), such that an external surface of the lower side panel 118A is brought into contact with an external side surface of the upper side panel 118B thereby placing side panels 118 into the collapsed position.

Figure 22:
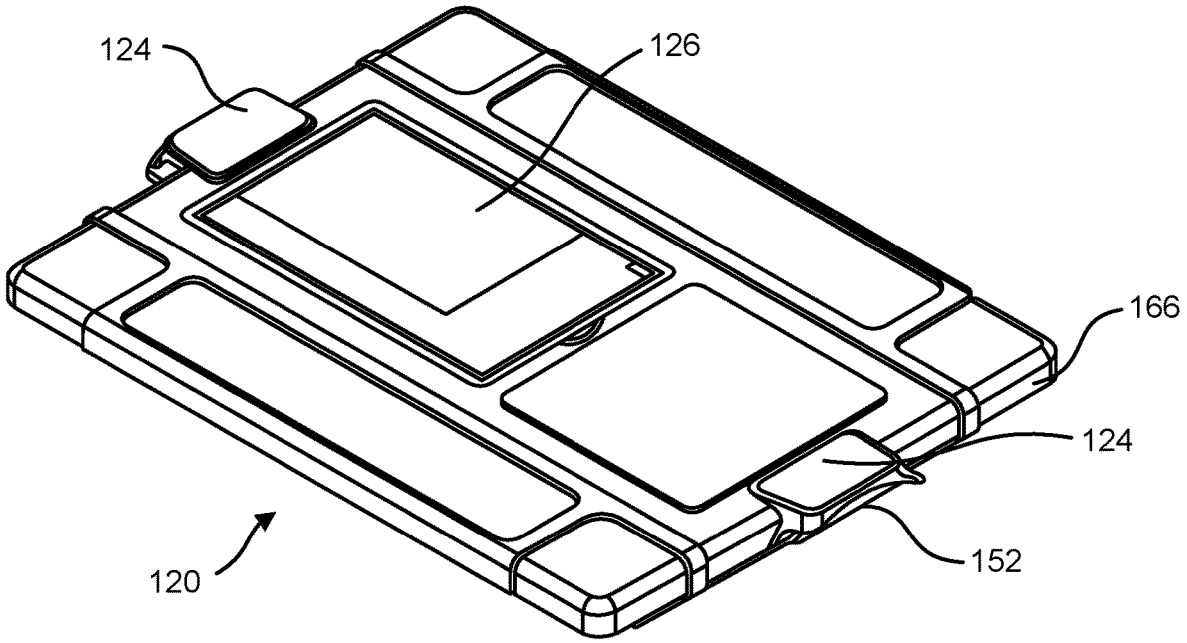
FIG. 22 illustrates an exemplary lid for the portable storage container of FIG. 11A.
Figure 23:
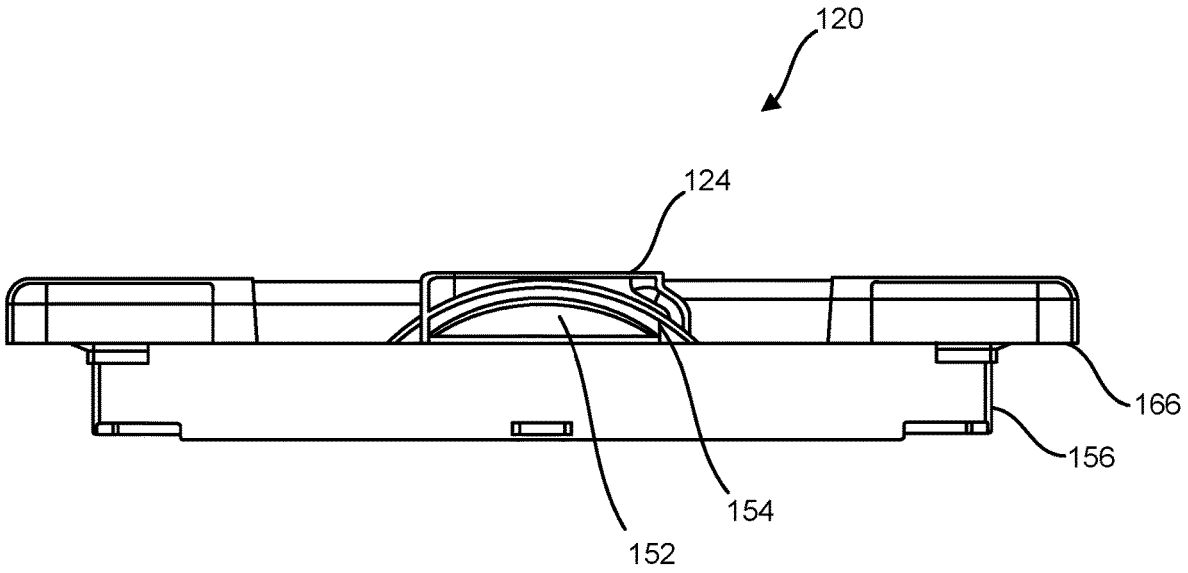
FIG. 23 illustrates an end view of the lid of FIG. 22.
Figure 24:
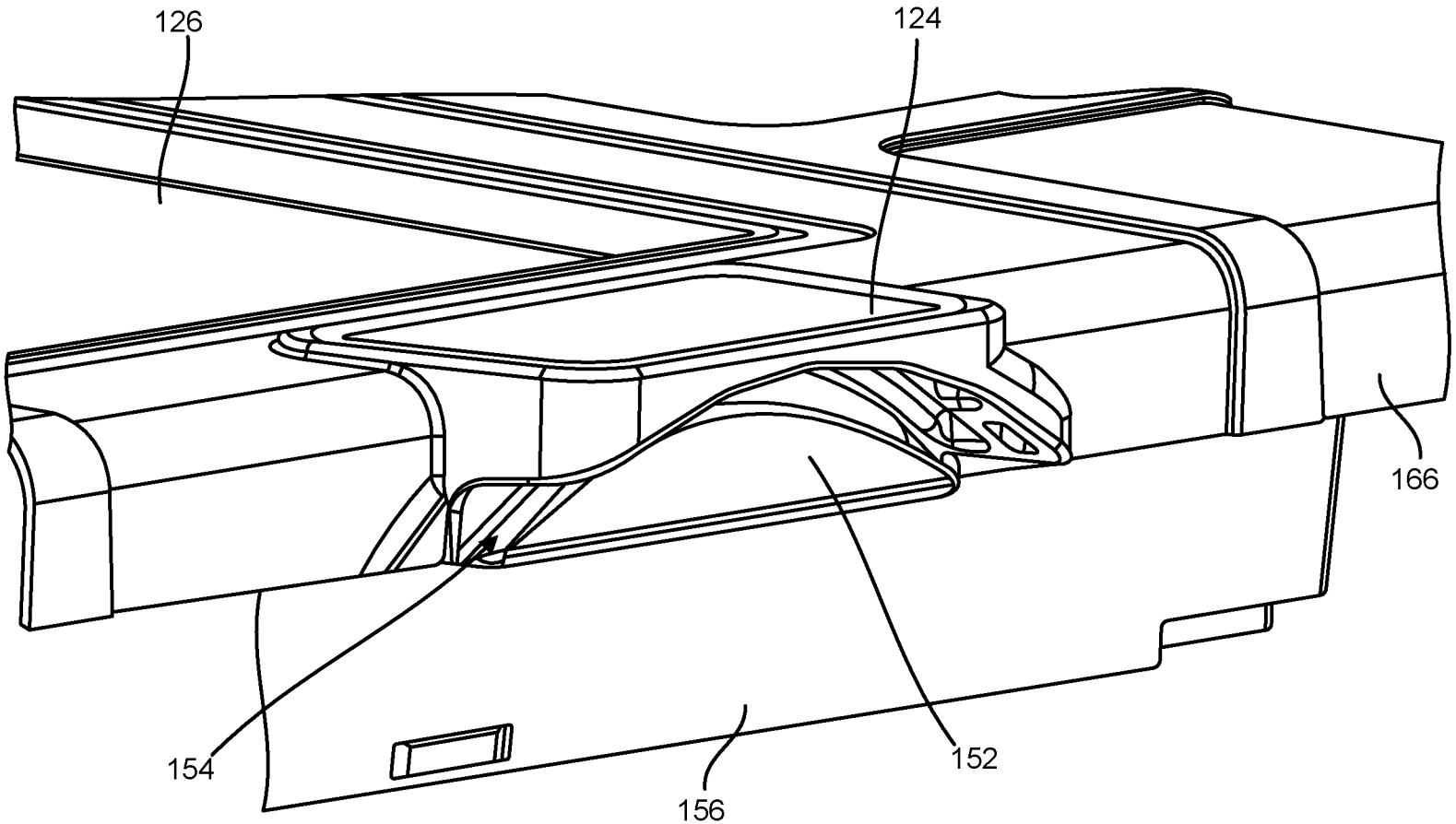
FIG. 24 illustrates an exemplary handle of the lid of FIG. 22.
Figure 25:
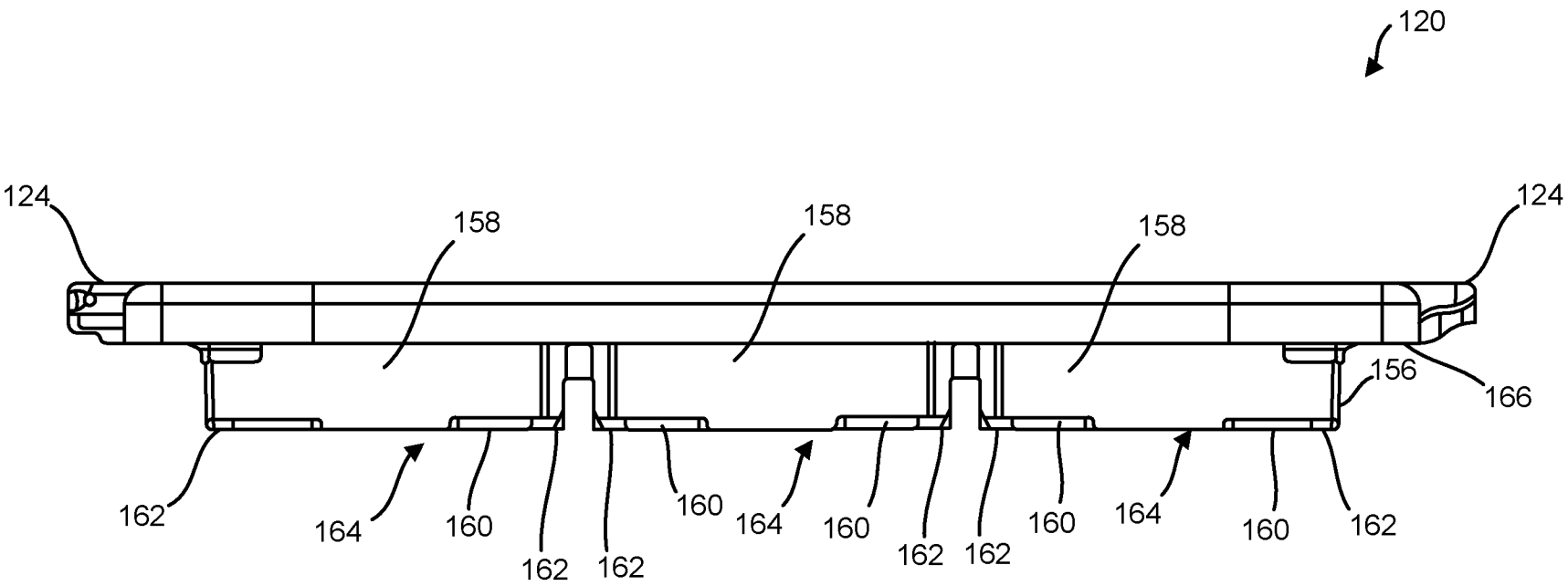
FIG. 25 illustrates a side view of the lid of FIG. 22.
Figure 26:
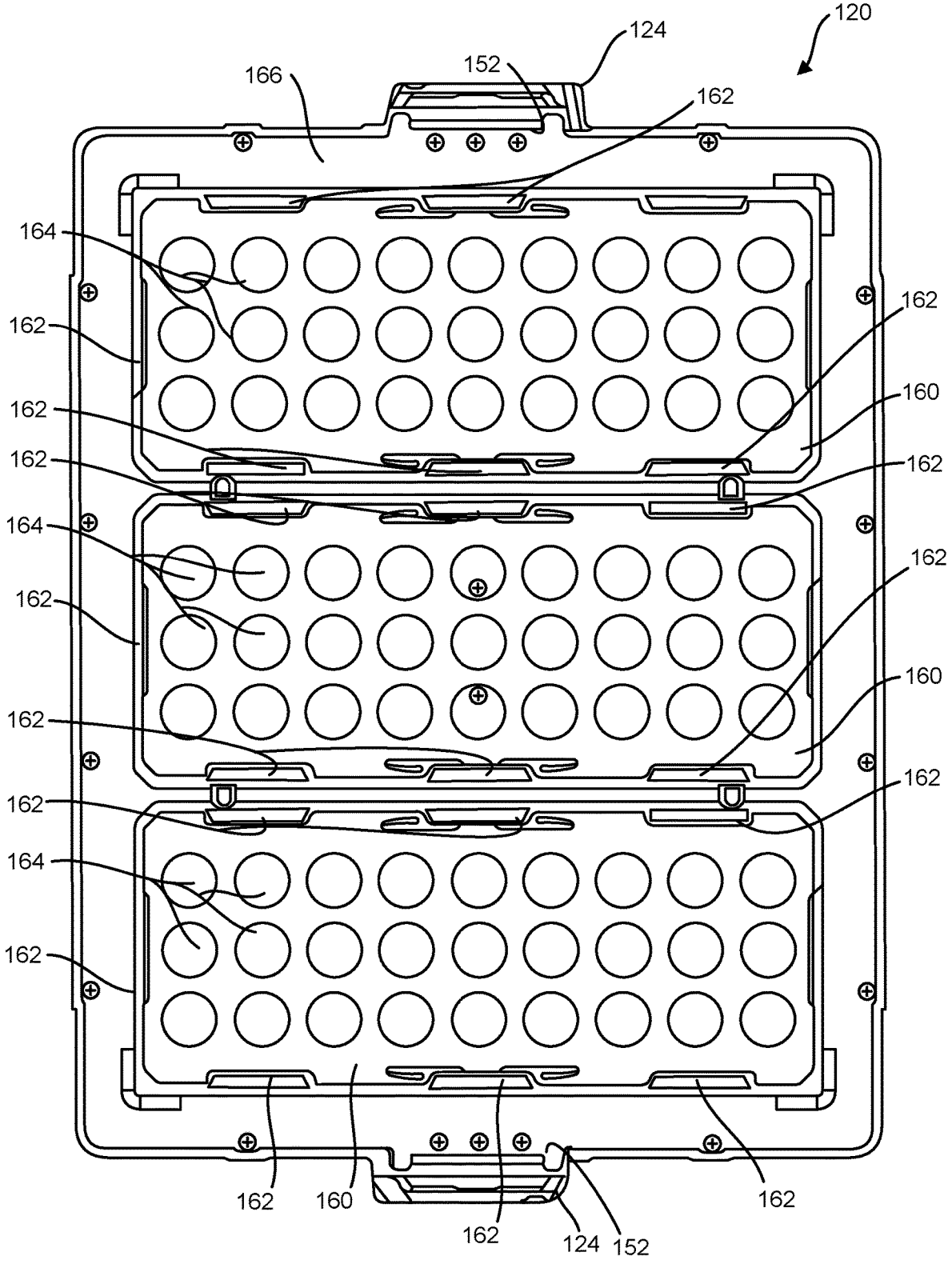
FIG. 26 illustrates a bottom view of the lid of FIG. 22.

Referring next to FIGS. 22-26, an exemplary lid 120 for container 100 is illustrated. FIG. 22 illustrates a perspective view of lid 120. FIG. 23 illustrates a front view of lid 120. FIG. 24 illustrates a portion of a handle 124 of lid 120. FIG. 25 illustrates a side view of lid 120. FIG. 26 illustrates a bottom view of lid 120. Lid 120 is configured to close the internal storage area 102 of container 100 when the lid 120 is in a closed position, such as illustrated in FIGS. 11A and 19, and provides access to the internal storage area 102 when the lid is in an opened position. In some exemplary embodiments, lid 120 may include a lock, a tamper resistant or tamper-evident closure.

In the embodiment illustrated in FIG. 22, an upper portion 166 of lid 120 includes shipping label area 126 for receiving a shipping label. In some exemplary embodiments, shipping label area 126 includes a pouch or envelope for at least partially enclosing a shipping label. In some exemplary embodiments, shipping label area 126 has a substantially flat surface to which a shipping label can be adhered.

Lid 120 illustratively includes one or more handles 124. As illustrated in FIGS. 22-24, each handle extends outwardly from the upper portion 166 of lid 120, providing a user with a convenient area for grasping container 100. Handle 124 illustratively includes a lid locking portion 152 and lid locking groove 154 for receiving an upper locking lip 194 of upper locking portion 192 of securing mechanism 180 (see FIG. 37).

As illustrated in FIG. 23, lid 120 further includes a lower portion 156 attached to upper portion 166. Lower portion 156 illustratively extends into the storage area 102 of container 100 when the lid 120 is coupled to the body 110 (see FIG. 27).

In the exemplary embodiment illustrated in FIGS. 25 and 26, lid 120 includes a plurality of compartments or receptacles 158 configured to receive one or more temperature control element, such as an ice pack, reusable cold pack, dry ice, or warming pack. The receptacles face the internal storage area 102 when the lid is in the closed position.

In some exemplary embodiments, the lid includes a plurality of shelves 160, each configured to cover at least a portion of one of the receptacles 158. The receptacles 158 are held in place by one or more tabs 162 on the bottom portion of lid 120. Each shelf 160 is configured to hold or support the temperature control element positioned in the corresponding receptacle 158. In other exemplary embodiments, the temperature control element may be directly attached to lid 120, such as snapping into tabs 162 of lid 120, or movable retaining element such as a screw or rotatable tab.

As illustrated in FIG. 26, each shelf 160 includes a plurality of apertures 164 (not all apertures are numbered in FIG. 26) allowing for convective air movement between the receptacle 158 and internal storage area 102. As an example, air cooled by a cooling element such as an ice pack in receptacle 158 moves through the apertures 164 into the internal storage area 102 to cool the internal storage area 102, while warmer air from internal storage area 102 moves through the apertures into the receptacle 158 where it is cooled by the cooling element positioned therein.

Figure 28:
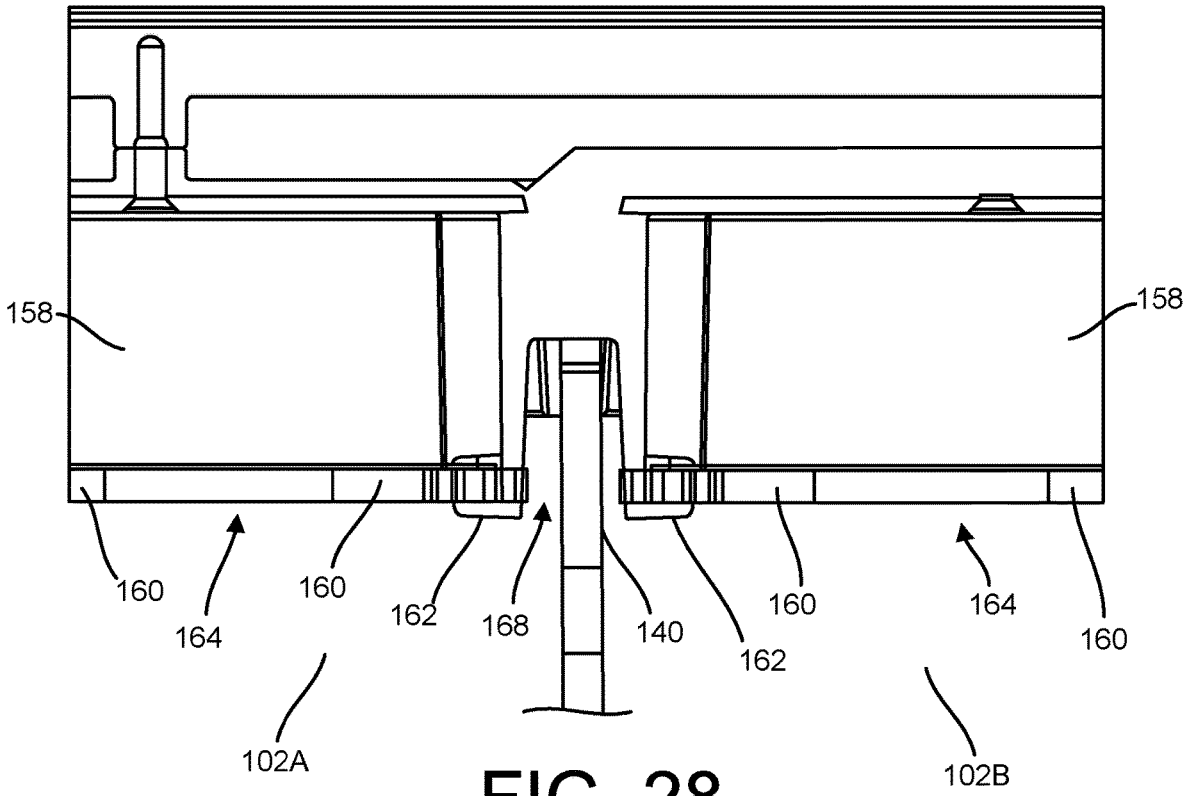
FIG. 28 illustrates a detail portion of FIG. 27 showing the divider and the lid.

Referring next to FIGS. 27 and 28, the lid 120 further includes one or more slots 168 separating adjacent receptacles 158. As shown in FIG. 27, lid 120 may include first and second slots 168A, 168B dividing lower portion 156 of lid 120 into three receptacles 158. In other embodiments, lid 120 may include more or fewer slots 168 and lower portion 156 may be divided into more or fewer receptacles 158. Each slot 168 is configured to receive an upper edge of divider 140 to divide internal storage area 102 into a first portion 102A and a second portion 102B. In some exemplary embodiments, the upper perimeter portion 114 and/or one or more side panels 118 also include a slot 128 (see FIG. 4) to further secure the divider 140 in place.

In some exemplary embodiments, at least one of liner 148 and body 110 includes slots 128 at least partially extending around installed divider 140 to support the container 100 in the expanded configuration.

Figure 29:
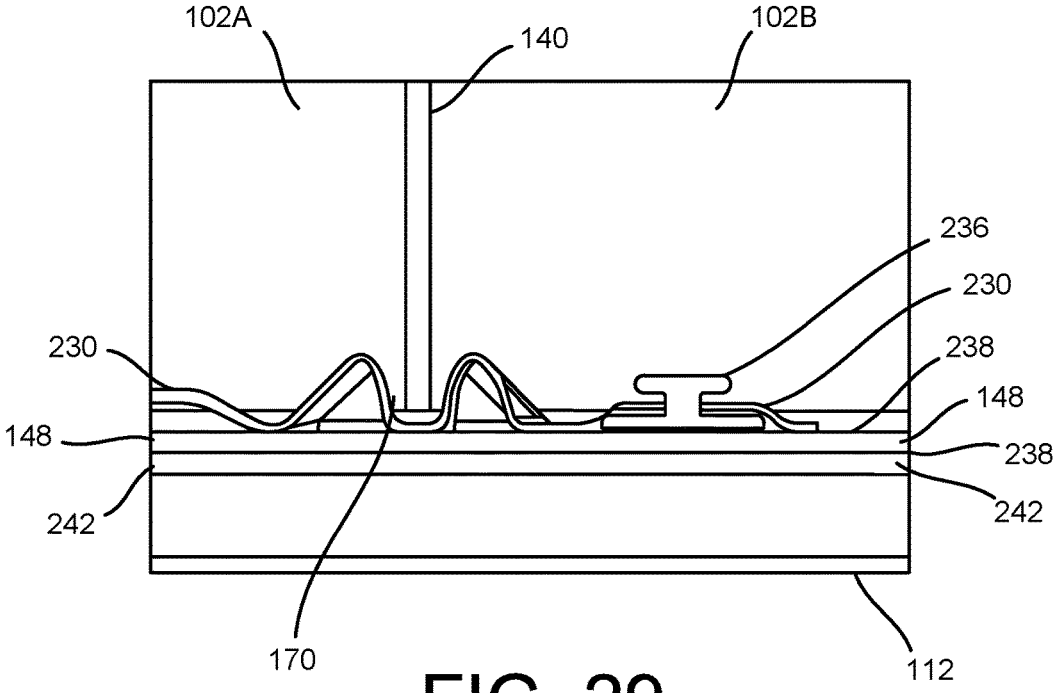
FIG. 29 illustrates another detail portion of FIG. 27 showing the divider and the base.

Referring next to FIGS. 27 and 29, at least one of the base 112, the liner 148, and the handle 230 includes one or more slots 170 proximate the base 112 and corresponding to and substantially vertically aligned with each of the slots 168 for divider 140 in lid 120. As illustrated in FIG. 29, in some embodiments, the slots 170 may be formed in a handle 230 attached to the liner 148. In other exemplary embodiments, the slots 170 may be formed directly in an inner surface of the base 112 and/or the inner surface 148A of liner 148. As shown in FIG. 27, first and second slots 170A, 170B may be provided. In other embodiments, more or fewer slots 170 may be provided. Each slot 170 is configured to receive a lower edge of divider 140 to divide internal storage area 102 into a first portion 102A and a second portion 102B. In some exemplary embodiments, one or more side panels 118 may also include a slot 170 to further secure the divider 140 in place.

As illustrated in FIG. 27, positioning divider 140 into the slot 168A and slot 170A as shown results in a first storage area portion 102A associated with first receptacle 158A and second receptacle 158B, and a second storage area portion 102B associated with third receptacle 158C. Similarly, positioning divider 140 into the slot 168B and slot 170B would result in a first storage area portion associated with first receptacle 158A and a second storage area portion associated with second receptacle 158B and third receptacle 158C. Positioning a first divider 140 into slot 168A and 170A and a second divider 140 (not shown) into slot 168B and 170B would result in a first storage area portion associated with first receptacle 158A, a second storage area portion associated with second receptacle 158B, and a third storage area portion associated with third receptacle 158C.

In some exemplary embodiments, it may be desirable to thermally isolated isolate adjacent first portion 102A and second portion 102B of internal storage area 102. In these embodiments, a first temperature control element may be placed in first receptacle 158A to maintain the first portion 102A at a first temperature and a second temperature control element may be placed in second receptacle 158B to maintain the second portion 102B at a second temperature that is different than the first temperature. In one embodiment, the first temperature control element is dry ice and the second temperature control element is an ice pack or reusable cold pack to maintain a first temperature that is colder than the second temperature.

In some exemplary embodiments, slots 128 form a seal with an insulated divider 140 to thermally isolate adjacent first portion 102A and second portion 102B of internal storage area 102. In some exemplary embodiments, divider 140 is formed as a part of liner 148 to thermally isolate adjacent first portion 102A and second portion 102B of internal storage area 102.

Each slot 168 in the lid 120 and/or side panels 118, as well as each slot 170 in the handle 230 or base 112 illustratively acts as a divider 140 positioning feature to maintain the position of divider 140 within the internal storage area 102. When positioned one or more slots 168, 170, divider 140 supports the shape of container 100.

Figure 30:
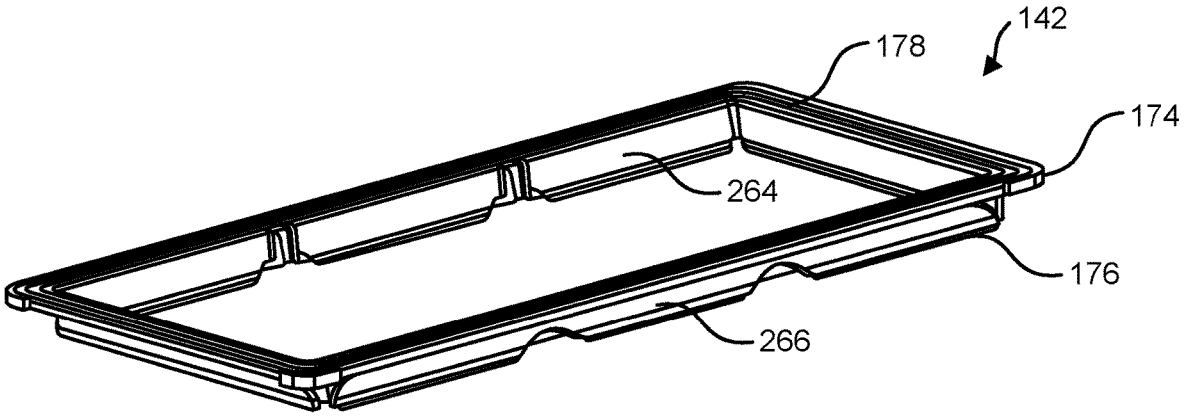
FIG. 30 illustrates an exemplary hoop for the portable storage container of FIG. 11A.
Figure 31:
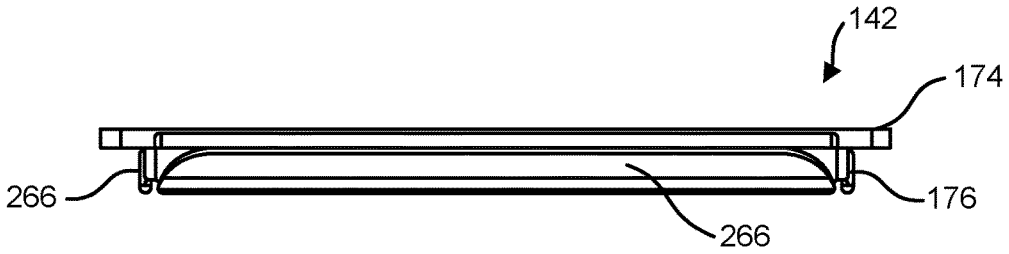
FIG. 31 illustrates a side view of the hoop of FIG. 30.
Figure 32:
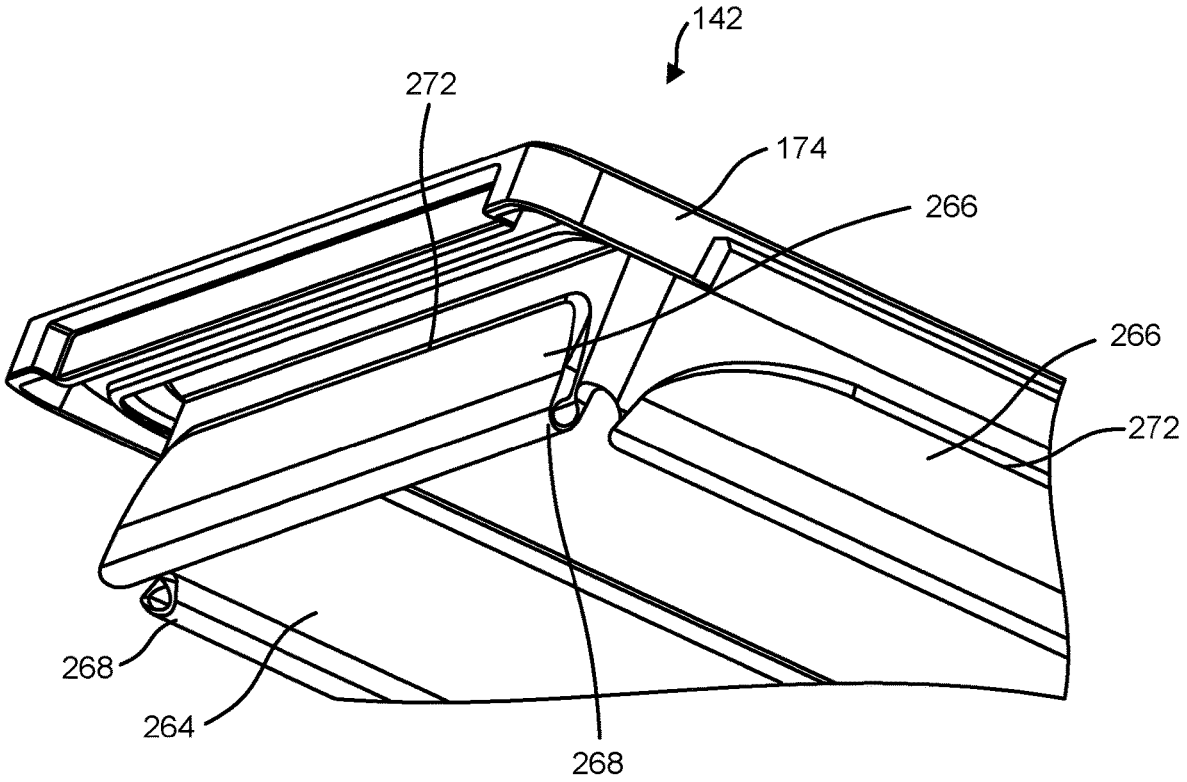
FIG. 32 illustrates a bottom perspective view of a portion of the hoop of FIG. 30.

Referring next to FIGS. 30-32, an illustrative hoop 142 for securing the liner 148 in the internal storage area 102 is illustrated. As shown in FIGS. 30 and 31, the hoop 142 has a plurality of sides forming a continuous perimeter and includes an upper perimeter portion 174 and a lower perimeter portion 176. In some embodiments, an upper surface of the upper perimeter portion 174 includes a channel 178 for receiving a gasket 144 to seal the body 110 to the lid 120 when the lid 120 is in the closed position.

As shown in FIG. 32, the lower perimeter portion 176 of hoop 142 includes a connecting portion 264 extending downwardly from the upper perimeter portion 174. The connecting portion 264 is flexibly attached to a securing portion 266 by an intermediate portion 268. Securing portion 266 includes a plurality of projections that each extend substantially upward in relation to the intermediate portion 268.

In some exemplary embodiments, the intermediate portion 268 has a thinner cross sectional area relative to the connecting portion 264 and/or securing portion 266, allowing the securing portion 266 to flex about the intermediate portion 268 relative to the securing portion 266. In one exemplary embodiment, the flexible intermediate portion 268 biases the securing portion 266 at an angle to the vertical connecting portion 264 in a direction towards the exterior surface of the container 100 when the hoop 142 is installed in the upper perimeter portion 114. In some exemplary embodiments, the connecting portion 264 and the securing portion 266 have substantially similar cross-sectional areas.

In some embodiments, the lower perimeter portion 176 is formed by molding the hoop 142 out of a plastic material such that the connecting portion 264, intermediate portion 268, and securing portion 266 form a substantially straight line. While the hoop 142 is warm, the securing portion 266 is then pushed upward to be almost parallel with the connecting portion 264 and the hoop 142 is cooled. The resulting strain in the intermediate portion 268 provides an outward biasing force to the securing portion 266.

Figure 33:
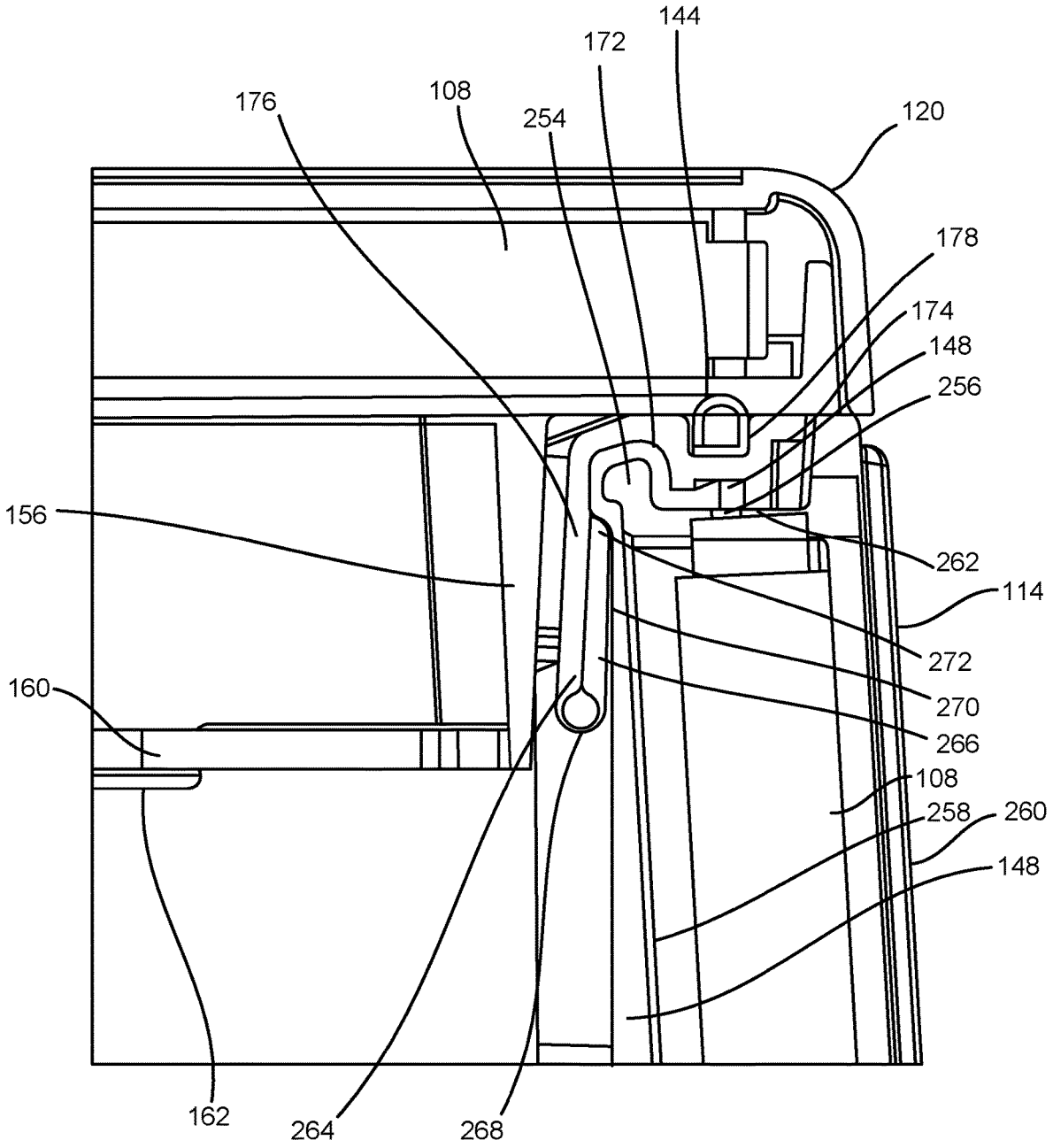
FIG. 33 illustrates a sectional view of the portable storage container of FIG. 11B showing the hoop and liner.

Referring next to the cross-section illustrated in FIG. 33, the upper perimeter portion 114 includes an internal lip 254 extending in a direction towards the internal storage area 102 of container 102. An edge region 172 of liner 148 extends up an inner surface 258 of the upper perimeter portion 114, over the lip 254, and onto the top surface 262 of the upper perimeter portion 114. The hoop 142 is then positioned within a channel or recess 256 on the top surface 262 of the upper perimeter portion. Hoop 142 may include a channel or recess 178 for receiving gasket 144. In one exemplary embodiment, gasket 144 is secured in recess 178 by a friction fit or adhesive. In another exemplary embodiment, gasket 144 is secured to lid 120 and received within recess 178 when the lid is in the closed position.

As the hoop 142 is positioned, the securing portion 266 of the hoop 142 is compressed by the lip 254 towards the connecting portion 264. After the distal end 272 of the securing portion 266 passes the lip 254, the securing portion 266 is compressed against the liner 148, exerting a force through the liner 148 against the inner surface 258 of the upper perimeter portion. The hoop 142 is maintained in position by the distal end 272 of the securing portion 266, which is prevented from moving upward by the lip 254. In some embodiments, the hoop 142 provides a force on two, three, or four sides of the upper perimeter portion 114 to secure the liner 148 in place. In some exemplary embodiments, the thinner intermediate portion 268 is configured to break if a strong enough upward force is exerted on the hoop 142, allowing hoop 142 and liner 148 to be removed from the interior storage area 102 of the container 100.

In some embodiments, the container 100 is assembled by providing the base, upper perimeter portion 114, end panels 116, and side panels 118. The liner 148 is inserted into the internal storage area 102 of the body 110, covering the internal lip 254 of the upper perimeter portion 114. The hoop 142 is then received within the recess 256 in the upper perimeter portion 114, such that the outer surface 270 of securing portion 266 exerts a force through the liner 148 against the upper perimeter portion to secure the liner 148 in place. The hoop 142 is retained in position by the distal end 272 of the securing portion 266 abutting the internal lip 254 of the upper perimeter portion 114.

Figure 34:
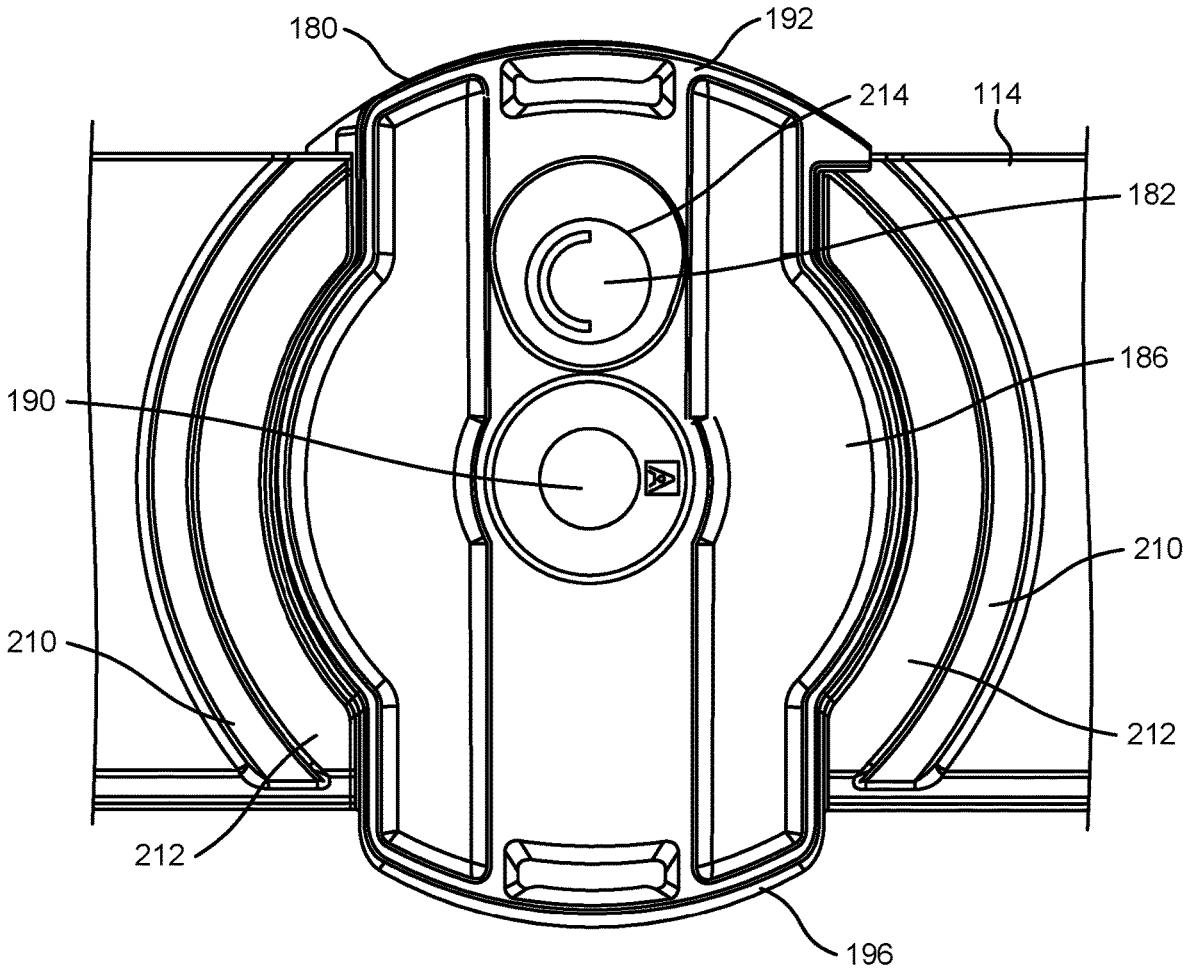
FIG. 34 illustrates an end view of an exemplary securing mechanism of the portable storage container of FIG. 11A.
Figure 35:
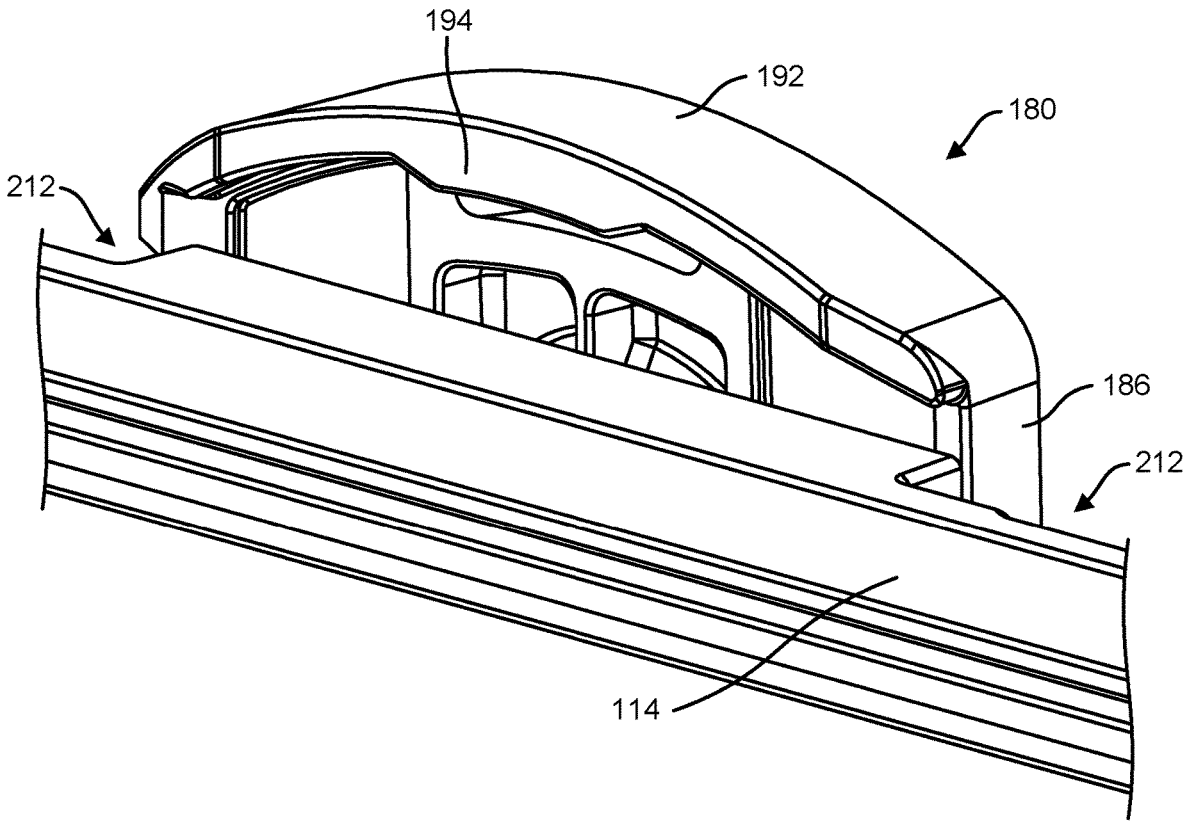
FIG. 35 illustrates a rear perspective view of the securing mechanism of FIG. 34.
Figure 36:
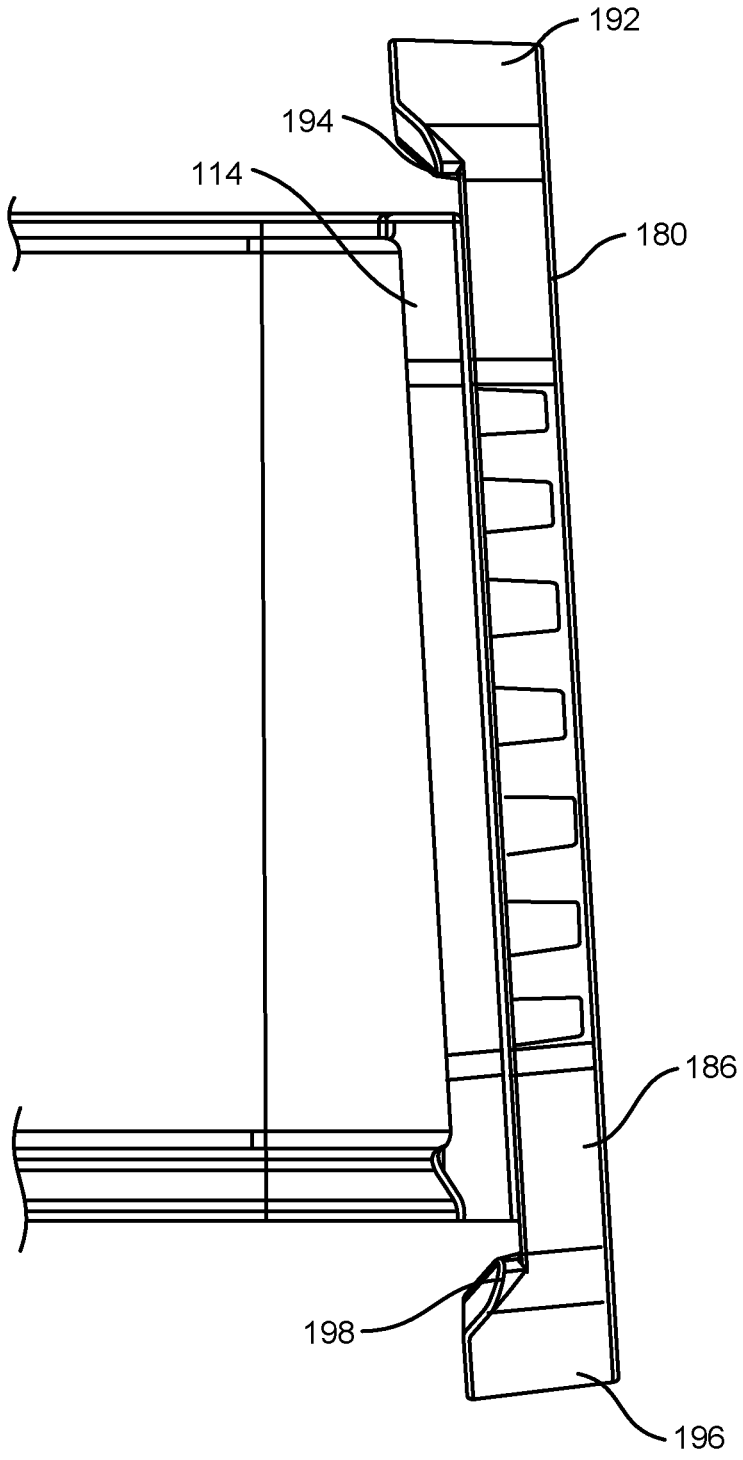
FIG. 36 illustrates a side view of the securing mechanism of FIG. 34.

Referring next to FIGS. 34-36, an exemplary securing mechanism 180 is illustrated. FIG. 34 illustrates a front view of the securing mechanism 180. FIG. 35 illustrates a rear perspective view of the securing mechanism 180. FIG. 36 illustrates a side view of the securing mechanism.

In some embodiments, securing mechanism 180 includes a rotating portion 186 which rotates about a rotation post 190 secured to upper perimeter portion 114. Rotating portion 186 is configured to be rotatable between a locked position in which securing mechanism 180 is releasably coupled to one or more of base 112, end panel 116, and lid 120, and an unlocked position in which securing mechanism 180 is not releasably coupled to one or more of base 112, end panel 116, and lid 120. Rotating portion 186 rotates clockwise and counterclockwise about post 190 between the locked position and unlocked position within a circular recess 212 formed in the outer perimeter surface 210 of upper perimeter portion 114.

Figure 37:
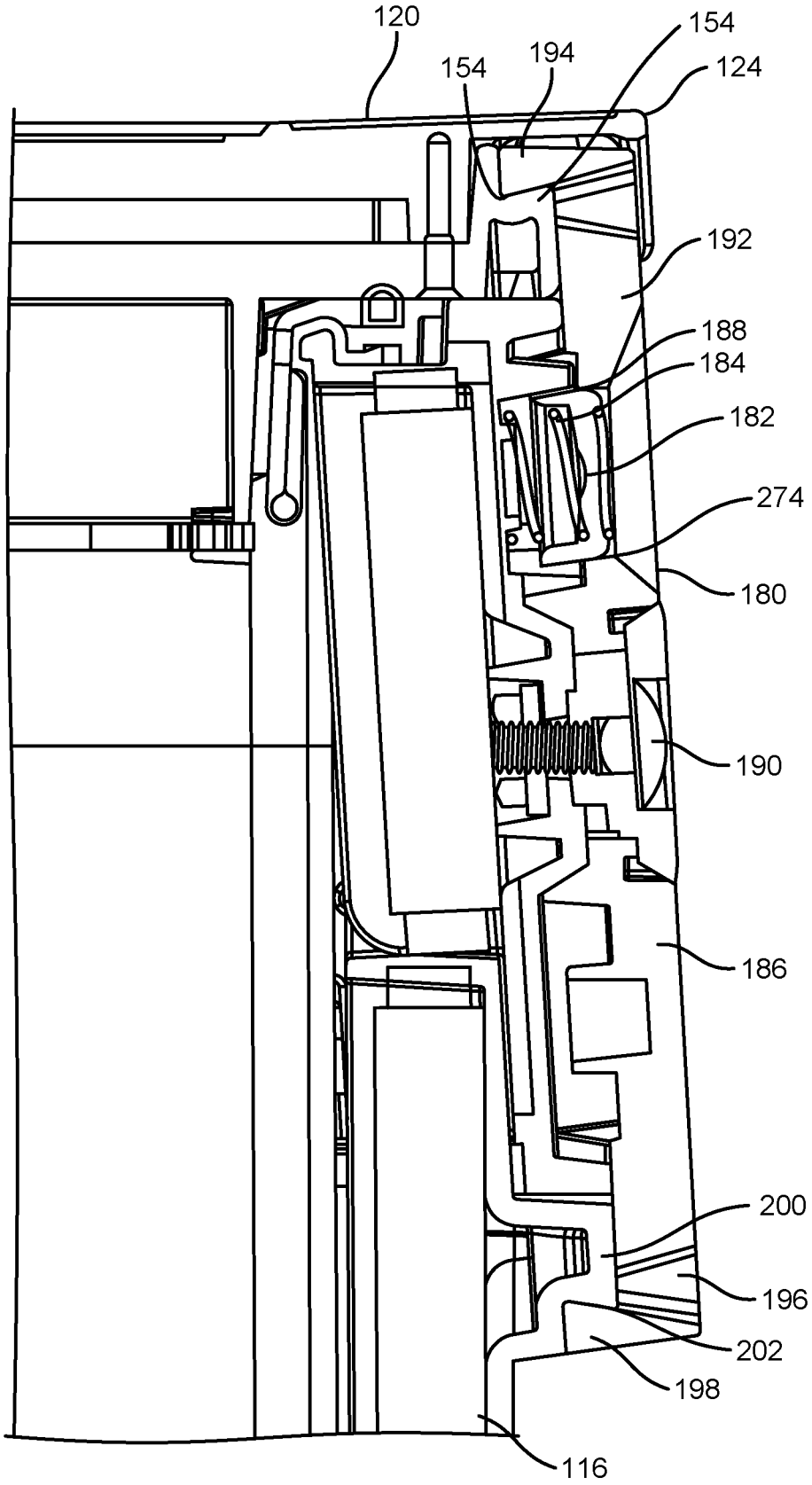
FIG. 37 illustrates a sectional view of the securing mechanism of FIG. 34.

As shown in FIGS. 34 and 37, securing mechanism 180 includes a locking button 182 received within a recess 274 in rotating portion 186. Button 182 is illustratively movable between the extended position as illustrated in FIG. 37, and a depressed position. A biasing member, such as a spring 184, biases the button 182 in the extended position. As shown in FIG. 37, when the rotating portion 186 is in the locked position, the button can move between the extended position and the depressed position. In the extended position, the button 182 partially extends into the recess 274 of the rotating portion 186, preventing the rotating portion from rotating out of the locked position. A user can apply a force to the button 182 to overcome the force of spring 184 and move button 182 from the extended position to a depressed position in which the button 182 is moved behind a back surface 188 of rotating portion 186, allowing rotating portion 186 to rotate from the locked position to the unlocked position.

Rotating portion 186 includes an upper locking portion 192 for releasably coupling a corresponding lid locking portion 152 of lid 120 (see FIG. 23). As illustrated in FIGS. 35 and 36, upper locking portion 192 includes an upper locking lip 194. Upper locking lip 194 is configured to be received within groove 154 of lid locking portion 152 of lid 120 (see FIG. 24). As illustrated in FIG. 37, when locking lip 194 is received within groove 154 of lid locking portion 152, the upper locking portion 192 prevents movement of the lid 120 relative to the securing mechanism 180, thereby releasably and removably securing the lid 120 to the body 110 of container 100.

Figure 38:
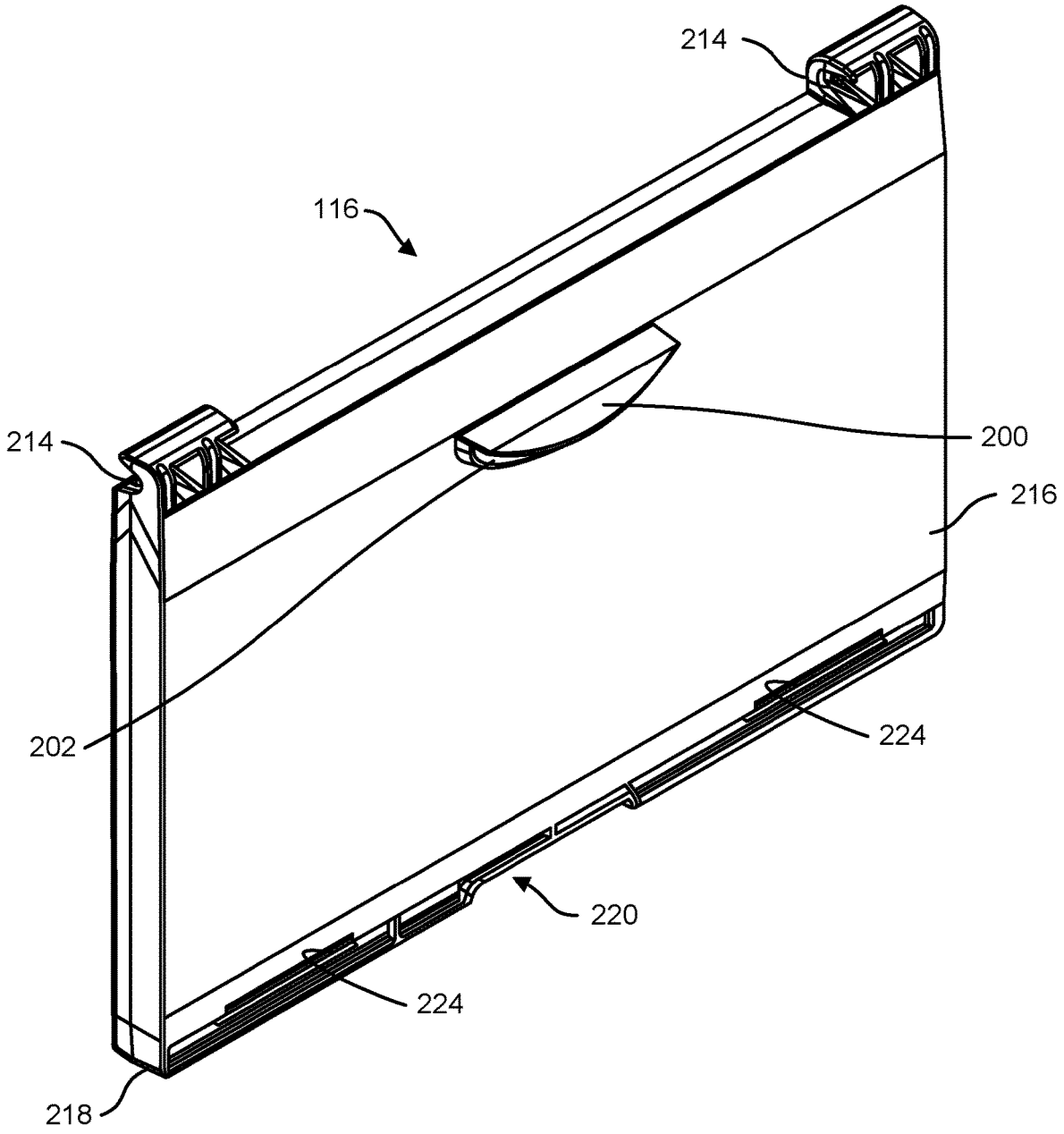
FIG. 38 illustrates an exemplary end panel of the portable storage container of FIG. 11A.

Rotating portion 186 includes a lower locking portion 196 for releasably coupling either a corresponding panel locking portion 200 positioned on end panel 116 (see FIG. 38) when the container 100 is in the expanded configuration or a corresponding base locking portion 204 positioned on base 112 (see FIG. 40) when the container is in the collapsed configuration. As illustrated in FIG. 36, lower locking portion 196 includes a lower locking lip 198.

When container 100 is in the expanded configuration (see FIG. 11A), lower locking lip 198 is configured to be received within groove 202 of panel locking portion 200 of end panel 116 (see FIG. 24). As illustrated in FIG. 37, when locking lip 198 is received within groove 202 of panel locking portion 200, the lower locking portion 196 prevents movement of the end panel 116 relative to the securing mechanism 180, thereby securing the end panel 116 in the vertical storage position and the container 100 in the expanded configuration.

Figure 40:
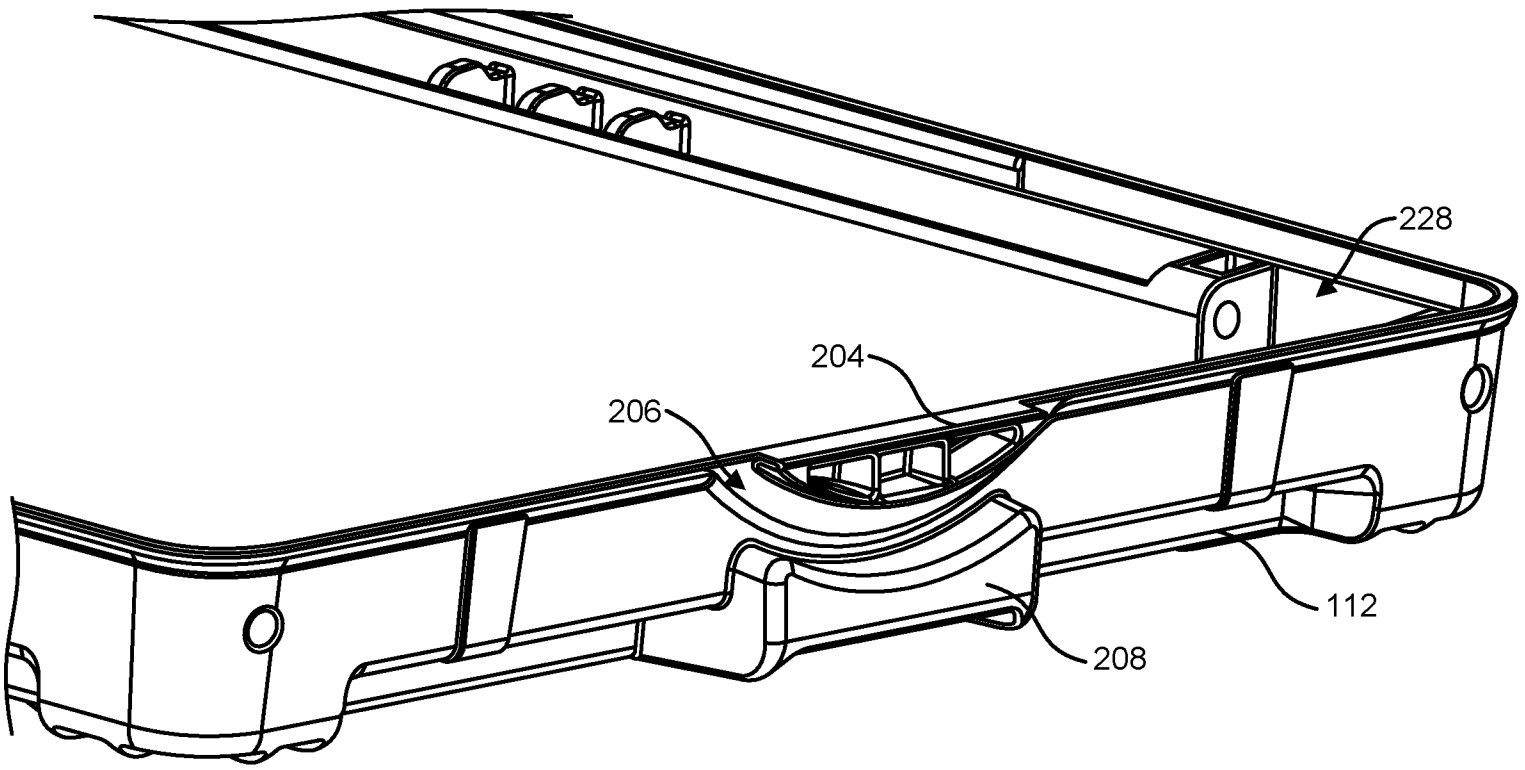
FIG. 40 illustrates a front view of an end portion of an exemplary base of the portable storage container of FIG. 11A.

When container 100 is in the collapsed configuration (see FIG. 19), lower locking lip 198 is configured to be received within groove 206 of base locking portion 204 of base 112 (see FIG. 40). When locking lip 198 is received within groove 206 of base locking portion 204, the lower locking portion 196 prevents movement of the base relative to the securing mechanism 180, thereby securing the container 100 in the collapsed configuration. As shown in FIG. 40, base 112 may further include a base locking guard 208 extending from the bottom of base 112. Guard 208 illustratively protects lower locking lip 198 to prevent securing mechanism 180 being inadvertently moved from a locked position to an unlocked position, such as during shipping of container 100.

In some exemplary embodiments, rotating the rotating portion 186 of securing mechanism 180 between the locked and unlocked positions moves the upper locking lip 194 of upper locking portion 192 from a locked position within the groove 154 of lid locking portion 152 to an unlocked position not within the groove 154, and simultaneously moves the lower locking lip 198 of lower locking portion 196 from a locked position within either the groove 202 of panel locking portion 200 or the groove 206 of base locking portion 204 to an unlocked position not within either groove 202 or 206. In some exemplary embodiments, the post 190, upper locking lip 194, and lower locking lip 198 are positioned in a substantially straight line. In some exemplary embodiments, the post 190, upper locking lip 194, lower locking lip 198, and button 182 are positioned in a substantially straight line.

As illustrated in FIGS. 14, 16, and 20, in some exemplary embodiments the container 100 includes two or more securing mechanisms 180. As shown in FIG. 14, the container 100 includes a first securing mechanism 180 positioned on a front side of upper perimeter portion 114 and configured to releasably engage a first lid locking portion 152 positioned on a front side of lid 120 and either a first panel locking portion 200 positioned on a front end panel 116 when the container 100 is in the expanded configuration (see FIG. 16) or a first base locking portion 204 positioned on a front side of base 112 when the container 100 is in the collapsed configuration (see FIG. 20). Container 100 is illustrated as also including a second securing mechanism 180 positioned on an opposite back side of upper perimeter portion 114 and configured to releasably engage a second lid locking portion 152 positioned on a back side of lid 120 and either a second panel locking portion 200 positioned on a back end panel 116 when the container 100 is in the expanded configuration (see FIG. 16) or a second base locking portion 204 positioned on a back side of base 112 when the container 100 is in the collapsed configuration (see FIG. 20).

Referring next to FIGS. 38, 39A, 39B, and 39C, an exemplary end panel 116 is illustrated. End panel 116 includes pivoting connectors 214 configured to rotatably connect end panel 116 to a receiver 228 in upper perimeter portion 114 with a pin 134. In some exemplary embodiments, each pivoting connector 214 has a substantially circular or semi-circular aperture for receiving pin 134. End panel 116 further includes a panel locking portion 200 on an outer surface 216. Panel locking portion 200 includes a groove 202 for receiving the lower locking lip 198 of securing mechanism 180. When the locking lip 198 is received within groove 202, the securing mechanism 180 resists the end panel 116 from rotating about the pivoting connectors 214 to move from the vertical storage position in the expanded configuration of container 100 to the horizontal shipping position in the collapsed configuration of container 100.

Figure 39A:
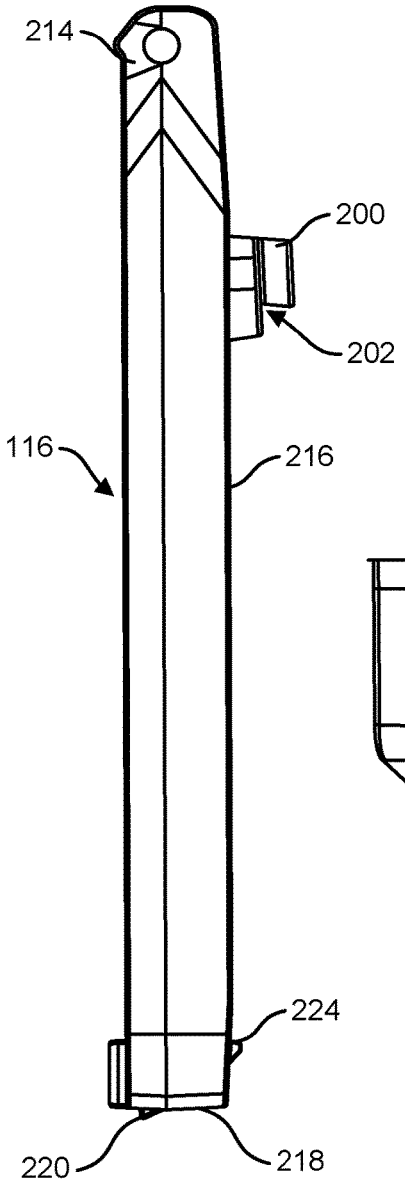
FIG. 39A illustrates a side view of the end panel in FIG. 11B.
Figure 39B:
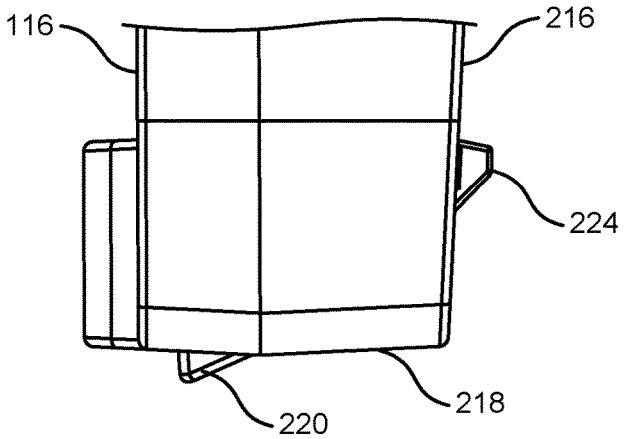
FIG. 39B illustrates a detail portion of FIG. 39A.
Figure 39C:
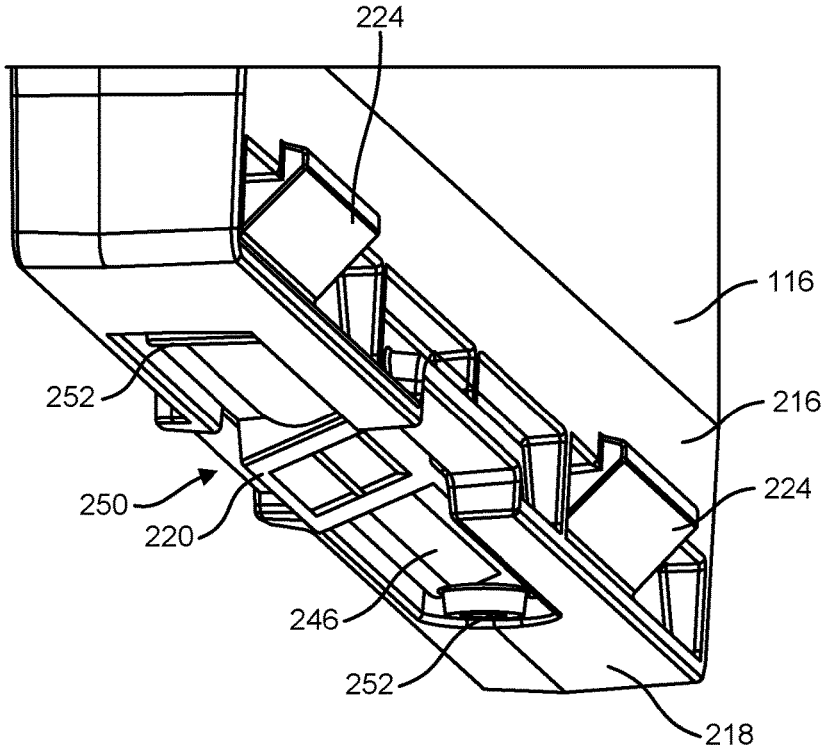
FIG. 39C illustrates a bottom perspective view of the end panel of FIG. 38.
Figure 49:
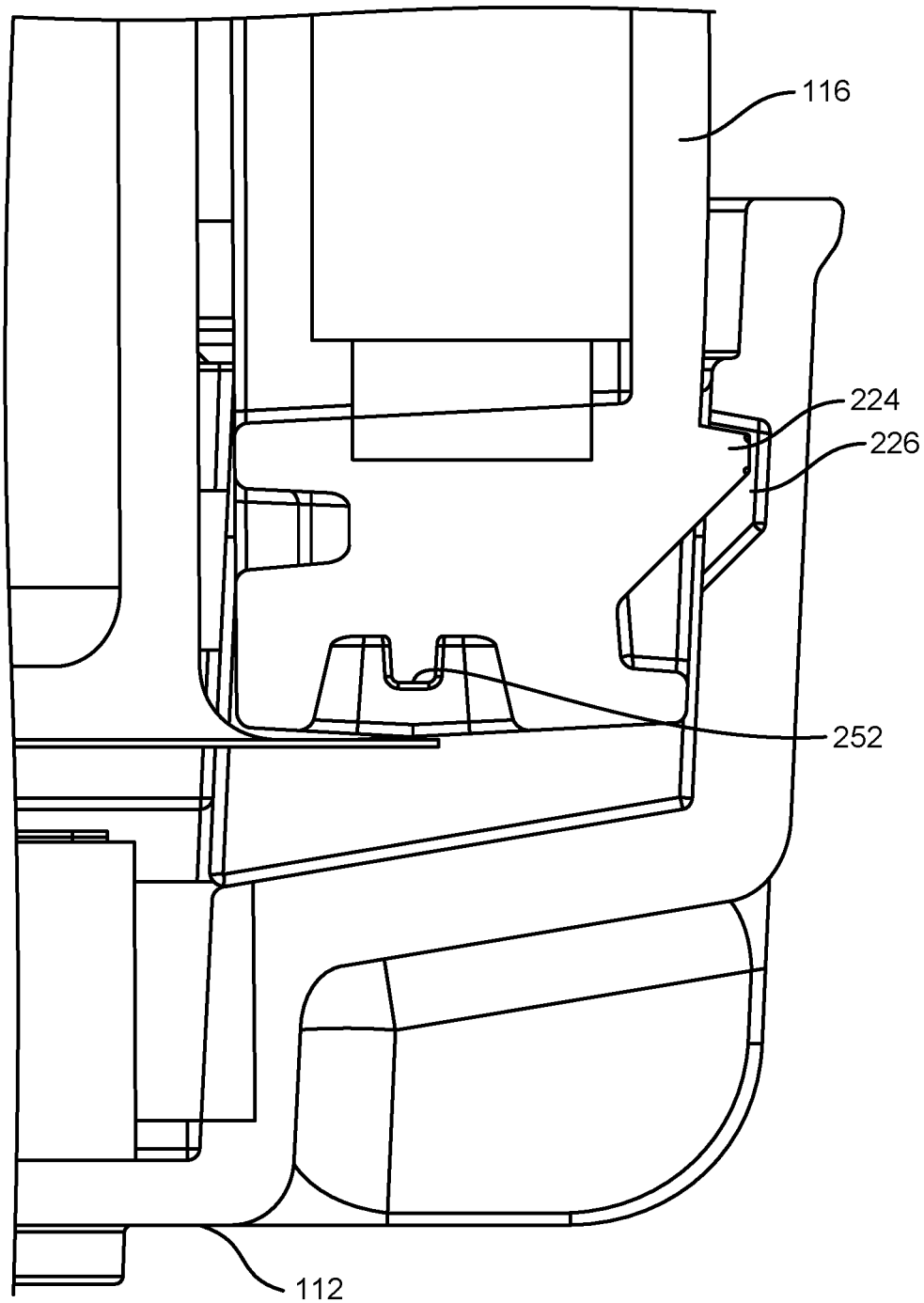
FIG. 49 illustrates another view of the locking member of FIG. 46 showing the side locking member.

As shown in FIG. 39C, in some exemplary embodiments the outer surface 216 of end panel 116 further includes locking latches 224. Each locking latch 224 is configured to be received within a corresponding recessed lip 226 of base 112 (see FIGS. 41 and 49). Each locking latch 224 is illustratively formed from a resilient or flexible material, such that the locking latch 224 deforms slightly as it is received within the corresponding recessed lip 226, and then locks the motion of end panel 116 with respect to base 112. Upon an application of a large enough force, the locking latch 224 again deforms and is released from the recessed lip 226, allowing movement of end panel 116 relative to base 112.

In some exemplary embodiments, a release mechanism 250 including a locking latch 220 is formed on a bottom surface 218 of end panel 116. Locking latch 220 is illustratively attached to the bottom surface 218 end panel 116 by a biasing member 246, and is moveable between a down, locked or latched position engaging a corresponding channel 222 in base 112 and an up, unlocked or unlatched position disengaging the channel 222 (see FIG. 41). In the exemplary embodiment illustrated in FIG. 39C, locking latch 220 is attached to a central portion of biasing member 246, while each end portion 252 of the biasing member is secured to the bottom surface 218 of end panel 116. In some exemplary embodiments, the biasing member is a spring biasing the locking latch 220 in a down, locked position.

Figure 50:
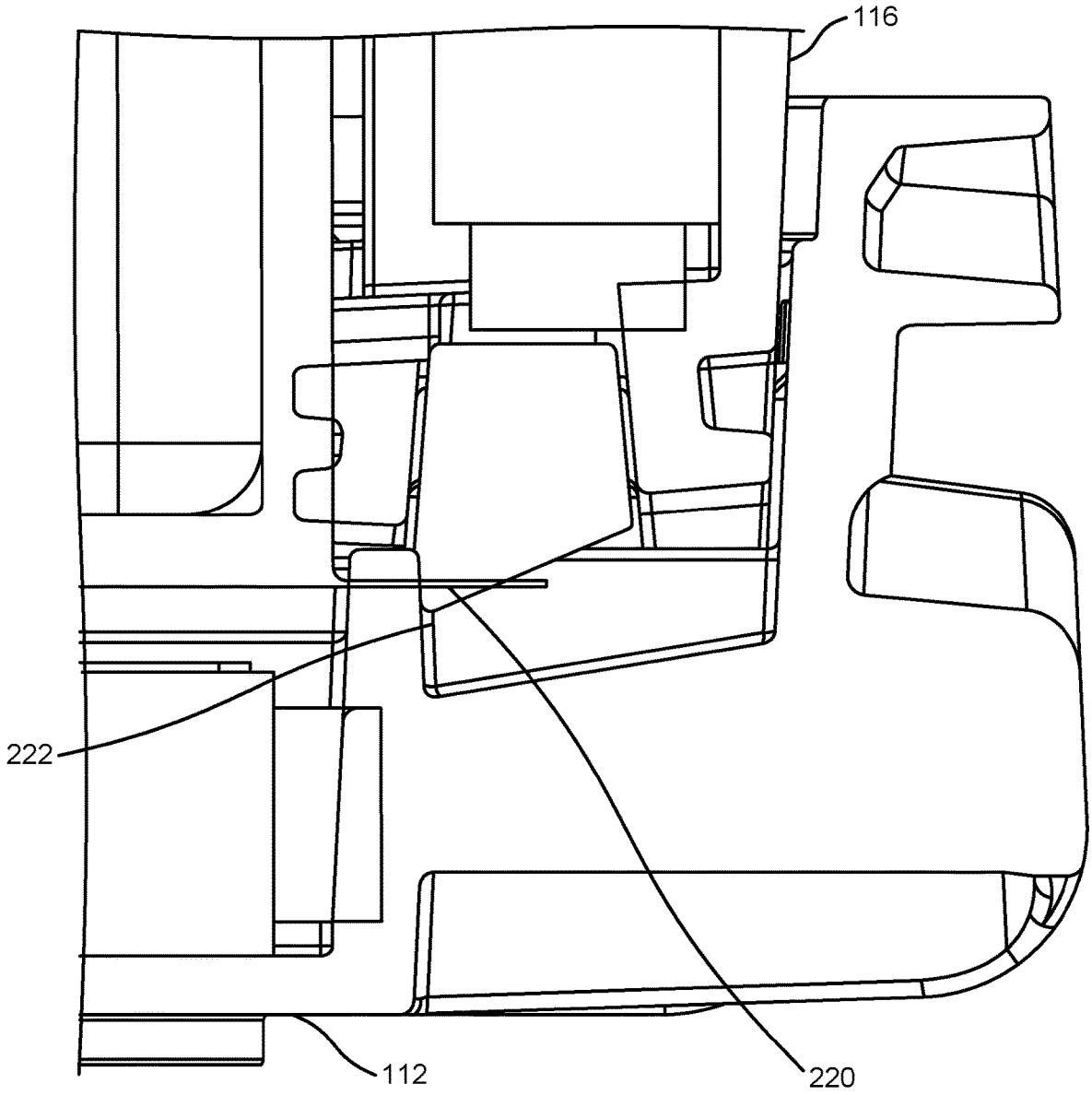
FIG. 50 illustrates still another view of the locking member of FIG. 46 showing the base locking member.

Locking latch 220 is illustratively received within a recess or channel 222 formed in base 112 (see FIG. 41) when locking latch 220 is in the locked position. As shown in FIG. 50, when locking latch 220 is in the locked position, channel 222 prevents locking latch 220 and the entire end panel 116 from moving relative to the base 112, thereby securing end panel 116 in the vertical storage position and container 100 in the expanded configuration. When locking latch 220 is moved from the locked position to the unlocked position, locking latch 220 clears the lip of channel 222, allowing end panel 116 to rotate from the vertical storage position to the horizontal shipping position, and thereby allowing container 100 to be placed in the collapsed configuration.

Figure 43:
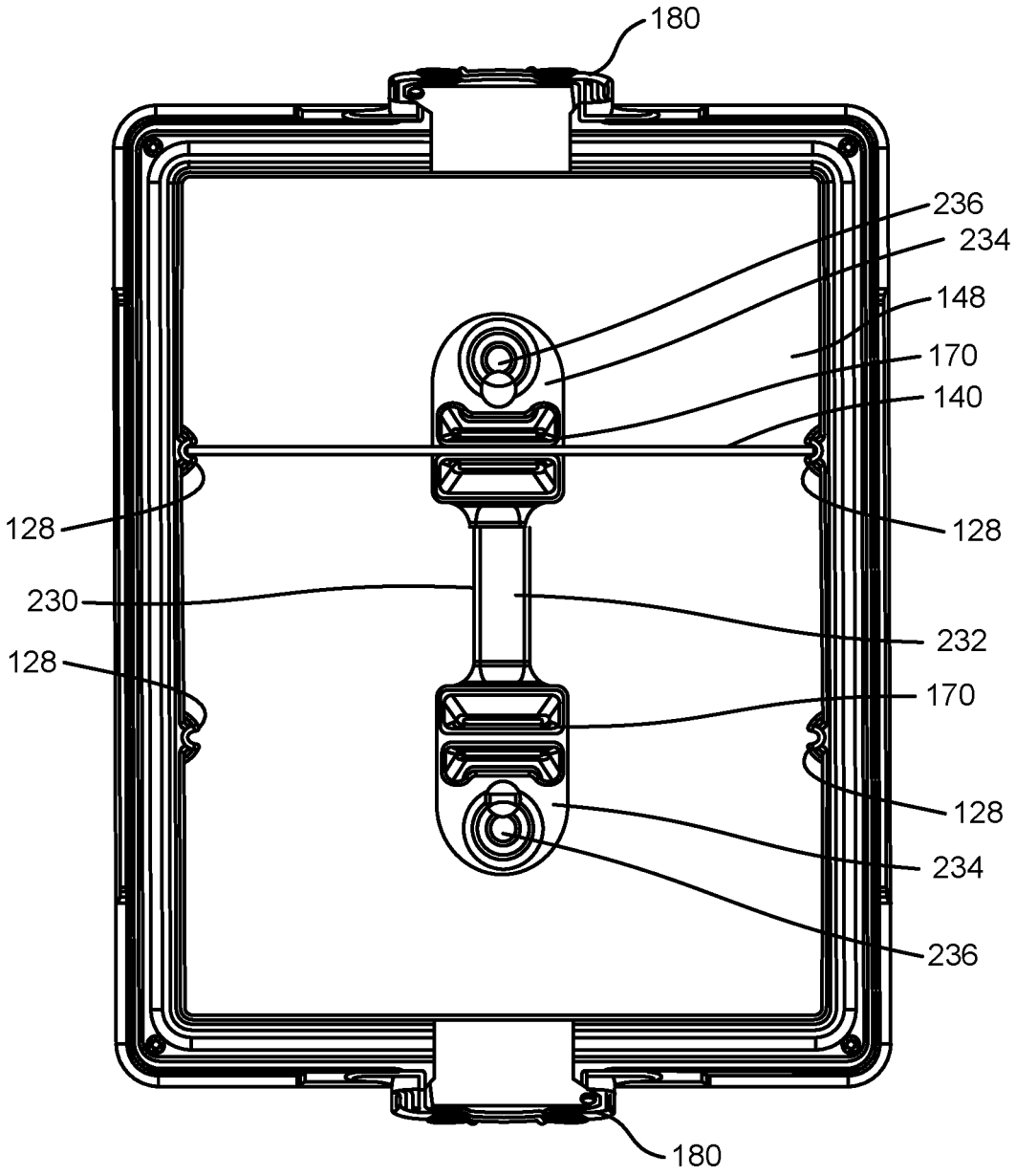
FIG. 43 illustrates a top sectional view of the portable storage container of FIG. 11B in the expanded configuration showing the internal storage area and handle.
Figure 44:
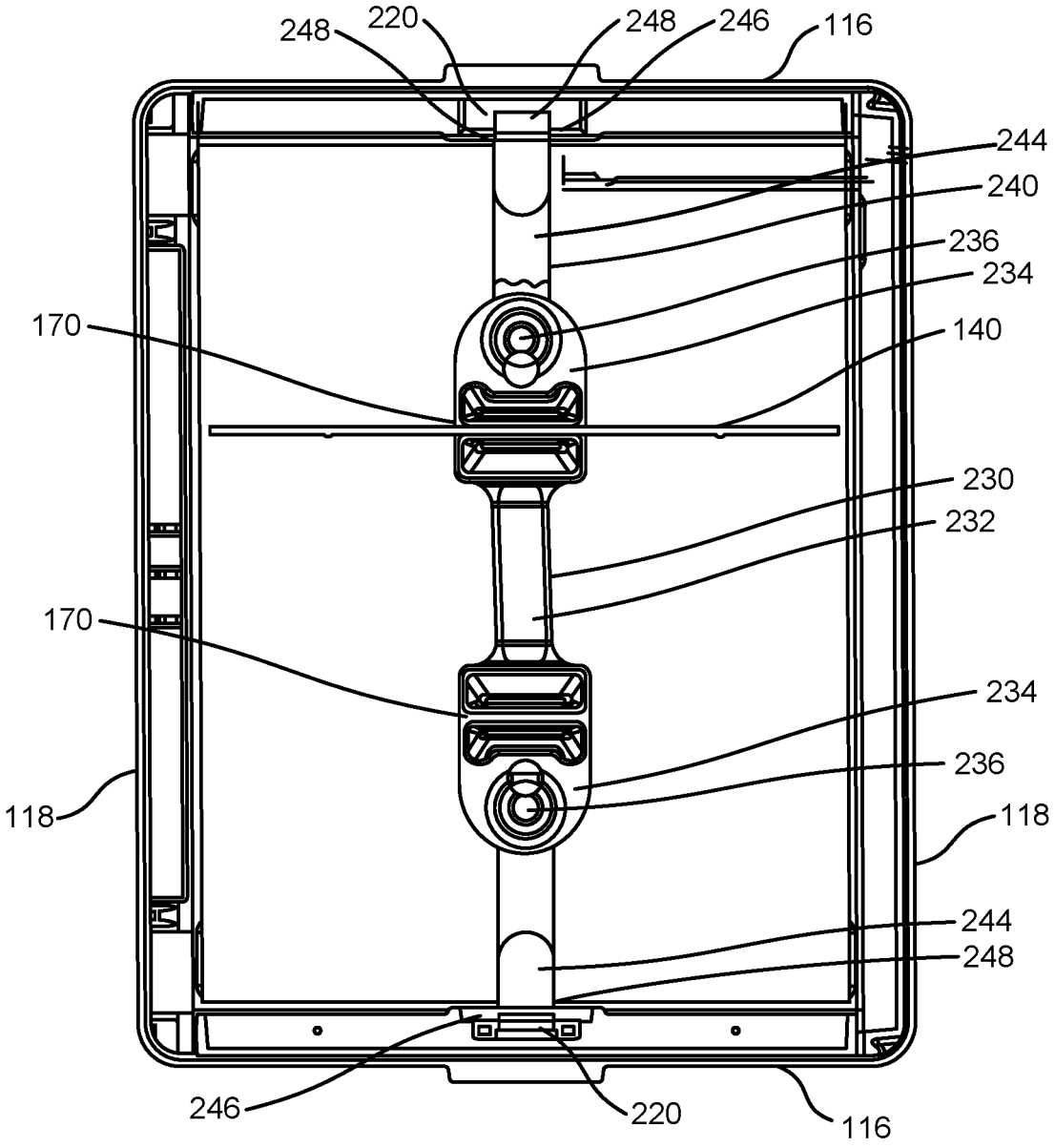
FIG. 44 illustrates a top sectional view of the portable storage container of FIG. 11B in the expanded configuration showing the internal storage area and handle with the liner not pictured.
Figure 45:
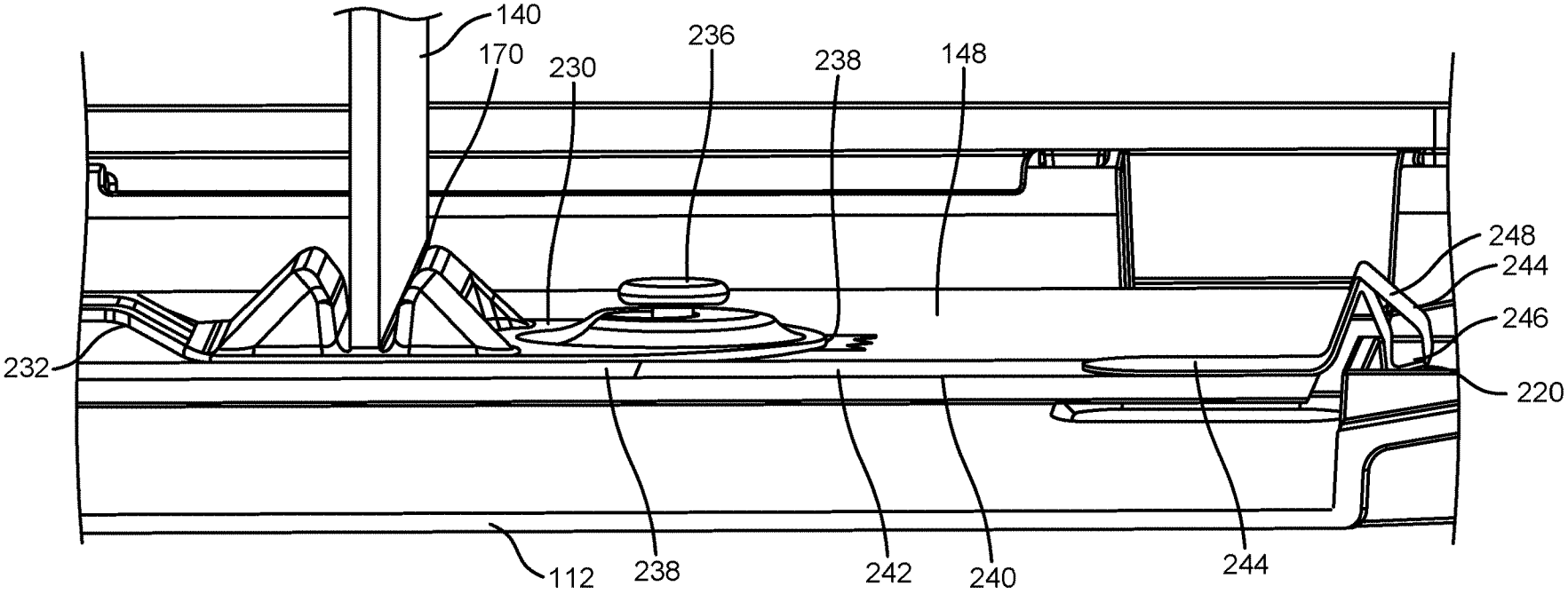
FIG. 45 illustrates a close up view of the portable storage container of FIG. 44 in the expanded configuration showing the handle and strap.
Figure 46:
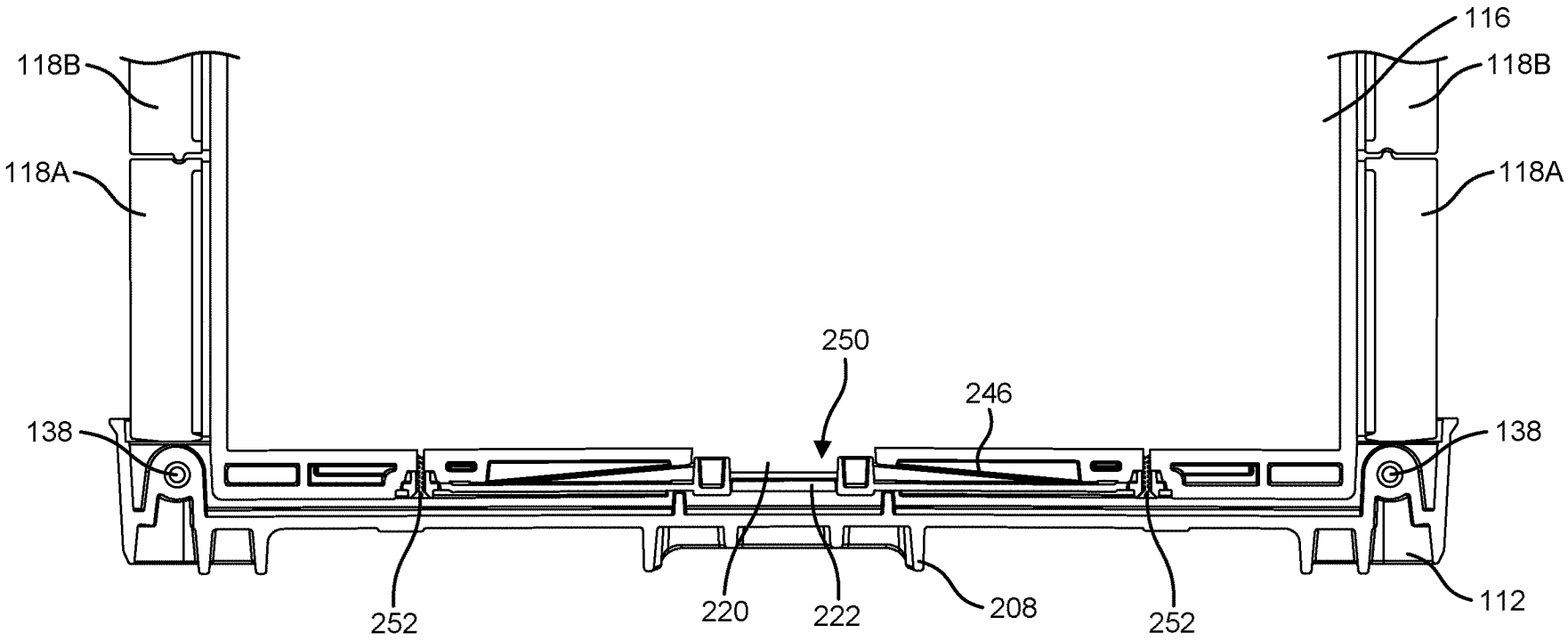
FIG. 46 illustrates the exemplary locking member of FIG. 42.
Figure 47:
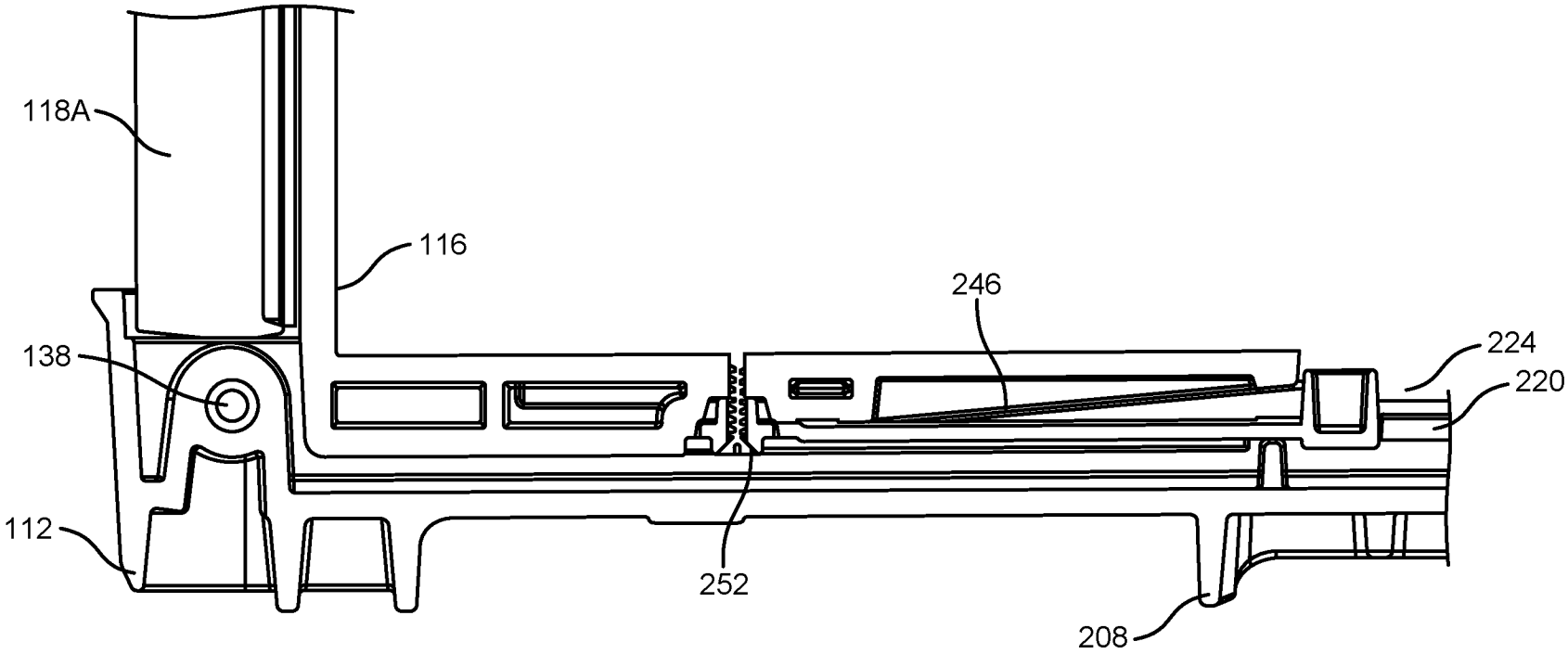
FIG. 47 illustrates a detail portion of FIG. 46 showing a portion of the locking member.
Figure 48:
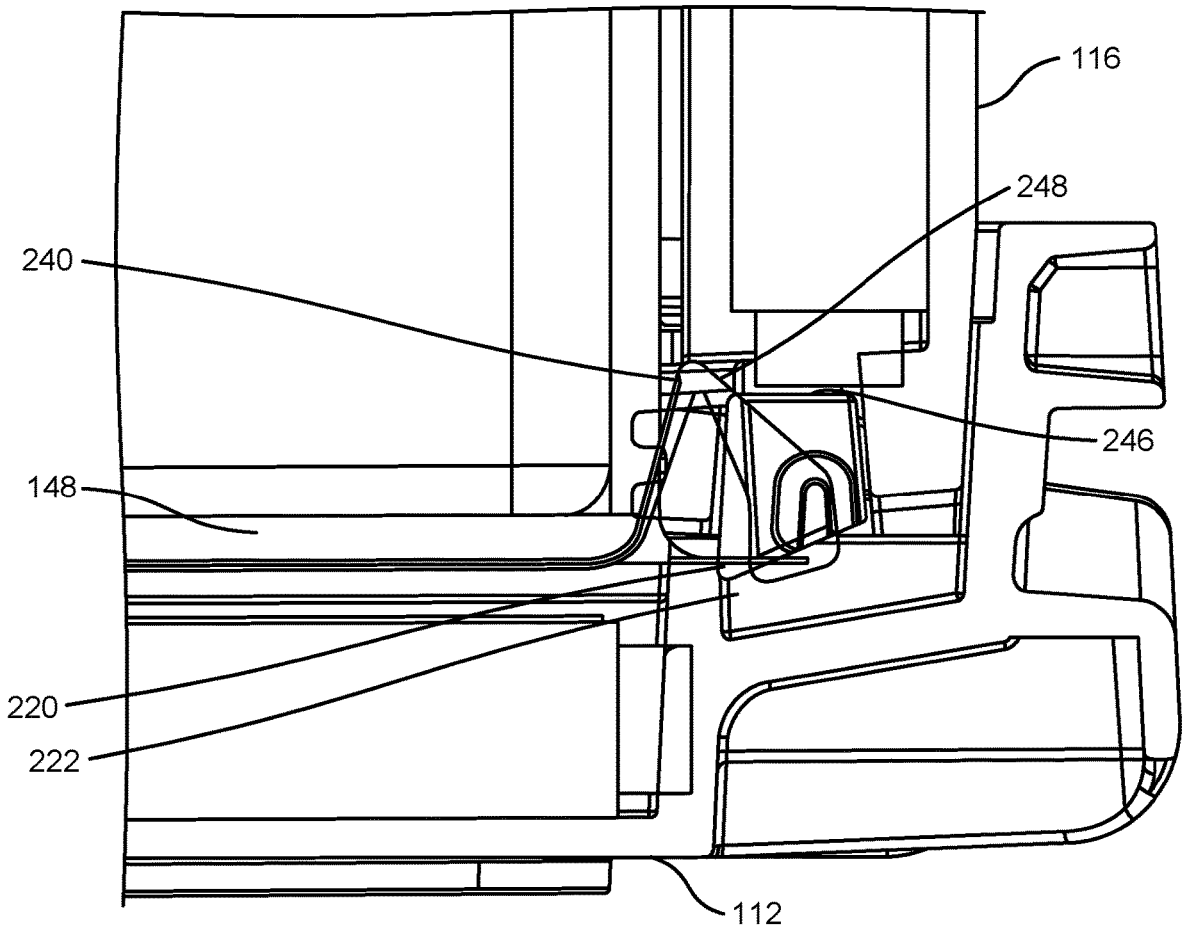
FIG. 48 illustrates the locking member of FIG. 46 showing the strap and base locking member.

Referring next to FIG. 43, a top view of container 100 with lid 120 removed is shown. FIG. 44 shows a sectional top view of the interior storage area 102 with the liner 148 not shown. FIG. 45 illustrates a side sectional view of the container 100 showing the handle 230 attached to the biasing member 246 and locking latch 220.

Handle 230 is accessed through the internal storage area 102 with the lid 120 removed. In some exemplary embodiments, handle 230 includes a grasping portion 232 extending above the surface of liner 148 and configured to be grasped by a user. The grasping portion 232 extends between end portions 234. The handle 230 may include one or more slots 170 for receiving divider 140. Each end portion 234 is illustratively attached to the liner 148.

In one exemplary embodiment, the end portion 234 is attached to a strap 240 extending below the liner 148 by an anchor 236 coupled to both the end portion 234 and the strap 240 and extending through liner 148. In some exemplary embodiments, strap 240 is detachable from liner 148 and/or biasing member 246.

In another exemplary embodiment (see FIG. 45), the end portion is attached to an anchor 236 that is attached to the inner surface 148A of liner 148, such as with a layer of suitable adhesive 238. The portion 242 of strap 240 under handle 230 is attached to the outer surface 148B of liner 148, such as with a layer of suitable adhesive 238. The inner surface 148A and outer surface 148B are continuous in the area of the liner proximate the handle 230, such that the liner is not pierced, punctured, or otherwise transversed by the attachment of the handle 230 to the strap 240.

As illustrated in FIG. 44, the handle 230 is operably coupled to a first biasing member 246 and first locking latch 220 on a front end panel 116 and a second biasing member 246 and second locking latch 220 on a back end panel 116 opposite the front end panel 116.

Referring next to FIGS. 42, 46, 47, and 48, a sectional view of body 110 and end panel 116 is illustrated. A lower portion of end panel 116 includes an aperture or slot 248 providing access to biasing member 246 from the internal storage area 102 of body 110. Strap 240 includes a portion 244 extending away from the handle 230 and the internal storage area 102 through slot 248 and engages biasing member 246 at a position below that of slot 248. When handle 230 is moved in a direction away from base 112, strap 240 pulls biasing member 246 in an upward direction towards slot 248 to move locking latch 220 from the locked position to an unlocked position. In some exemplary embodiments slot 248 does not permit biasing member 246 to pass into slot 248, transferring additional force and/or movement from the strap 240 to a lower portion of end panel 116.

With the container 100 in the expanded configuration, the button 182 of securing mechanism 180 is moved to the depressed position and the rotating portion 186 of securing mechanism 180 is moved from the locked position to the unlocked position, such that the lower locking lip 196 is not positioned within the panel locking groove 202. With the lid 120 removed, the handle 230 is configured such that as the handle 230 is moved, the strap 240 extending through the slots 248 in each end panel 116 exerts a force on the locking latch 220. Once the force overcomes the downward force of the biasing member 246, the locking latch 220 moves from the locked position to the unlocked position. Continued movement of the handle in a direction away from the base 112 results in the strap 240 continuing to pull both of the end panels 116 from a region near bottom surface 218, resulting in the locking latches 224 deforming and releasing from the recessed lips 226 of base 112, and each panel 116 moving from the vertical storage position to the horizontal shipping position. The panels 116 may be secured in the horizontal shipping position with one or more snap/détente 136. The hinge 130 of each side panel 118 is then collapsed inward, causing each lower side panel 118A and upper side panel 118B to rotate about pins 138 and the outer surface of each lower side panel 118A to be moved adjacent to the outer surface of the corresponding upper side panel 118B. The lid 120 may then be replaced on the body 110, and the rotating portion 186 of securing mechanism 180 is rotated back to the locked position until the spring 184 returns the button 182 to the extended position, the lower locking lip 198 is received within base locking groove 206, and the upper locking lip 194 is received within the lid locking groove 154, thereby securing the container 100 in the collapsed configuration.

With the container 100 in the collapsed configuration, the button 182 of securing mechanism 180 is moved to the depressed position and the rotating portion 186 of securing mechanism 180 is moved from the locked position to the unlocked position, such that the lower locking lip 196 is not positioned within the panel locking groove 202 and upper locking lip 194 is not positioned within the lid locking groove 154. The lid 120 may be removed, and the hinge 130 of each side panel 118 is expanded, causing each lower side panel 118A and upper side panel 118B to rotate about pins 138 and the outer surface of each lower side panel 118A to be moved substantially continuous to the outer surface of the corresponding upper side panel 118B to form an outer surface of the side 260. The end panels 116 are then pivoted downwardly with respect to the upper perimeter portion from the horizontal shipping position to the vertical storage position. The locking latch 220 of each end panel 116 is received within the corresponding channel 222 in the base 112, and locking latches 224 are received within the corresponding recessed lips 226 of the base 112. The biasing member moves the locking latch 220 to the locked position. The liner 148 may be pushed into the storage area 102 until the outer surface 148 contacts the base 112. The lid 120 may then be replaced on the body 110, and the rotating portion 186 of securing mechanism 180 is rotated back to the locked position until the spring 184 returns the button 182 to the extended position, the lower locking lip 198 is received within panel locking groove 202, and the upper locking lip 194 is received within the lid locking groove 154, thereby securing the container 100 in the expanded configuration.

In addition to the primary internal storage areas or compartments, container 100 may also include one or more other storage areas, storage pockets, or storage compartments for carrying other items. Container 100 may also include one or more other accessories, such as a rechargeable battery, a solar cell, a light, a liquid storage bladder, a first aid kit, a toolkit, and/or one or more thermometers for indicating temperature of one or more of the storage areas. In some configurations, one or more of the additional pockets, storage compartments, and/or dry storage areas may be on an interior surface of container 100.

In addition, container 100 may include one or more powered cooling or heating units for assisting in keeping items cold or warm, respectively, before transport, after delivery, and/or for some portion of the shipping process. In other words, the features disclosed herein may be supplemented by a powered cooling or heating unit when power is available and container 100 can be attached to the power source. In further examples, container 100 may include one or more contained power sources, such as a battery or solar panel, for temporarily providing power to the cooling or heating unit without tethering it to a power source.

Container 100 may also include one or more attachment areas or attachment points for removably attaching one or more accessories or other items to container 100. Attachment points may include any of a variety of attachment mechanisms, structures, elements, or features including any described in U.S. patent application Ser. No. 15/398,468, filed Jan. 4, 2017, which is hereby incorporated by reference in its entirety.

Any of the techniques, improvements, features, functions, or processes described herein may be implemented in the form of a system or a kit. The system or kit may include any combination of the devices, components, elements, and/or modules disclosed herein.

The elements, components, and steps described herein are meant to exemplify some types of possibilities. In no way should the aforementioned examples limit the scope of the invention, as they are only exemplary embodiments.

The phrases "in some embodiments," "in an exemplary embodiment," "in one exemplary embodiment," "in some exemplary embodiments," "according to some embodiments," "in the embodiments shown," "in other embodiments," "in some examples," "in other examples," "in some cases," "in some situations," "in one configuration," "in another configuration," and the like generally mean that the particular technique, feature, structure, or characteristic following the phrase is included in at least one embodiment of the present invention and/or may be included in more than one embodiment of the present invention. In addition, such phrases do not necessarily refer to the same embodiments or to different embodiments.

The foregoing disclosure has been presented for purposes of illustration and description. Other modifications and variations of the disclosed techniques may be possible in view of the above teachings. The embodiments described in the foregoing disclosure were chosen to explain the principles of the concept and its practical application to enable others skilled in the art to best utilize the invention. It is intended that the claims be construed to include other alternative embodiments of the invention, except as limited by the prior art.

What is claimed is:

1. A collapsible shipping container having a first configuration and a second configuration, the shipping container comprising:

an insulated base;

an insulated upper perimeter portion;

a plurality of insulated side panels extending between the upper perimeter portion and the base, each of the plurality of the insulated side panels being movable between a respective first position and a respective second position, wherein the shipping container is in the first configuration when all of the insulated side panels are in the respective first positions and wherein the shipping container collapses into the second configuration when all of the side panels are in the respective second positions, the collapsible shipping container having a height in the first configuration that is greater than a height of the shipping container in the second configuration;

an insulated lid removably attachable to the upper perimeter portion for selectively closing and accessing an internal storage volume of the shipping container, the internal storage volume defined by the insulated base, the plurality of insulated side panels, the insulated upper perimeter portion and the insulated lid;

a latching mechanism for temporarily maintaining the shipping container in the first configuration, wherein the latching mechanism latches at least two of the insulated side panels in the respective first positions to temporarily maintain the shipping container in the first configuration;

a flexible liner attached to the upper perimeter portion and configured to line the internal storage volume, the flexible liner have a first surface facing the internal storage volume and a second surface facing at least one of the insulated base and the insulated side panels, the flexible liner having a handle attached to the first surface, the handle accessible from inside the internal storage volume; and a strap attached to the second surface of the flexible liner and attached to the latching mechanism, wherein the strap disengages the latching mechanism when the handle of the flexible liner is pulled from the internal storage volume, the disengaging of the latching mechanism permitting the shipping container to transition from the first configuration to the second configuration.

2. The collapsible shipping container of claim 1 wherein the latching mechanism includes a first latching apparatus associated with a first panel of the plurality of insulated side panels and a second latching apparatus associated with a second panel of the plurality of side panels, the second panel being opposite the first panel.

3. The collapsible shipping container of claim 2 wherein the first and second panels pivot inward toward the internal storage volume enabling the shipping container to transition from the first configuration to the second configuration.

4. The collapsible shipping container of claim 2 wherein a third panel of the plurality of insulated side panels is opposite a fourth panel of the plurality of insulated side panels, each of the third and fourth panels having an upper portion connected to a lower portion by a hinging element.

5. The collapsible shipping container of claim 2 wherein each latching apparatus includes a movable biased tab attached to the respective side panel, the movable biased tab extending into a slot in the insulated base to temporarily retain the respective side panel in the respective first position.

6. The collapsible shipping container of claim 5 wherein a force applied to the strap retracts the biased tabs from the slots in the insulated base to unlatch the latching mechanism.

7. The collapsible shipping container of claim 1 wherein the strap is attached to the flexible liner without piercing the flexible liner, the strap is detachable from the flexible liner, and the flexible liner is removable from the collapsible shipping container.

8. The collapsible shipping container of claim 1 further comprising a hoop configured to secure the flexible liner to the insulated upper perimeter portion.

9. The collapsible shipping container of claim 1 wherein the insulated lid includes one or more receptacles for receiving an ice pack and one or more shelves for retaining the ice pack, each shelf including one or more convection apertures.

10. A configurable shipping container having a first configuration and a second configuration, the shipping container comprising:

an base;

an upper portion;

a plurality of side panels extending between the upper portion and the base, each of the plurality of the side panels being movable between a first position and a second position, wherein the shipping container is in the first configuration when all of the side panels are in the respective first positions and wherein the shipping container is in the second configuration when all of the side panels are in the respective second positions, the first configuration of the shipping container having a volume that is greater than a volume of the second configuration;

a lid for selectively accessing and closing an internal storage volume of the shipping container, the internal storage volume defined by the base, the upper portion, the plurality of side panels, and the lid;

latching mechanisms for temporarily maintaining the shipping container in the first configuration, wherein the latching mechanisms temporarily latch at least two of the side panels in the respective first positions to temporarily maintain the shipping container in the first configuration;

a flexible liner attached to the upper portion and configured to line at least a portion of the internal storage volume of the shipping container; and a strap attached to the flexible liner and the latching mechanisms, wherein the strap disengages the latching mechanisms when the flexible liner is pulled away from the internal storage volume, the disengaging of the latching mechanisms releasing the at least two of the side panels from the respective first positions thereby permitting the shipping container to transition from the first configuration to the second configuration.

11. The configurable shipping container of claim 10 wherein the flexible liner includes a handle attached to an inner surface of the flexible liner, the handle accessible from the internal storage volume.

12. The configurable shipping container of claim 10 wherein one or more of the base, the side panels, and the lid include vacuum insulated panels.

13. The configurable shipping container of claim 10 further including a securing mechanism for securing the configurable shipping container in the second configuration.

14. The configurable shipping container of claim 10 wherein the at least two of the side panels are opposite each other and hinge inward toward the internal storage volume when in the respective second positions.

15. The configurable shipping container claim 10 wherein the lid includes:

a first receptacle and a second receptacle that face the internal storage volume when the lid is in the closed position, each of the first and second receptacles configured to receive one or more ice packs;

a first shelf and a second shelf, each shelf configured to cover at least a portion of a respective one of the first and second receptacles to hold the one or more ice packs in the respective one of the receptacles;

a slot between the first and second receptacles; and a removable divider for dividing the internal storage volume into a first storage compartment and a second storage compartment when the shipping container is in an expanded configuration, wherein a slot proximate the base and the slot in the lid receive respective edges of the divider for holding the divider in place, and wherein the first receptacle is associated with the first storage compartment and the second receptacle is associated with the second storage compartment.

16. An insulated portable storage container movable between an expanded configuration and a collapsed configuration, the container comprising:

a body having an internal cavity for storing one or more items, the body comprising:

an insulated upper perimeter portion;

an insulated base first and second opposing side panels each connected to the base, wherein the first side panel includes an insulated first upper portion pivotably attached to the perimeter portion and an insulated first lower portion pivotably attached to the base and the second side panel includes an insulated second upper portion pivotably attached to the perimeter portion and an insulated second lower portion pivotably attached to the base; and first and second opposing insulated end panels pivotably attached to the upper perimeter portion, wherein the first and second opposing end panels each extend between the perimeter portion and the base in a vertical storage position when the portable storage container is in the expanded configuration and wherein the first and second opposing end panels each extend from the perimeter portion substantially parallel to the base in a horizontal shipping position when the portable storage container is in the collapsed configuration;

a liner at least partially positioned in the internal cavity, the liner including a handle operably connected to the first end panel, wherein the handle is configured such that a first movement of the handle is configured to move the first end panel from the vertical storage position to the horizontal shipping position; and an insulated lid configured to engage the body to removably seal the internal cavity.

17. The insulated portable storage container of claim 16, wherein the first end panel further includes a movable locking member extending from a surface of the first end panel, wherein the locking member is configured such that the first movement of the handle moves the locking member from a locked position in which the locking member resists the movement of the first end panel from the vertical storage position to the horizontal shipping position to an unlocked position in which the locking member permits the movement of the first end panel from the vertical storage position to the horizontal shipping position.

18. The insulated portable storage container of claim 16, wherein the insulated upper perimeter portion includes a securing mechanism including a locking lip, the locking lip configured to releasably engage an end panel locking portion of the first end panel to prevent movement of the first end panel relative to the upper perimeter portion when the portable storage container is in the expanded configuration, and the locking lip configured to releasably engage a base locking portion of the base to prevent movement of the base relative to the upper perimeter portion when the portable storage container is in the collapsed configuration.

* * * * *